US006766734B2

(12) United States Patent
Geddes et al.

(10) Patent No.: US 6,766,734 B2
(45) Date of Patent: Jul. 27, 2004

(54) TRANSFER SHEET FOR CERAMIC IMAGING

(75) Inventors: Pamela A. Geddes, Alden, NY (US); Barry J. Briggs, Kelowna (CA); Daniel J. Harrison, Pittsford, NY (US); William C. Froass, Baldwinsville, NY (US); James A. Nellis, Phelps, NY (US)

(73) Assignee: International Imaging Materials, Inc., Amherst, NY (US)

( * ) Notice: Subject to any disclaimer, the term of this patent is extended or adjusted under 35 U.S.C. 154(b) by 105 days.

(21) Appl. No.: 10/265,013

(22) Filed: Oct. 4, 2002

(65) Prior Publication Data

US 2004/0003742 A1 Jan. 8, 2004

Related U.S. Application Data

(63) Continuation-in-part of application No. 10/080,783, filed on Feb. 22, 2002, which is a continuation-in-part of application No. 09/961,493, filed on Sep. 22, 2001, now Pat. No. 6,629,792, which is a continuation-in-part of application No. 09/706,415, filed on Oct. 31, 2000, now Pat. No. 6,481,353.

(51) Int. Cl.[7] ..... B41D 7/00

(52) U.S. Cl. ..... 101/33; 156/230; 156/277; 428/914

(58) Field of Search ..... 101/33, 34, 483, 101/487, 488, 491, 492; 156/89.11, 230, 233, 237, 277; 427/145, 147, 148, 149; 428/354, 914

(56) References Cited

U.S. PATENT DOCUMENTS

| | | | | | |
|---|---|---|---|---|---|
| 4,971,858 | A | * | 11/1990 | Yamano et al. | 428/32.5 |
| 5,069,954 | A | * | 12/1991 | Cole et al. | 428/202 |
| 5,132,165 | A | * | 7/1992 | Blanco | 428/210 |
| 5,665,472 | A | * | 9/1997 | Tanaka et al. | 428/32.71 |
| 6,149,747 | A | * | 11/2000 | Lorenz et al. | 156/89.11 |

FOREIGN PATENT DOCUMENTS

| | | | | | |
|---|---|---|---|---|---|
| JP | 02036998 | A | * | 2/1990 | B41M/5/30 |

* cited by examiner

*Primary Examiner*—Ren Yan
(74) *Attorney, Agent, or Firm*—Howard J. Greenwald

(57) ABSTRACT

A covercoated transfer sheet for transferring images to a ceramic substrate. The covercoated transfer sheet contains a flat, flexible substrate and a transferable covercoat releaseably bound to the flat, flexible substrate. When the transferable covercoat is printed with an image to form an imaged covercoat, the image has a higher adhesion to the covercoat than the covercoat has to the flexible substrate. The imaged covercoat has an elongation to break of at least about 1 percent, and it can be separated from the flexible substrate with a peel force of less than about 30 grams per centimeter.

16 Claims, 32 Drawing Sheets

TRANSFER SHEET FOR CERAMIC IMAGING

CROSS-REFERENCE TO RELATED PATENT APPLICATION

This application is a continuation-in-part of patent application Ser. No. 10/080,783, filed on Feb. 22, 2002, which in turn was a continuation in part of patent application Ser. No. 09/961,493, filed on Sep. 22, 2001, now U.S. Pat. No. 6,629,792, which in turn was a continuation-in-part of patent application U.S. Ser. No. 09/702,415, filed on Oct. 31, 2000, now U.S. Pat. No. 6,481,353.

FIELD OF THE INVENTION

A covercoated thermal transfer sheet for transferring an image to a ceramic substrate at ambient temperature.

BACKGROUND OF THE INVENTION

U.S. Pat. No. 5,069,954 of Donald Cole et al. describes a transfer assembly for use with automatic offset application equipment. The patent claims: "1. A ceramic transfer for use with automatic offset application equipment wherein the transfer is applied to ware by means of a printing pad, the transfer comprising, in sequence, a backing paper, release layer, design layer and covercoat layer, in which the covercoat layer is formed from a heat-activatable adhesive and extends over an area greater than that of the design layer so as to cover the design layer and provide a marginal portion of the covercoat layer which is in direct contact with the release layer, and the design layer is formed from a printing ink the medium of which has heat-activatable adhesive properties, the covercoat layer being such that when its adhesive is heat-activated, the marginal portion thereof has a lower coefficient of adhesion to the release layer than for the printing pad and the covercoat has a lower coefficient of adhesion for the printing pad than the marginal portion of the covercoat and the design layer have for the ware so that the design layer can be separated from the release layer and transferred to the ware by the pad."

It is disclosed in the Cole et al. patent that the prior art systems must be operated within certain specified temperature ranges. Thus, e.g., in the last paragraph of column 1 of U.S. Pat. No. 5,069,954, it is disclosed that: "We have found . . . it is difficult . . . to achieve consistent clean transfer without the use of an overlying adhesive layer to aid separation from the backing paper. Furthermore, the development of adhesive properties only within specified temperature ranges, as taught by U.S. Pat. No. 3,967,021, renders the successful operation of the process vulnerable to changers in ambient temperature and/or time delays . . . . "

The process of the Cole et al. patent also requires the use of ". . . specified temperature ranges . . . . " Thus, as is disclosed at lines 37 to 44 of column 5 of this patent, "Typically, the pad is maintained at a temperature of 100 degrees–130 degrees C. and a heated vacuum platen or base plate is maintained at a temperature of 70 degrees–100 degrees C. . . . . " When temperatures in excess of those specified are used in the Cole et al. process, distortion of the image being transferred often occurs.

However, the time at which the transfer paper is heated in the Cole et al. process is critical. This dwell time is described at lines 42 to 44 of column 5 of such patent, wherein it is taught that: "Typically, the pad resides on the ware for approximately half a second to ensure adequate adhesion of the design layer to the ware." Dwell times substantially longer than about half a second often causes distortion of the image being transferred when the Cole et al. process is used.

In the ceramic transfer assembly described in the Cole et al. patent, an image or design layer is printed upon a wax release layer (see, e.g., lines 63 to 66 of column 3 of the patent). Such a wax release layer is not optimally suited for receiving printed images due to its lower surface energy; and the images thus received often lack sufficient adhesion and often have poor image quality. Because of its poor adhesive qualities, the image printed on the release layer requires a covercoat layer in the Cole et al. assembly. It is expensive, difficult, and cumbersome to covercoat an image once it has been printed onto the wax release layer.

Furthermore, the process of U.S. Pat. No. 5,069,954 is limited in that it requires the use of pad transfer equipment and heat transfer paper and, thus, cannot be used, e.g., at ambient temperature.

It is an object of this invention to provide a process for transferring an image to a ceramic substrate which is readily adapted to use with substrates that need not have flat surfaces.

It is another object of this invention to provide a process for transferring an image to a ceramic substrate that need not be operated at elevated temperatures.

It is yet another object of this invention to provide a process for transferring an image to a ceramic substrate that need not be operated within a specified period of time.

It is yet another object of this invention to provide a process and an assembly for transferring an image to a ceramic substrate that provides better adhesion and print quality than does the process of U.S. Pat. No. 5,069,954.

It is yet another object of this invention to provide a covercoated transfer sheet for transferring images to a ceramic substrate which sheet is readily adapted for use in the process of the invention.

SUMMARY OF THE INVENTION

In accordance with this invention, there is provided a covercoated transfer sheet for transferring images to a ceramic substrate, wherein said covercoated transfer sheet is comprised of a flat, flexible substrate and a transferable covercoat releaseably bound to said flat, flexible substrate, wherein, when said transferable covercoat is printed with an image to form an imaged covercoat, said image has a higher adhesion to said covercoat than said covercoat has to said flexible substrate, said imaged covercoat has an elongation to break of at least about 1 percent, and said imaged covercoat can be separated from said flexible substrate with a peel force of less than about 30 grams per centimeter.

BRIEF DESCRIPTION OF THE DRAWINGS

The invention will be described by reference to this specification and the attached drawings, in which like numerals refer to like elements, and in which.

Figure 1:
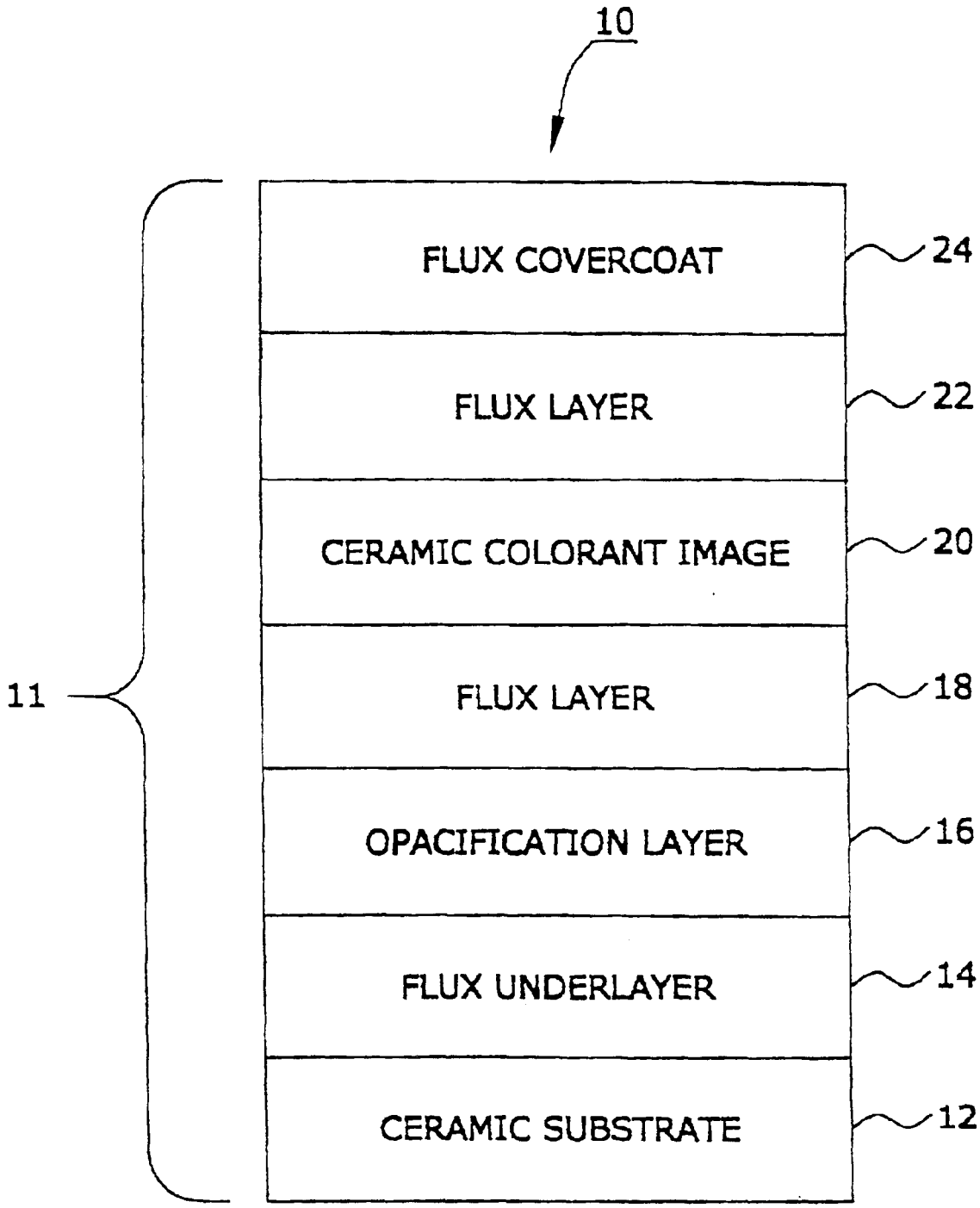
FIG. 1 is a schematic representation of a ceramic substrate to which a color image has been transferred in accordance with the invention.
Figure 6:
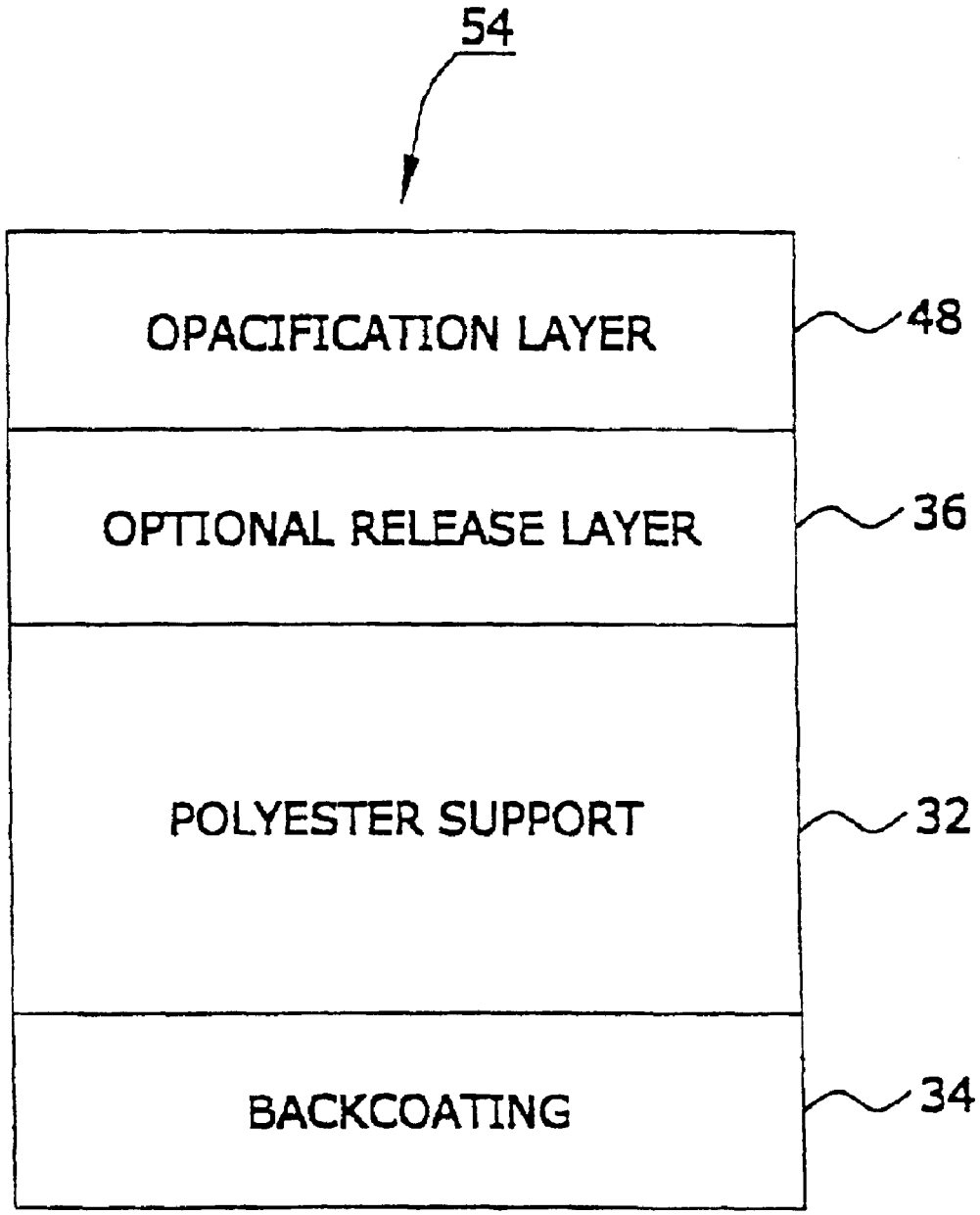
Figure 6A:
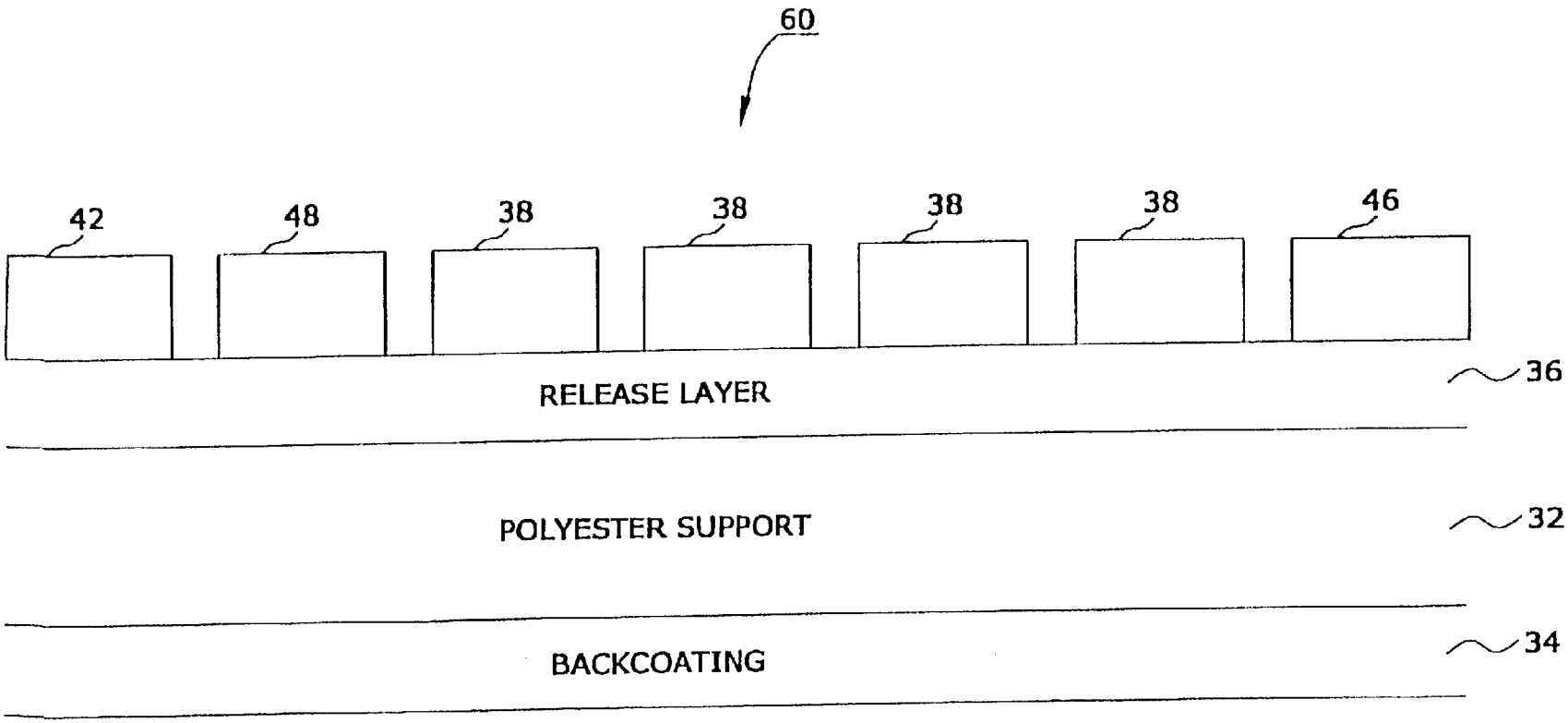
Figure 7:
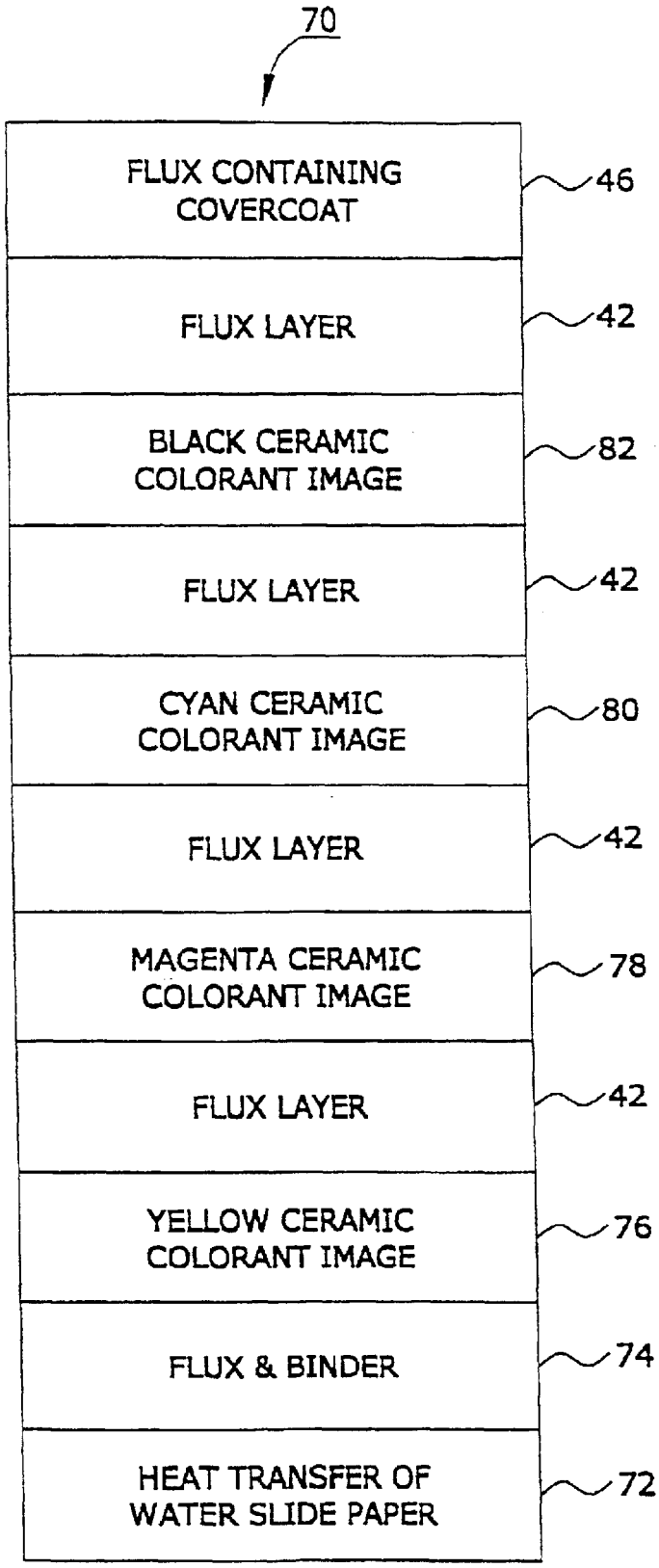
Figure 8:
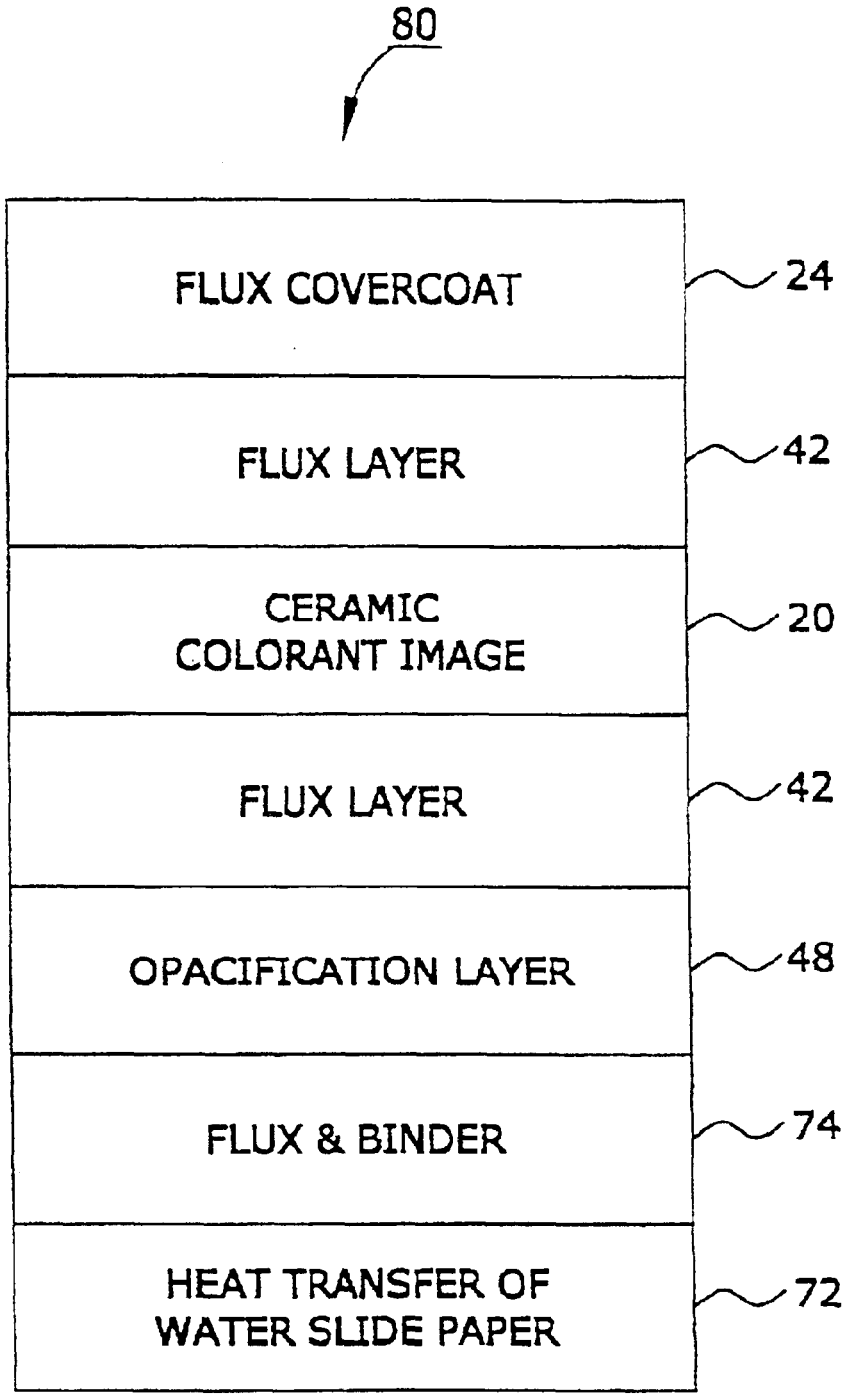
Figure 12:
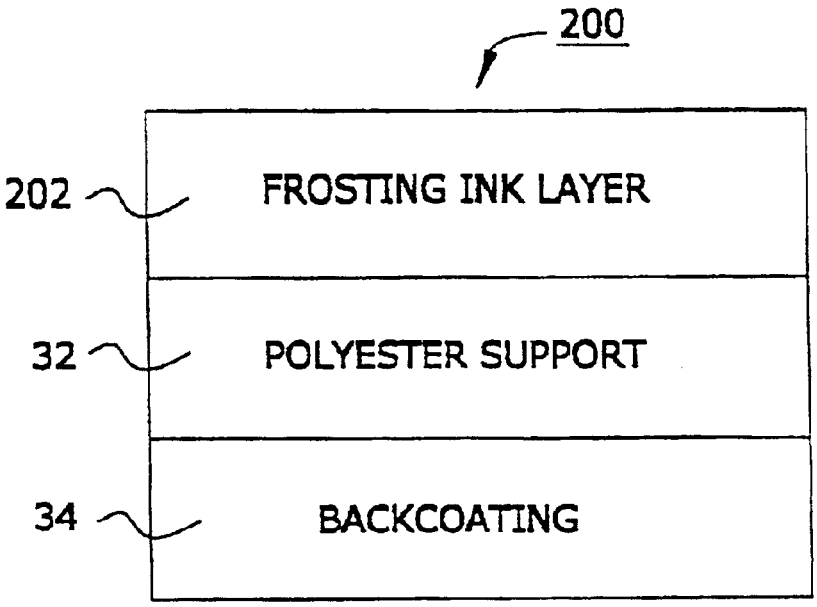
Figure 13:
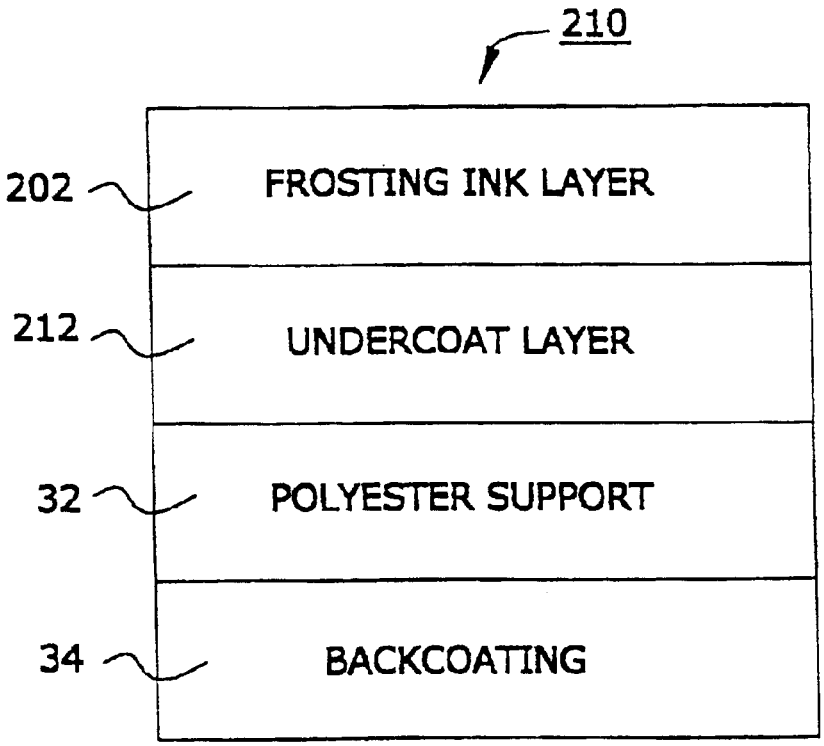
Figure 13B:
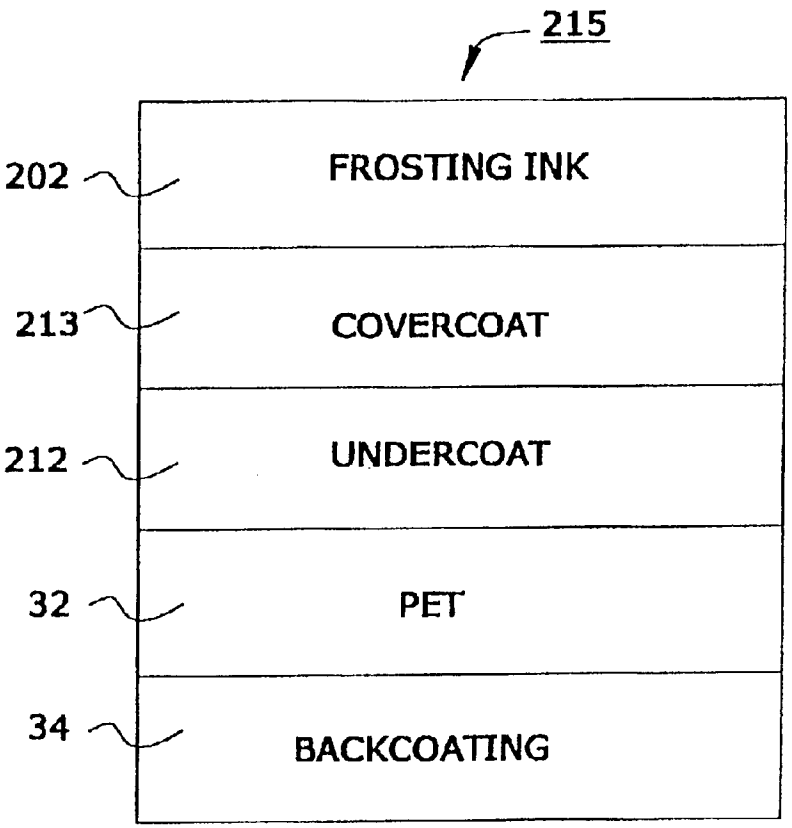
Figure 13A:
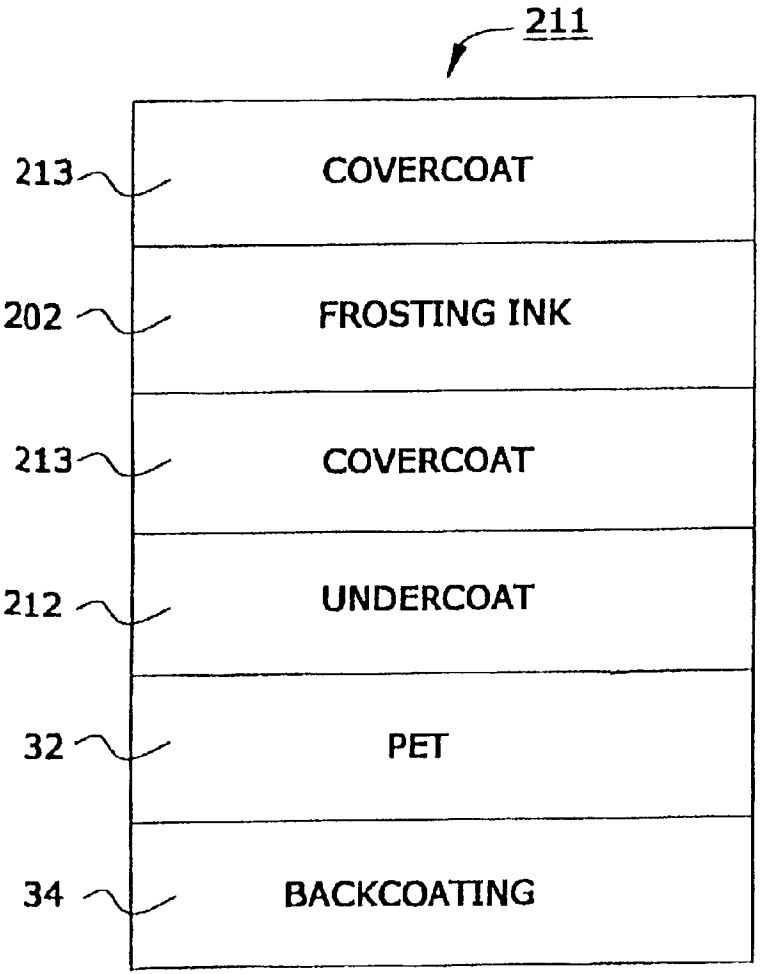
Figure 14:
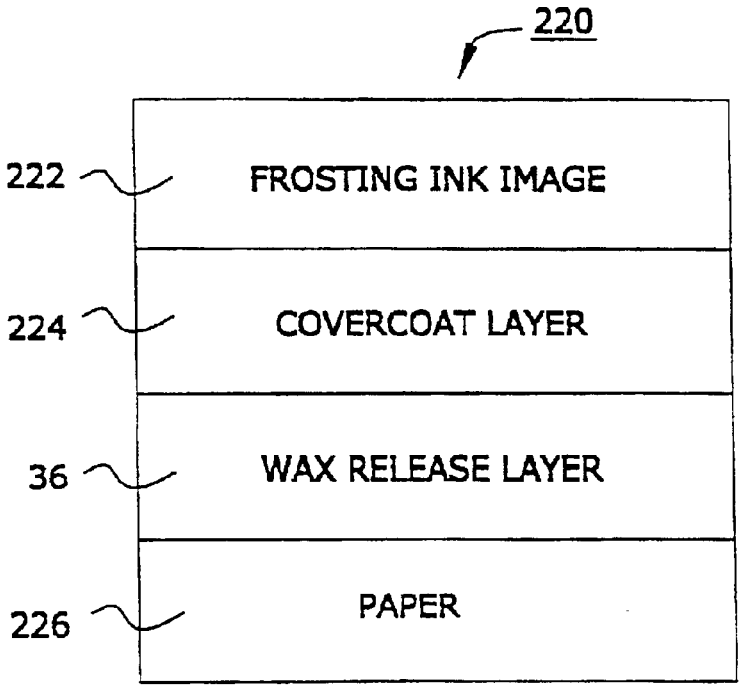
Figure 15:
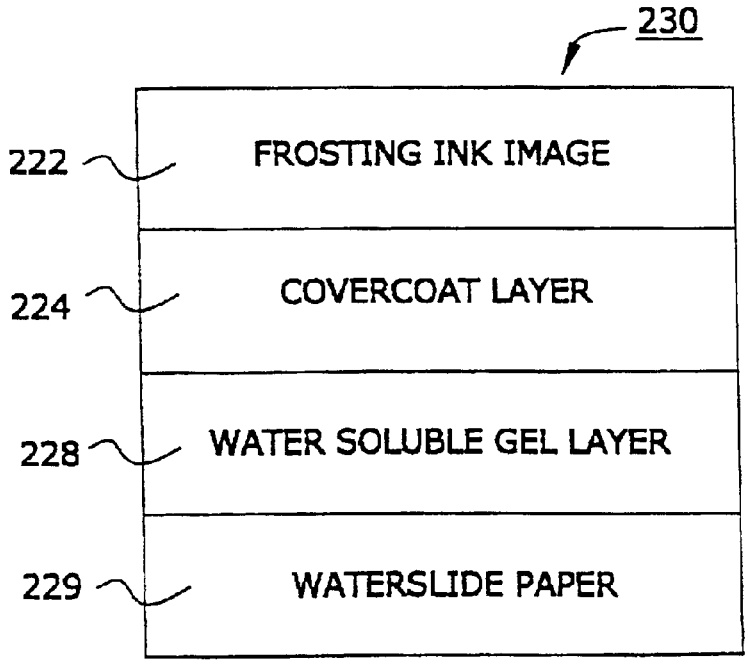
Figure 16:
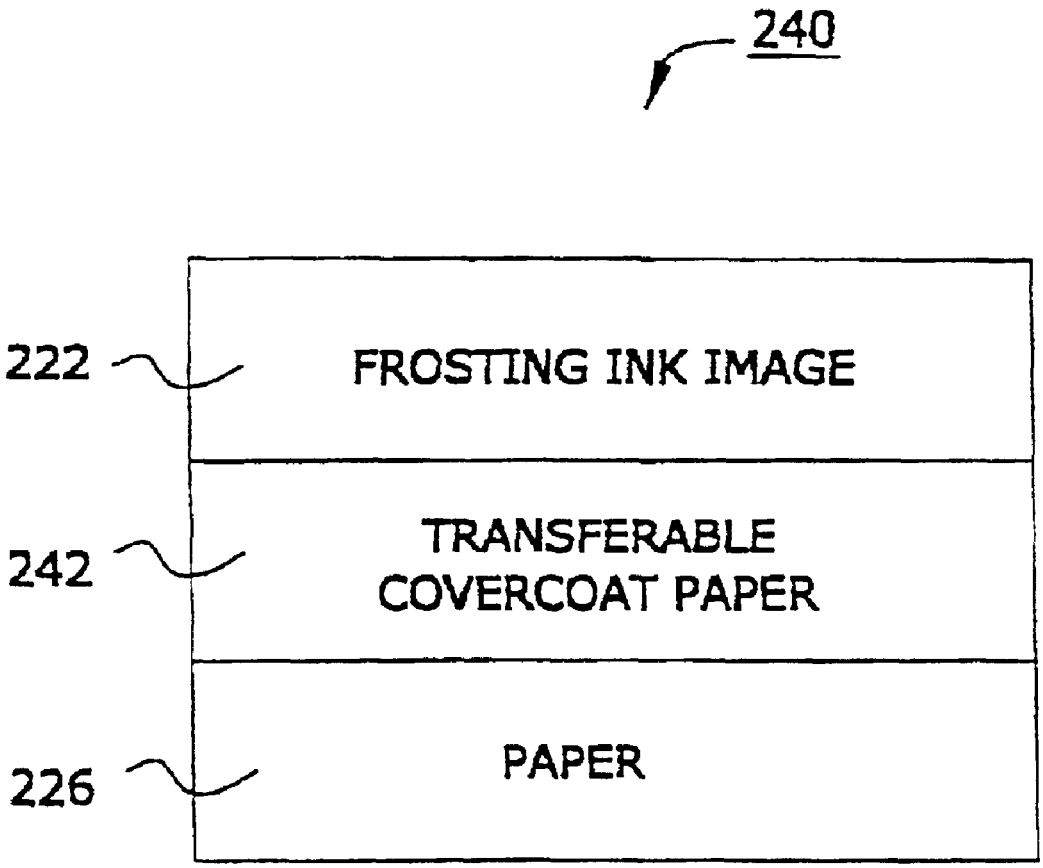
Figure 17:
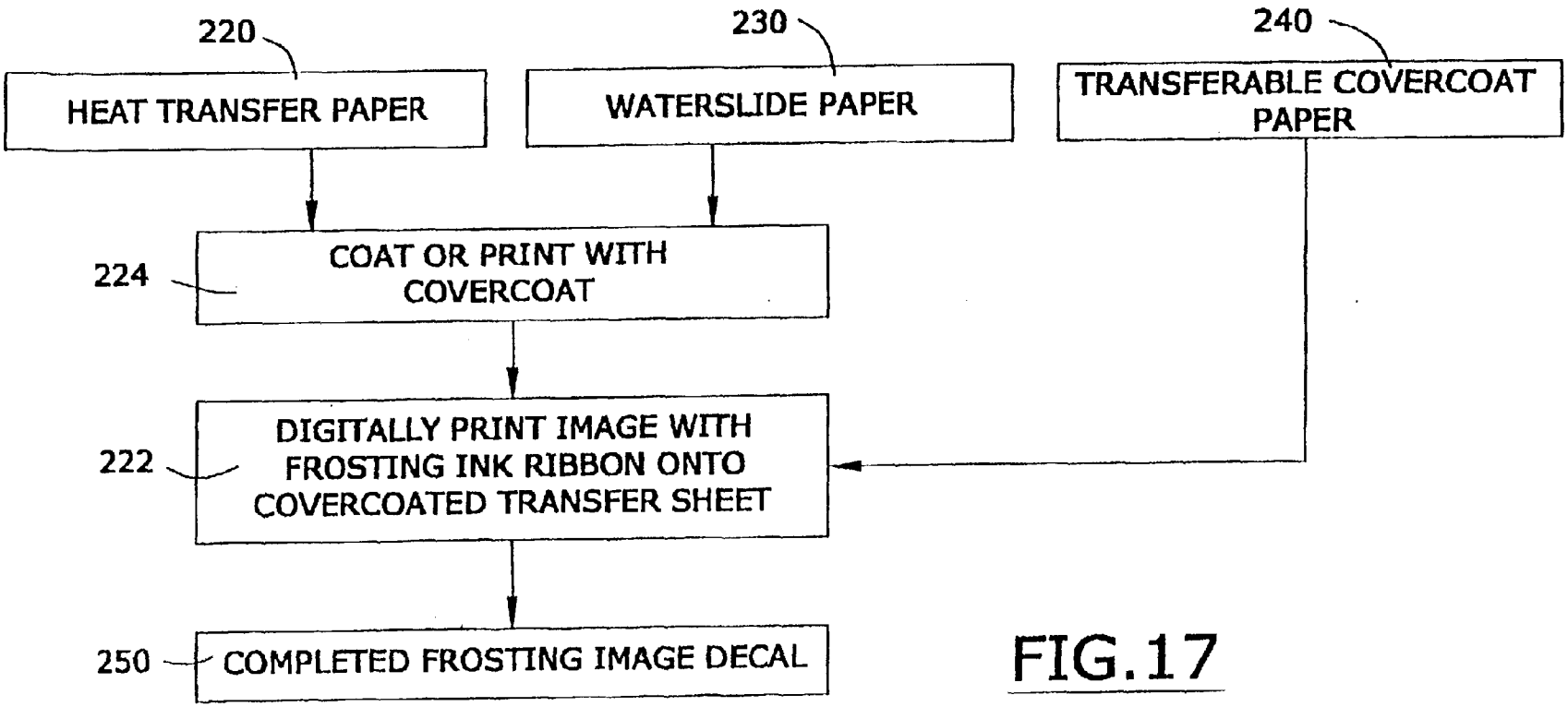
Figure 18:
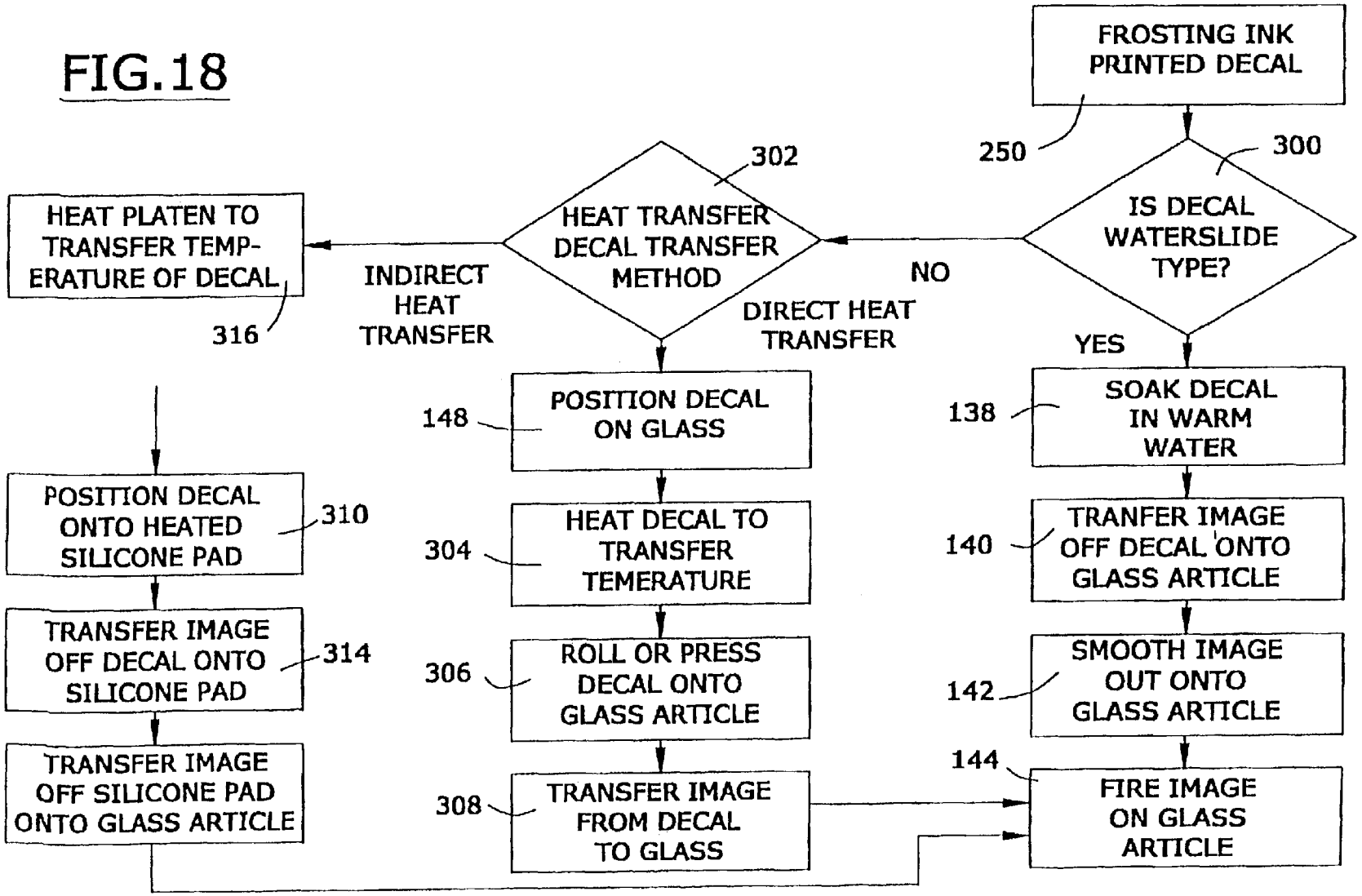
Figure 19:
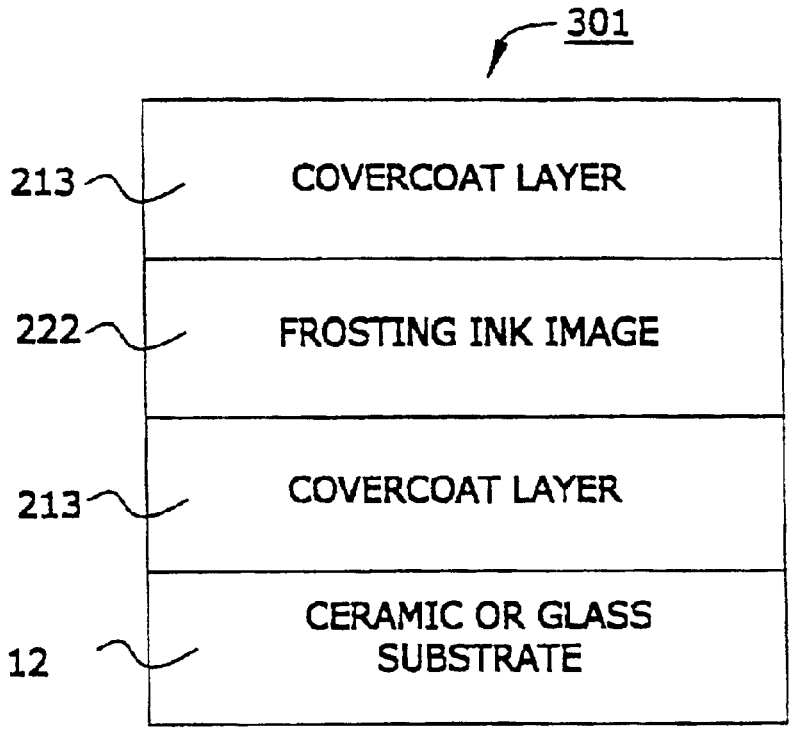
Figure 20:
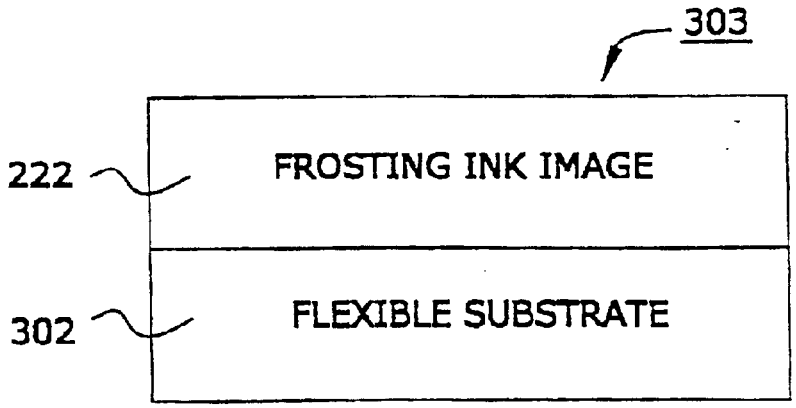
Figure 21:
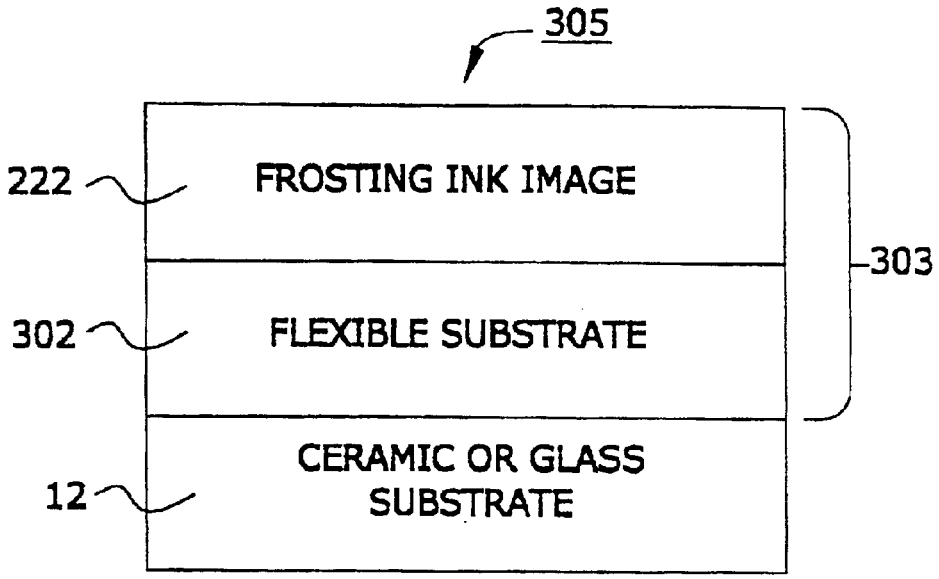
Figure 22:
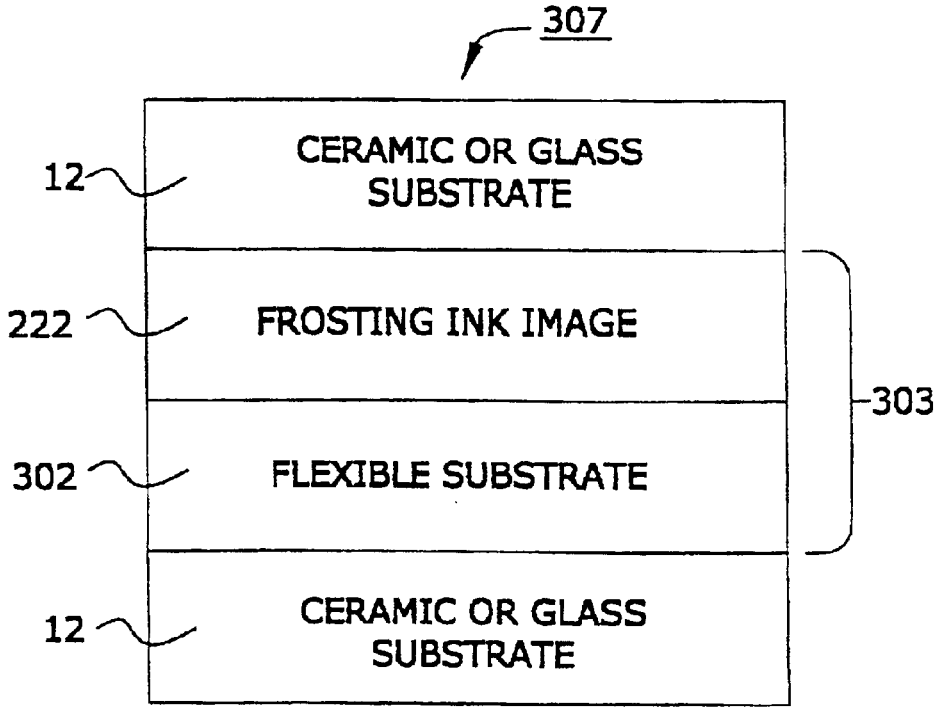
Figure 23:
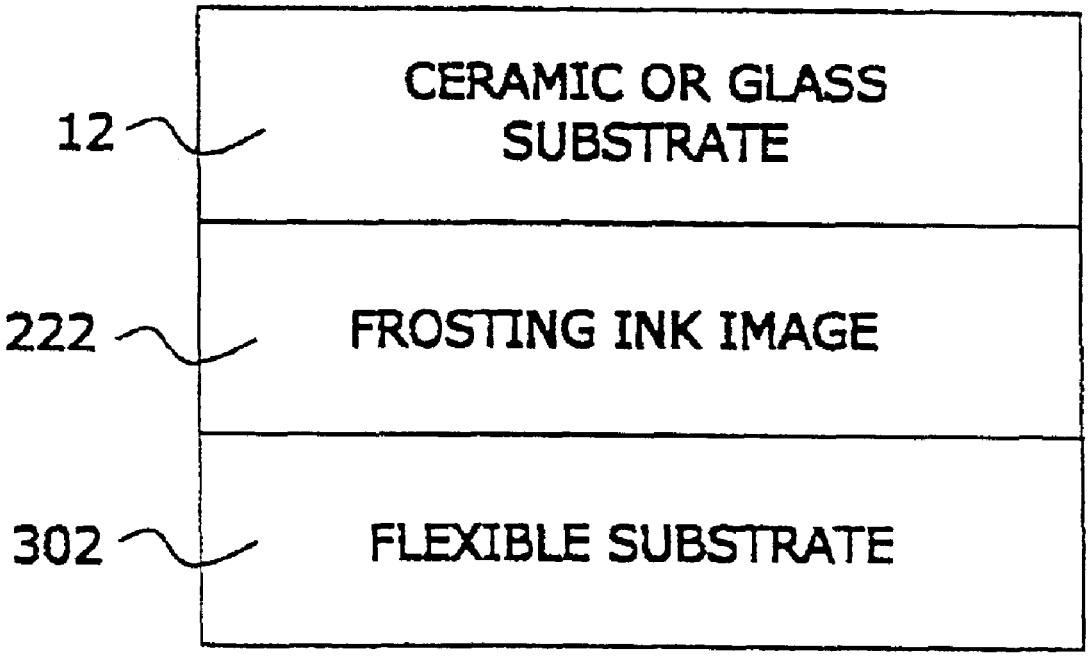
Figure 24:
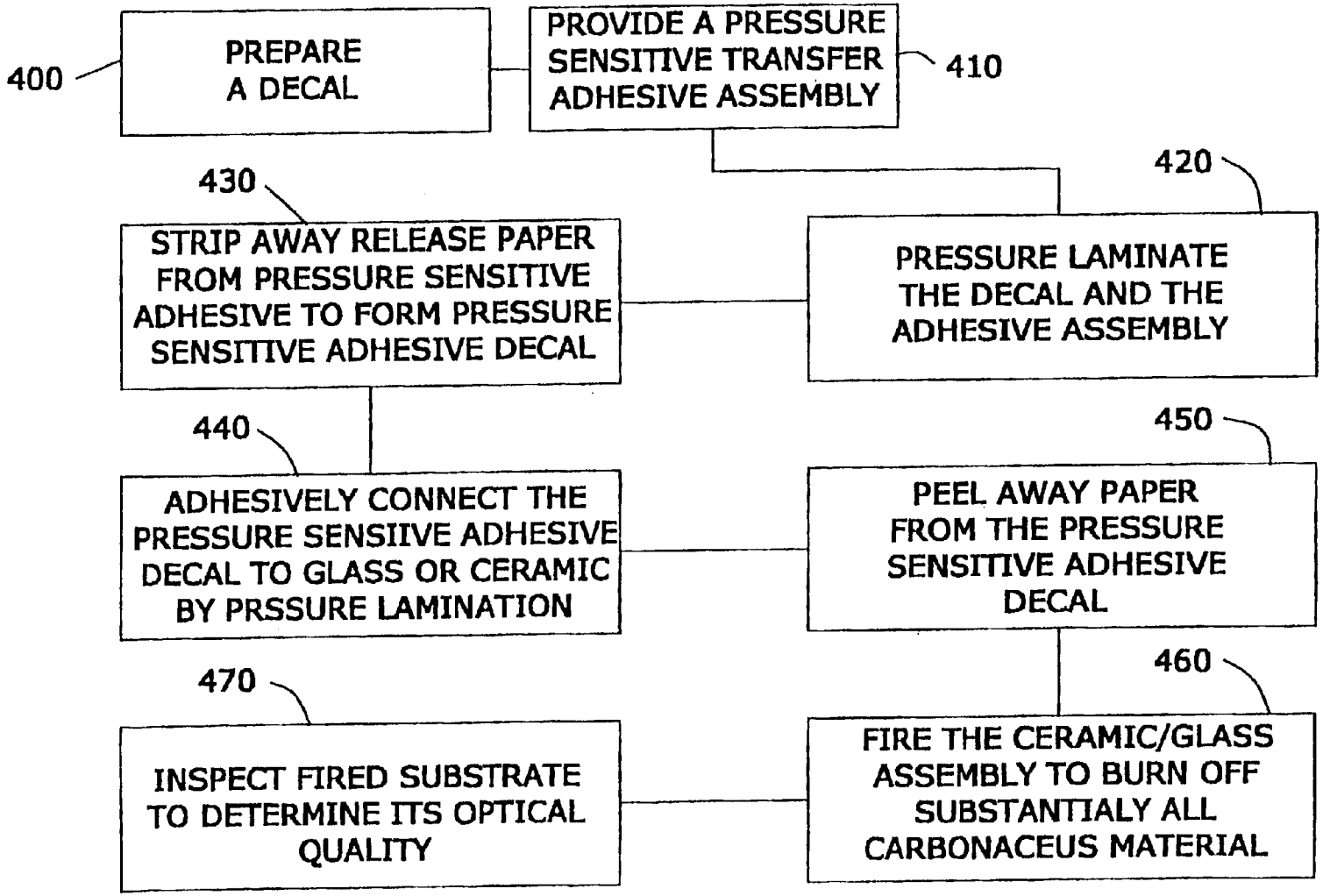
Figure 25B:
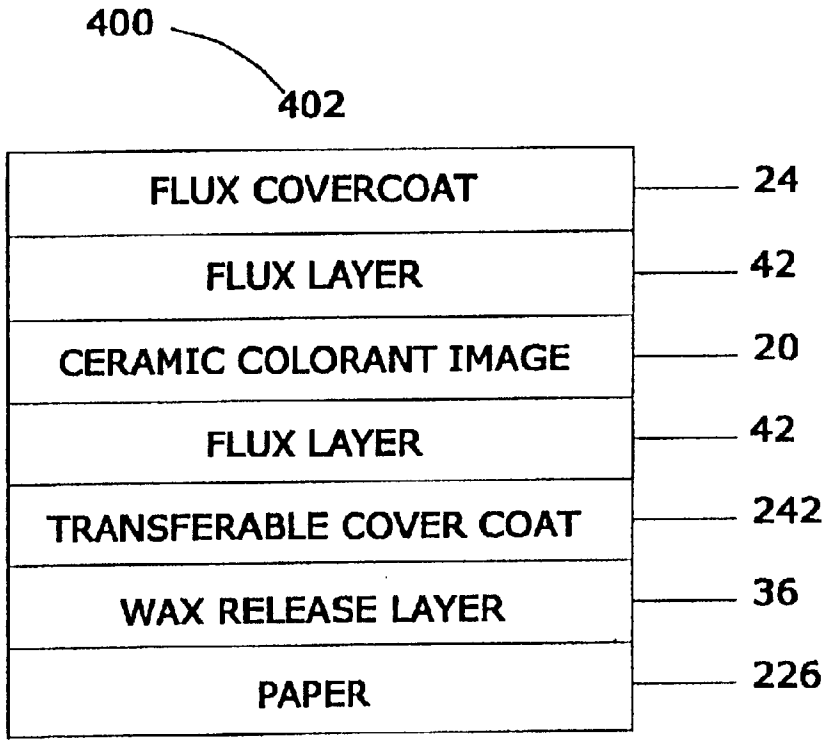
Figure 25A:
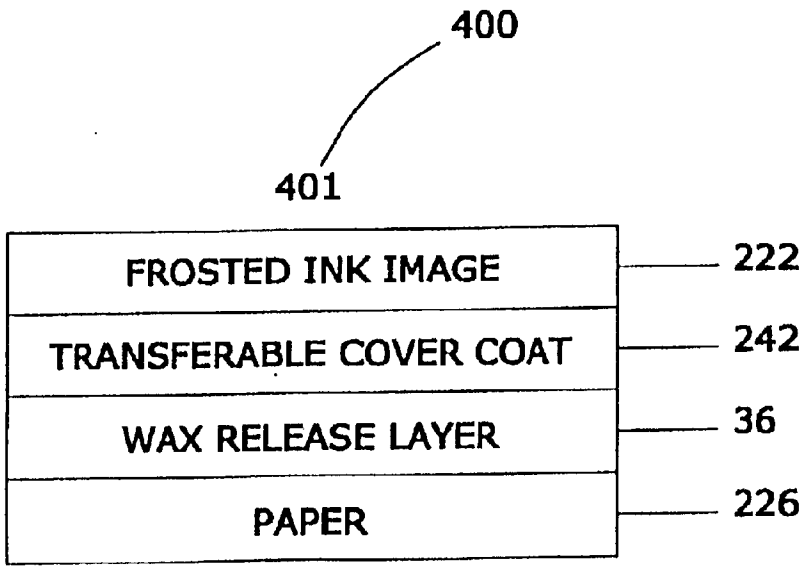
Figure 26:
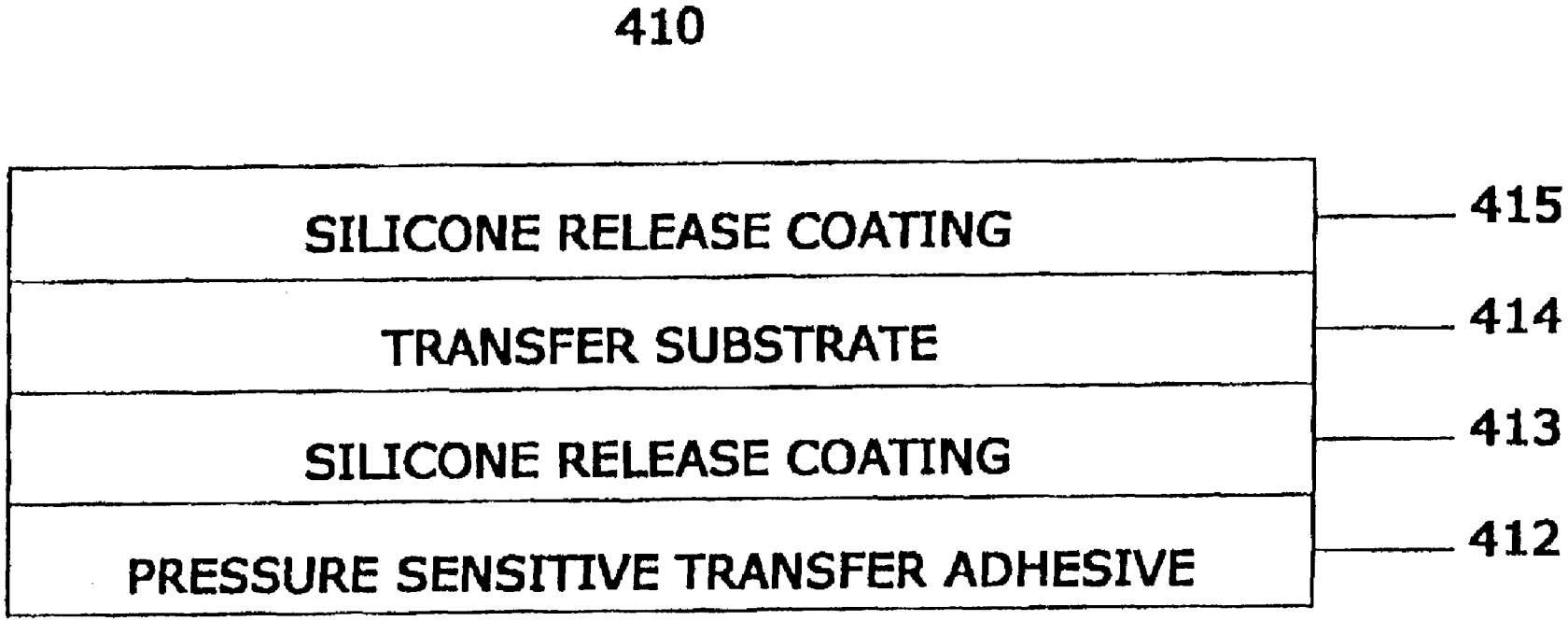
Figure 27:
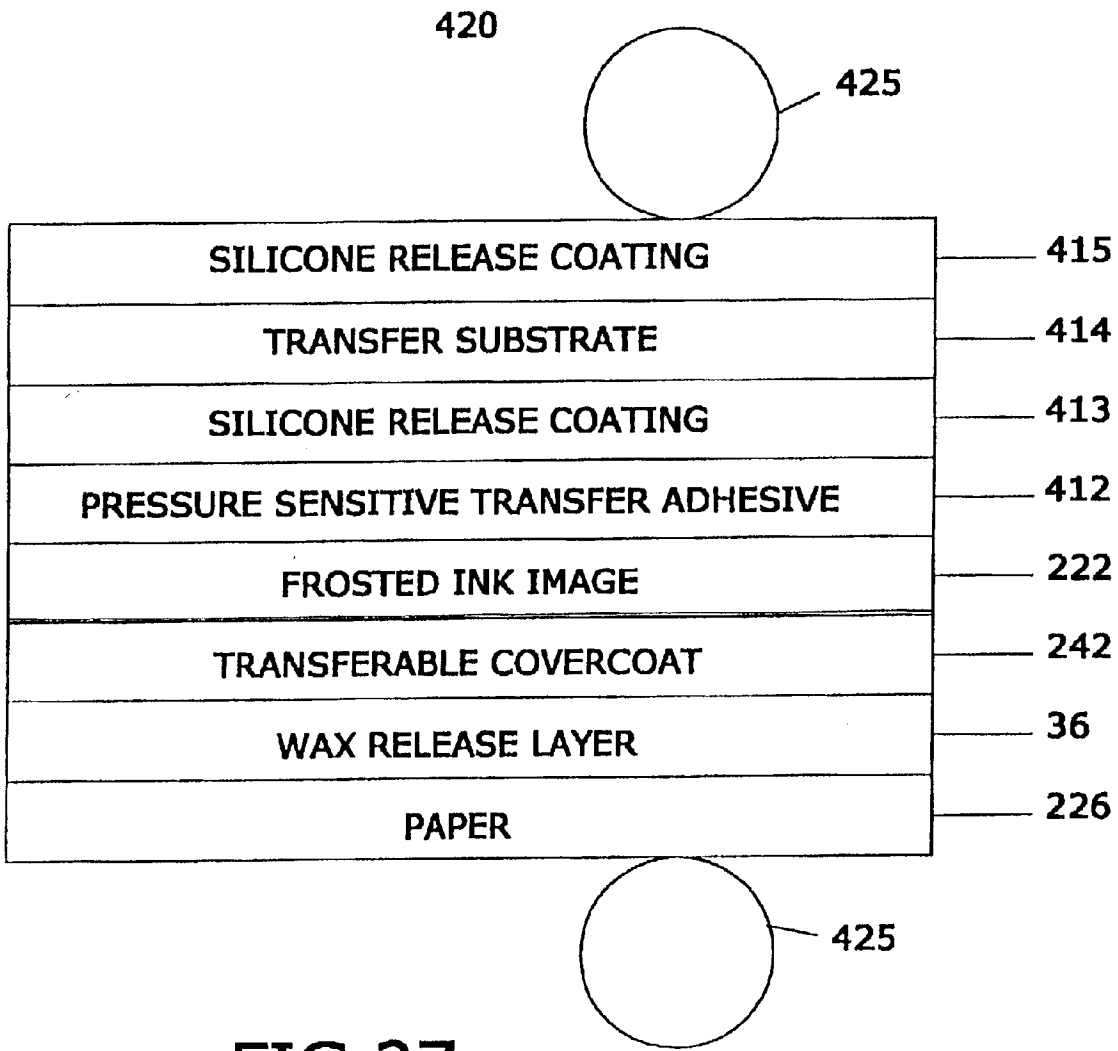
Figure 28:
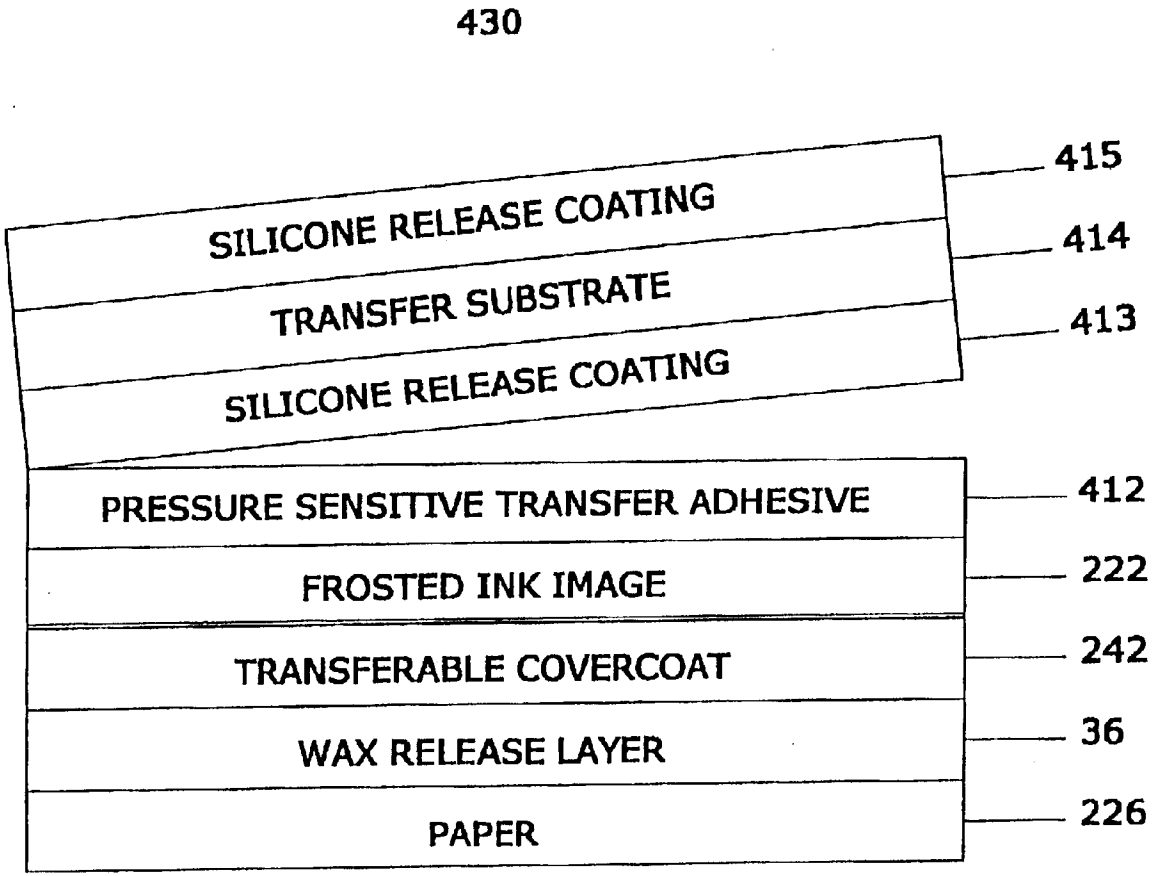
Figure 29:
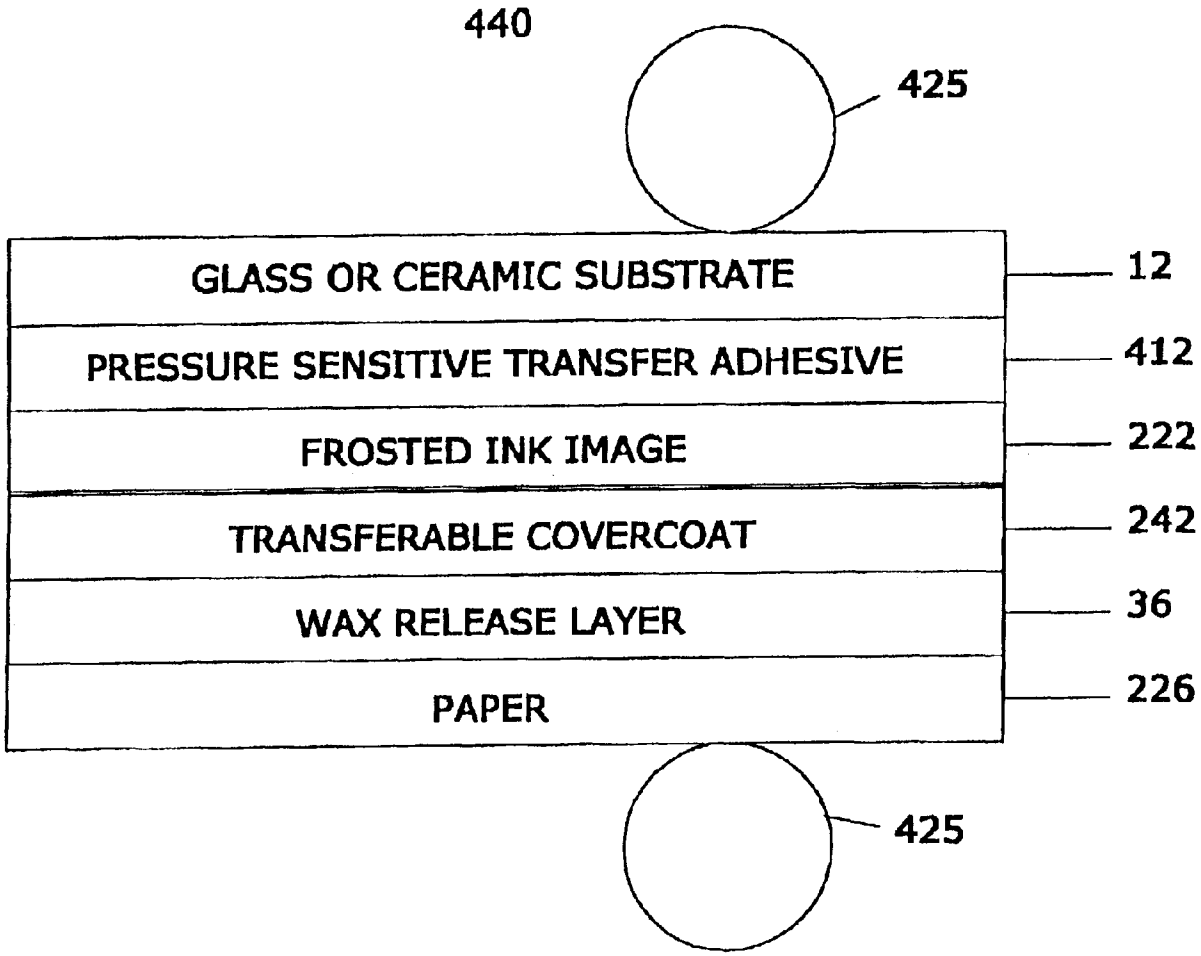
Figure 30:
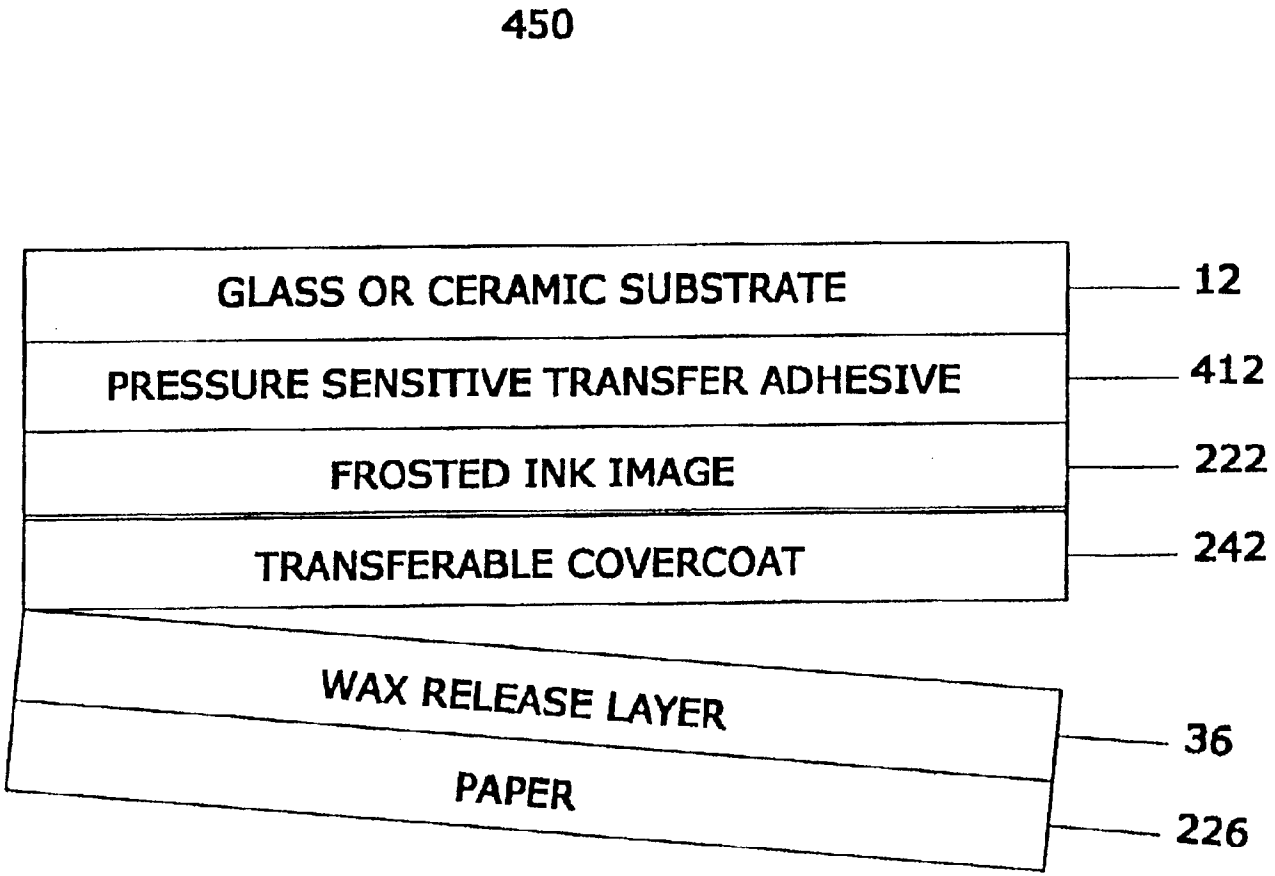
Figure 31:
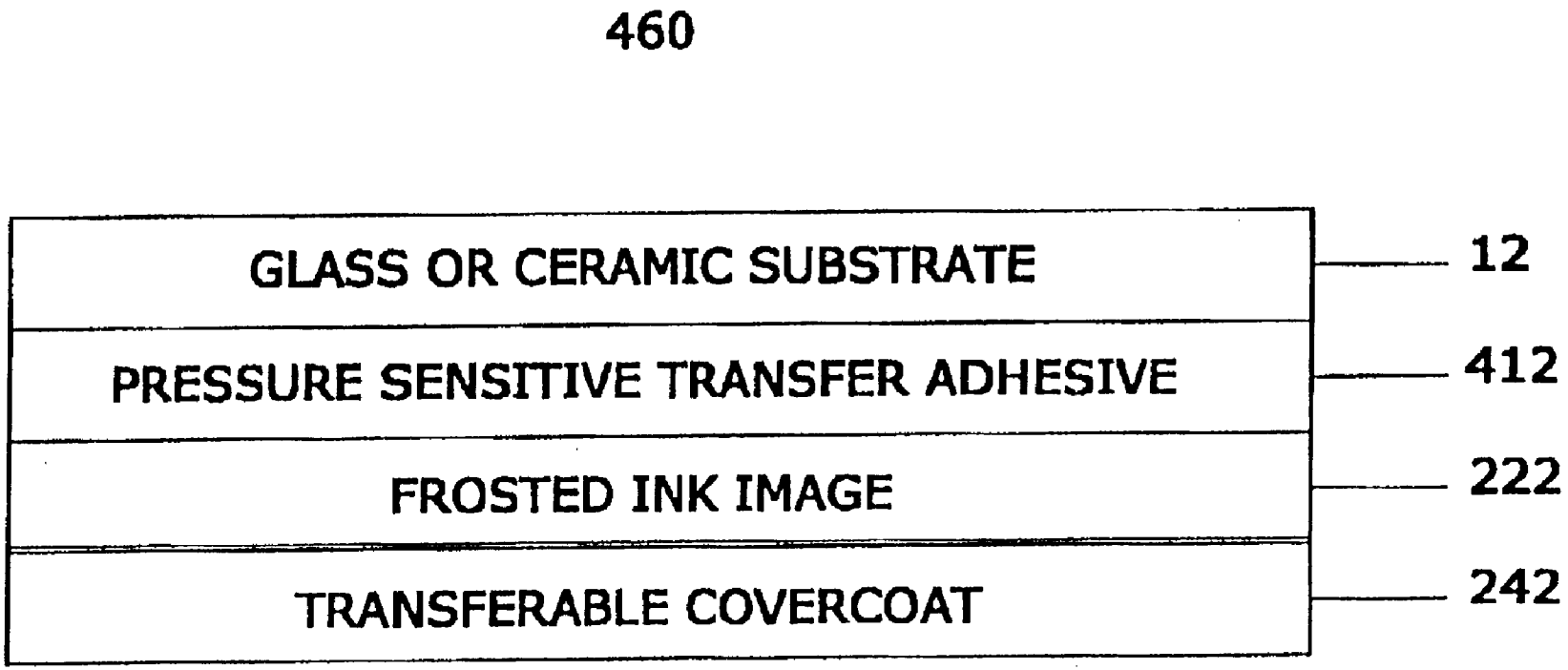
Figure 32:
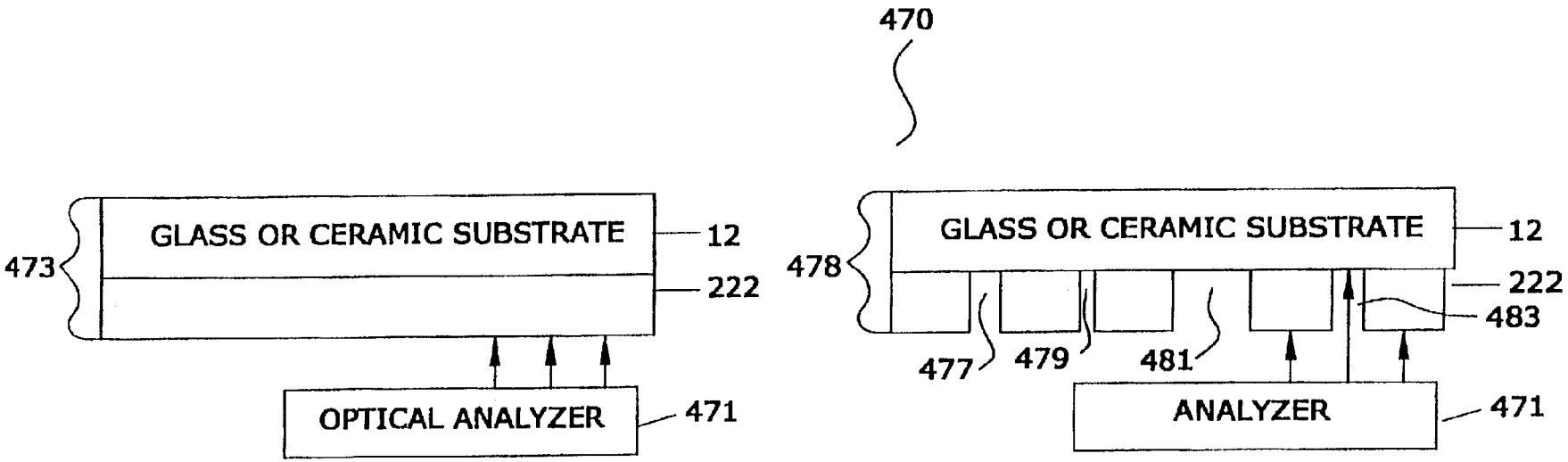

Each of FIGS. 2, 3, 4, 5, and 6 is a schematic of a preferred ribbon which may be used to prepare the ceramic substrate of FIG. 1;

FIG. 6A is a schematic representation of another preferred ribbon which may be used to prepare the ceramic substrate of FIG. 1;

Each of FIGS. 7 and 8 is schematic of a preferred decal which may be used to prepare the ceramic substrate of FIG. 1;

Each of FIGS. 9, 10, 10A, and 11 is a flow diagram illustrating how the ribbon, a first decal, a second decal, and the printed ceramic substrate of the invention, respectively, is made;

FIG. 12 is a schematic representation of a thermal ribbon comprised of a frosting ink layer;

FIGS. 13, 13A, and 13B are schematic representations other thermal ribbons comprised of a frosting ink layer;

FIG. 14 is a schematic representation of a heat transfer paper made with the thermal ribbon of FIG. 12 or FIG. 13;

FIG. 15 is a schematic representation of a Waterslide paper assembly made with the thermal ribbon of FIG. 12 or FIGS. 13, 13A, or 13B;

FIG. 16 is a schematic representation of a transferable covercoat paper assembly;

FIG. 17 is a flow diagram illustrating a process for making a frosting image decal with either the heat transfer paper of FIG. 14, the Waterslide paper assembly of FIG. 15, or the transferable covercoat assembly of FIG. 16;

FIG. 18 is a flow diagram/logic diagram describing how one may transfer the frosting image decal of FIG. 17 to a ceramic substrate;

FIG. 19 is a schematic representation of ceramic or glass substrate on which is disposed a frosting ink image and two covercoat layers;

FIG. 20 is a schematic representation of a flexible substrate on which is disposed a frosting ink image;

FIG. 21 is a schematic representation of a ceramic or glass substrate on which is disposed the flexible substrate of FIG. 20;

FIG. 22 is a schematic representation of a laminated structure in which the flexible substrate assembly of FIG. 20 is disposed between two ceramic or glass layers;

FIG. 23 is a schematic representation of a ceramic or glass substrate beneath which is disposed a frosting ink image;

FIGS. 24 is a flow diagram of one preferred process of the invention;

FIGS. 25A and 25B a schematics of two preferred decals which may be used in the process depicted in FIG. 24;

FIG. 26 is a schematic of a preferred adhesive assembly which may be used in the process depicted in FIG. 24;

FIG. 27 is a schematic of one preferred lamination step of the process depicted in FIG. 24;

FIG. 28 is a schematic of one preferred stripping step of the process depicted in FIG. 24 in which release paper is stripped away from pressure sensitive adhesive;

FIG. 29 is a schematic of one preferred lamination step of the process depicted in FIG. 24 in which the decal is laminated to a glass or ceramic substrate with pressure;

FIG. 30 is a schematic of one preferred stripping step of the process depicted in FIG. 24 in which a paper/wax resin release layer is stripped away to laeave a covercoated image on the glass or ceramic substrate;

FIG. 31 is a schematic of the assembly containing the covercoated image on the glass or ceramic substrate;

FIG. 32 is a schematic of a process of evaluating the optical properties of the glass/ceramic substrate with an image fixed to it.

Figure 33:
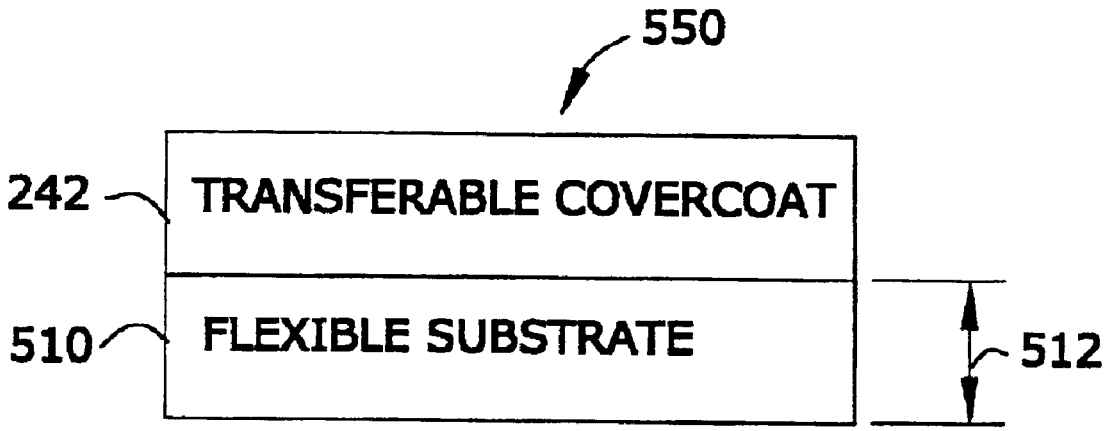
Figure 34:
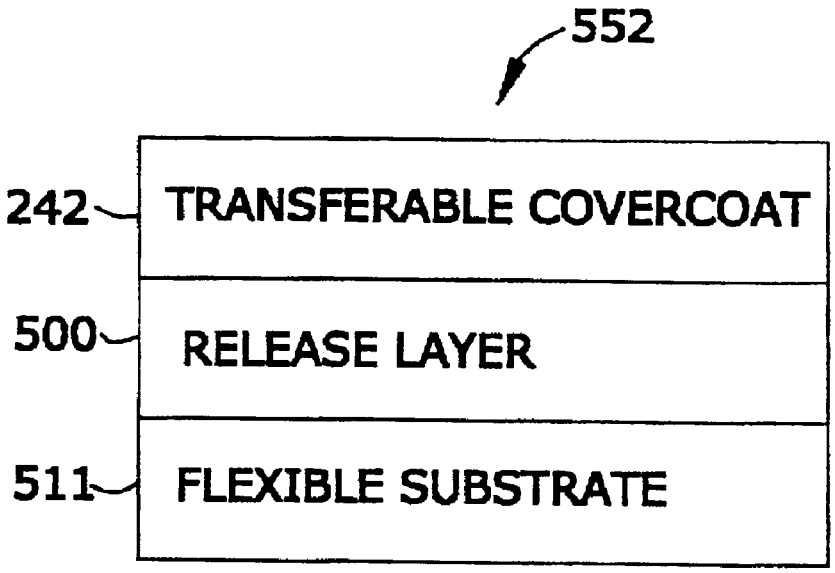

FIG. 33 is a schematic of a preferred embodiment of a transfer sheet assembly of the invention; and FIG. 34 is a schematic of another transfer sheet assembly of the invention.

DESCRIPTION OF THE PREFERRED EMBODIMENTS

In the first part of this specification, a novel thermal transfer system for fired ceramic decals will be discussed. Thereafter, in the second part of the specification, a novel thermal transfer ribbon comprised of a frosting ink will be discussed. In the third part of this specification, a process for preparing a ceramic substrate/adhesive/decal assembly will be described. In the fourth part of this specification, certain novel transfer sheet assemblies are discussed.

FIG. 1 is a schematic representation of a printed ceramic substrate 10 made in accordance with one preferred process of this invention; this Figure, and the other Figures in this patent application, are not necessarily drawn to scale.

As used herein, the term "ceramic" includes both glass, conventional oxide ceramics, and non-oxide ceramics (such as carbides, nitrides, etc.)

Referring again to FIG. 1, printed ceramic substrate 10 is comprised of a ceramic substrate 12 onto which one or more color images is fixed.

In one embodiment, the ceramic substrate 12 used in the process of this invention preferentially has a melting temperature of at least 550 degrees Centigrade. As used in this specification, the term melting temperature refers to the temperature or range of temperatures at which heterogeneous mixtures, such as a glass batch, glazes, and porcelain enamels, become molten or softened. See, e.g., page 165 of Loran S. O'Bannon's "Dictionary of Ceramic Science and Engineering" (Plenum Press, New York, 1984). In one embodiment, it is preferred that the substrate have a melting temperature of at least about 580 degrees Centigrade. In another embodiment, such melting temperature is from about 580 to about 1,200 degrees Centigrade.

The ceramic substrate used in the process of this invention preferably is a material which is subjected to a temperature of at least about 540 degrees Celsius during processing and, in one embodiment, is comprised of one or more metal oxides. Typical of such preferred ceramic substrates are, e.g., glass, ceramic whitewares, enamels, porcelains, etc. Thus, by way of illustration and not limitation, one may use the process of this invention to transfer and fix color images onto ceramic substrates such as dinnerware, outdoor signage, glassware, decorative giftware, architectural tiles, color filter arrays, floor tiles, wall tiles, perfume bottles, wine bottles, beverage containers, and the like.

Referring again to FIG. 1, and in the preferred embodiment depicted therein, it will be seen that a flux underlayer 14 is disposed on top of and bonded to the top surface of the ceramic substrate 12. Flux underlayer 14 is preferably transferred to the ceramic substrate surface at a coating weight (coverage) of at least about 1 gram per square meter. It is preferred to use a coating weight (coverage) for flux layer 14 of at least 7 grams per square meter; and it is more preferred to use a coating weight (coverage) for layer 14 of at least about 14 grams per square meter. As will be apparent to those skilled in the art, the coating weight (coverage) referred to herein (and elsewhere in this specification) is a dry weight, by weight of components which contain less than 1 percent of solvent.

The coating composition used to apply layer 14 onto ceramic substrate 12 preferably contains frit with a melting temperature of at least about 550 degrees Centigrade. As used in this specification, the term frit refers to a glass which has been melted and quenched in water or air to form small friable particles which then are processed for milling for use as the major constituent of porcelain enamels, flitted glazes, frit chinaware, and the like. See, e.g., page 111 of Loran S. O'Bannon's "Dictionary of Ceramic Science and Engineering," supra.

In one embodiment, the frit used in the process of this invention has a melting temperature of at least about 750 degrees Centigrade. In another embodiment, the flit used in the process of this invention has a melting temperature of at least about 950 degrees Centigrade.

One may use commercially available frits. Thus, by way of illustration and not limitation, one may use a frit sold by the Johnson Matthey Ceramics Inc. (498 Acorn Lane, Downington, Pa. 19335) as product number 94C1001 ("Onglaze Unleaded Flux"), 23901 ("Unleaded Glass Enamel Flux,"), and the like. One may use a flux sold by the Cerdec Corporation of P.O. Box 519, Washington, Pa. 15301 as product number 9630.

Applicants have discovered that, in one embodiment and for optimum results, the melting temperature of the frit used should be either substantially the same as or no more than 50 degrees lower than the melting point of the substrate to which the colored image is to be affixed.

The frit used in the coating composition, before it is melted onto the substrate by the heat treatment process described elsewhere in this specification, preferably has a particle size distribution such that substantially all of the particles are smaller than about 10 microns. In one embodiment, at least about 80 weight percent of the particles are smaller than 5.0 microns.

One may use many of the frits known to those skilled in the art such as, e.g., those described in U.S. Pat. Nos. 5,562,748, 5,476,894, 5,132,165, 3,956,558, 3,898,362, and the like. Similarly, one may use some of the frits disclosed on pages 70–79 of Richard R. Eppler et al.'s "Glazes and Glass Coatings" (The American Ceramic Society, Westerville, Ohio, 2000).

Referring again to FIG. 1, the flux underlayer 14 preferably is comprised of at least about 25 weight percent of one or more frits, by total dry weight of all components in layer 14. In one embodiment, from about 35 to about 85 weight percent of frit material is used in flux underlayer 14. In another embodiment, from about 65 to about 75 percent of such frit material is used.

It is preferred that the frit material used in layer 14 comprise at least about 5 weight percent, by dry weight, of silica. As used herein, the term silica is included within the meaning of the term metal oxide; and the preferred frits used in the process of this invention comprise at least about 98 weight percent of one or more metal oxides selected from the group consisting of lithium, sodium, potassium, calcium, magnesium, strontium, barium, zinc, boron, aluminum, silicon, zirconium, lead, cadmium, titanium, and the like.

Referring again to FIG. 1, in addition to the frit, layer 14 also is comprised of one or more thermoplastic binder materials in a concentration of from about 0 to about 75 percent, based upon the dry weight of frit and binder in such layer 14. In one embodiment, the binder is present in a concentration of from about 15 to about 35 percent. In another embodiment, the layer 14 is comprised of from about 15 to about 75 weight percent of binder.

One may use any of the thermal transfer binders known to those skilled in the art. Thus, e.g., one may use one or more of the thermal transfer binders disclosed in U.S. Pat. Nos. 6,127,316, 6,124,239, 6,114,088, 6,113,725, 6,083,610, 6,031,556, 6,031,021, 6,013,409, 6,008,157, 5,985,076, and the like. The entire disclosure of each of these U.S. patents is hereby incorporated by reference into this specification.

By way of further illustration, one may use a binder which preferably has a softening point from about 45 to about 150 degrees Celsius and a multiplicity of polar moieties such as, e.g., carboxyl groups, hydroxyl groups, chloride groups, carboxylic acid groups, urethane groups, amide groups, amine groups, urea, epoxy resins, and the like. Some suitable binders within this class of binders include polyester resins, bisphenol-A polyesters, polvinyl chloride, copolymers made from terephthalic acid, polymethyl methacrylate, vinylchloride/vinylacetate resins, epoxy resins, nylon resins, urethane-formaldehyde resins, polyurethane, mixtures thereof, and the like.

In one embodiment a mixture of two synthetic resins is used. Thus, e.g., one may use a mixture comprising from about 40 to about 60 weight percent of polymethyl methacrylate and from about 40 to about 60 weight percent of vinylchloride/vinylacetate resin. In this embodiment, these materials collectively comprise the binder.

In one embodiment, the binder is comprised of polybutylmethacrylate and polymethylmethacrylate, comprising from 10 to 30 percent of polybutylmethacrylate and from 50 to 80 percent of the polymethylacrylate. In one embodiment, this binder is comprised of cellulose acetate propionate, ethylenevinylacetate, vinyl chloride/vinyl acetate, urethanes, etc.

One may obtain these binders from many different commercial sources. Thus, e.g., some of them may be purchased from Dianal America Company of 9675 Bayport Blvd., Pasadena, Tex. 77507; suitable binders available from this source include "Dianal BR 113" and "Dianal BR 106." Similarly, suitable binders may also be obtained from the Eastman Chemicals Company (Tennessee Eastman Division, Box 511, Kingsport, Tenn.).

Referring again to FIG. 1, in addition to the frit and the binder, the layer 14 may optionally contain from about 0 to about 75 weight of wax and, preferably, from about 5 to about 20 percent of such wax. In one embodiment, layer 14 is comprised of from about 5 to about 10 weight percent of such wax. Suitable waxes which may be used include carnuaba wax, rice wax, beeswax, candelilla wax, montan wax, paraffin wax, microcrystalline waxes, synthetic waxes such as oxidized wax, ester wax, low molecular weight polyethylene wax, Fischer-Tropsch wax, and the like. These and other waxes are well known to those skilled in the art and are described, e.g., in U.S. Pat. No. 5,776,280. One may also use ethoxylated high molecular weight alcohols, long chain high molecular weight linear alcohols, copolymers of alpha olefin and maleic anhydride, polyethylene, polypopylene, These and other suitable waxes are commercially available from, e.g., the Baker-Hughes Baker Petrolite Company of 12645 West Airport Blvd., Sugarland, Tex.

In one preferred embodiment, carnuaba wax is used as the wax. As is known to those skilled in the art, carnuaba wax is a hard, high-melting lustrous wax which is composed largely of ceryl palmitate; see, e.g., pages 151–152 of George S. Brady et al.'s "Material's Handbook," Thirteenth Edition (McGraw-Hill Inc., New York, N.Y.,1991). Reference also may be had, e.g., to U.S. Pat. Nos. 6,024,950, 5,891,476, 5,665,462, 5,569,347, 5,536,627, 5,389,129, 4,873,078, 4,536,218, 4,497,851, 4,4610,490, and the like. The entire disclosure of each of these U.S. patents is hereby incorporated by reference into this specification.

Layer 14 may also be comprised of from about 0 to 16 weight percent of plasticizers adapted to plasticize the resin used. Those skilled in the art are aware of which plasticizers are suitable for softening any particular resin. In one embodiment, there is used from about 1 to about 15 weight percent, by dry weight, of a plasticizing agent. Thus, by way of illustration and not limitation, one may use one or more of the plasticizers disclosed in U.S. Pat. No. 5,776,280 including, e.g., adipic acid esters, phthalic acid esters, chlorinated biphenyls, citrates, epoxides, glycerols, glycol, hydrocarbons, chlorinated hydrocarbons, phosphates, esters of phthalic acid such as, e.g., di-2-ethylhexylphthalate, phthalic acid esters, polyethylene glycols, esters of citric acid, epoxides, adipic acid esters, and the like.

In one embodiment, layer 14 is comprised of from about 6 to about 12 weight percent of the plasticizer which, in one embodiment, is dioctyl phthalate. The use of this plasticizing agent is well known and is described, e.g., in U.S. Pat. Nos. 6,121,356, 6,117,572, 6,086,700, 6,060,214, 6,051,171, 6,051,097, 6,045,646, and the like. The entire disclosure of each of these U.S. patent applications is hereby incorporated by reference into this specification.

Suitable plasticizers may be obtained from, e.g., the Eastman Chemical Company.

Referring again to FIG. 1, and in the preferred embodiment depicted therein, it will be seen that, disposed over flux layer 14, is opacification layer 16. Opacification layer 16 is optional; but, when it is used, it is preferably used at a coating weight (coverage) of from about 0.5 to about 10 grams per square meter and, more preferably, from about 1 to about 5 grams per square meter.

As is known to those skilled in the art, the opacification layer functions to introduce whiteness or opacity into the substrate by utilizing a substance that disperses in the coating as discrete particles which scatter and reflect some of the incident light. In one embodiment, the opacifying agent is used on a transparent ceramic substrate (such as glass) to improve image contrast properties.

One may use opacifying agents which are known to work with ceramic substrates. Thus, e.g., one may use one or more of the agents disclosed in U.S. Pat. Nos. 6,022,819, 4,977,013 (titanium dioxide), U.S. Pat. No. 4,895,516 (zirconium, tin oxide, and titanium dioxide), U.S. Pat. No. 3,899,346, and the like. The disclosure of each of these U.S. patents is hereby incorporated by reference into this specification.

One may obtain opacifying agents obtained from, e.g., Johnson Matthey Ceramic Inc., supra, as, e.g., "Superpax Zirconium Opacifier."

The opacification agent used should have a melting temperature at least about 500 degrees Centigrade higher than the melting point of the frit(s) used in layer 14. Generally, the opacification agent(s) have a melting temperature of at least about 1200 degrees Centigrade.

The opacification agent should preferably have a refractive index of greater than 2.0 and, preferably, greater than 2.4.

The opacification agent preferably has a particle size distribution such that substantially all of the particles are smaller than about 10 microns. In one embodiment, at least about 80 weight percent of the particles are smaller than 5.0 microns.

Referring again to FIG. 1, in addition to the opacification agent, opacification layer 16 also is preferably comprised of one or more thermoplastic binder materials in a concentration of from about 0 to about 75 percent, based upon the dry weight of opacification agent and binder in such layer 14. In one embodiment, the binder is present in a concentration of from about 15 to about 35 percent. One may use one or more of the binders described with reference to layer 14. Alternatively, one may use one or more other suitable binders.

In addition to the opacifying agent and the optional binder, one may also utilize the types and amounts of wax that are described with reference to layer 14, and/or different amounts of different waxes. Alternatively, or additionally, one may also use the types and amounts of plasticizer described with reference to layer 14. In general, the only substantive differences between layers 14 and 16 are that the calculations are made with respect to the amount of opacifying agent (in layer 16) and not the amount of frit (as is done in layer 14)..

Referring again to FIG. 1, one may optionally use a second flux layer 18 similar in composition and/or concentrations to layer 14. When such a second flux layer is used, it will be disposed over and printed over the opacification layer 16.

Disposed over the flux layer 14 is one or more color images 20. These ceramic colorant image(s) 20 will be disposed over either the ceramic substrate 12 or the flux layer 14, and/or the optional opacification layer 16 when used, and/or the optional second flux layer 18 when used.

In another embodiment, the image 20 is a bi-tonal image. In yet another embodiment, the image 20 is a black and white image.

In one embodiment, it is preferred to apply these image(s) with a digital thermal transfer printer. Such printers are well known to those skilled in the art and are described in International Publication No. WO 97/00781, published on Jan. 7, 1997, the entire disclosure of which is hereby incorporated by reference into this specification. As is disclosed in this publication, a thermal transfer printer is a machine which creates an image by melting ink from a film ribbon and transferring it at selective locations onto a receiving material. Such a printer normally comprises a print head including a plurality of heating elements which may be arranged in a line. The heating elements can be operated selectively.

Alternatively, or additionally, the image(s) may be printed by means of xerography, ink jet printing, silk screen printing, lithographic printing, and the like.

Alternatively, one may use one or more of the thermal transfer printers disclosed in U.S. Pat. Nos. 6,124,944, 6,118,467, 6,116,709, 6,103,389, 6,102,534, 6,084,623, 6,083,872, 6,082,912, 6,078,346, and the like. The disclosure of each of these U.S. patents is hereby incorporated by reference into this specification.

Digital thermal transfer printers are readily commercially available. Thus, e.g., one may use a printer identified as Gerber Scientific's Edge 2 sold by the Gerber Scientific Corporation of Connecticut. With such a printer, the digital color image(s) may be applied by one or more appropriate ribbon(s) in the manner discussed elsewhere in this specification.

Referring again to FIG. 1, and in the preferred embodiment depicted therein, the colorant, or colorants which form image 20 are mixed with one or more of the ingredients listed for the opacification layer, with the exception that the colorant(s) is substituted for the opacifying agent(s). Thus, a mixture of the colorant and/or binder and/or wax and/or plasticizer may be used. As will be apparent to those skilled in the art, no glass frit is used in colorant image 20.

It is this element 20 which is selectively applied by the color printer. One such mixture, comprised of one color, may first be digitally printed, optionally followed by one or more differently colored mixtures. The number of colors one wishes to obtain in element 20 will dictate how many different colors are printed.

Although not willing to be bound to any particular theory, applicants believe that the colorant mixtures applied as element 20 tend to admix to some degree.

The amount of colorant used in the composite 11 should not exceed a certain percentage of the total amount of flux used in such composite, generally being 33.33 percent or less. Put another way, the ratio of the total amount of flux in the composite 11 (which includes layers 14, 18, and 24) to the amount of colorant in element 20, in grams/grams, dry weight, should be at least about 2 and, preferably, should be at least about 3. In one embodiment, such ratio is at least 4.0 In another such embodiment, such ratio of flux/colorant is from about 5 to 6. It is noteworthy that, in the process described in U.S. Pat. No. 5,665,472, such ratio was 0.66 (Example 1 at Column 5), or 0.89 (Example 2 at Columns 5–6), or 1.1 (Example 3 at Column 6). At Column 4 of U.S. Pat. No. 5,665,472 (see lines 44 to 49), the patentee teaches that "The proportion of the weight of the bismuth oxide/borosilicate glass frit to the weight of the colorant is preferably 50 to 200% . . . . " Thus, substantially more colorant as a function of the flux concentration is used in the process of such patent than is used in this embodiment of applicants' process.

In another embodiment of the invention, the ratio of frit used in the process to colorant used in the process is at least 1.25.

The unexpected results which obtain when the flux/colorant ratios of this embodiment of the invention are substituted for the flux/colorant ratios of the prior art, and when the flux and colorant layers are separated, are dramatic. A substantially more durable product is produced by this embodiment of the instant invention.

Furthermore, applicants have discovered that, despite the use of substantial amounts of colorant, the process described in U.S. Pat. No. 5,665,472 does not produce transferred images with good color density. Without wishing to be bound to any particular theory, applicants believe that there is a certain optimal amount of encapuslation and immobilization of colorant and/or dissolution of colorant within the flux which is impeded by high concentrations of colorant.

It is disclosed in U.S. Pat. No. 5,665,472 that "The thermal transfer sheet of the present invention can, of course, cope with color treatment," and this statement is technically true. However, such process does not cope very well and must be modified in accordance with applicants' unexpected discoveries to produce a suitable digitally printed backing sheet with adequate durability and color intensity.

The only colorant disclosed in U.S. Pat. No. 5,665,472 is a fired pigment comprised of ferric oxide, cobalt oxide, and chromium trioxide in what appears to be a spinel structure. It is not disclosed where this pigment is obtained from, or what properties it has.

The colorants which work well in this embodiment of applicants' process preferably each contain at least one metal-oxide. Thus, a blue colorant can contain the oxides of a cobalt, chromium, aluminum, copper, manganese, zinc, etc. Thus, e.g., a yellow colorant can contain the oxides of one or more of lead, antimony, zinc, titanium, vanadium, gold, and the like. Thus, e.g., a red colorant can contain the oxides of one or more of chromium, iron (two valence state), zinc, gold, cadmium, selenium, or copper. Thus, e.g., a black colorant can contain the oxides of the metals of copper, chromium, cobalt, iron (plus two valence), nickel, manganese, and the like. Furthermore, in general, one may use colorants comprised of the oxides of calcium, cadmium, zinc, aluminum, silicon, etc.

Suitable colorants are be well known to those skilled in the art. See, e.g., U.S. Pat. Nos. 6,120,637, 6,108,456, 6,106,910, 6,103,389, 6,083,872, 6,077,594, 6,075,927, 6,057,028, 6,040,269, 6,040,267, 6,031,021, 6,004,718, 5,977,263, and the like. The disclosure of each of these U.S. patents is hereby incorporated by reference into this specification.

By way of further illustration, some of the colorants which can be used in this embodiment of the process of this invention include those described in U.S. Pat. Nos. 6,086,846, 6,077,797 (a mixture of chromium oxide and blue cobalt spinel), U.S. Pat. No. 6,075,223 (oxides of transition elements or compounds of oxides of transition elements), U.S. Pat. No. 6,045,859 (pink coloring element) U.S. Pat. No. 5,988,968 (chromium oxide, ferric oxide), U.S. Pat. No. 5,968,856 (glass coloring oxides such as titania, cesium oxide, ferric oxide, and mixtures thereof), U.S. Pat. No. 5,962,152 (green chromium oxides), U.S. Pat. Nos. 5,912,064, 5,897,885, 5,895,511, 5,820,991 (coloring agents for ceramic paint), U.S. Pat. No. 5,702,520 (a mixture of metal oxides adjusted to achieve a particular color), and the like. The entire disclosure of each of these U.S. patents is hereby incorporated by reference into this specification.

The ribbons produced by one embodiment of the process of this invention are preferably leach-proof and will not leach toxic metal oxide. This is unlike the prior art ribbons described by Tanaka at Column 1 of U.S. Pat. No. 5,665,472, wherein he states that: "In the case of the thermal transfer sheet containing a glass flit in the binder of the hot-melt ink layer, lead glass has been used as the glass frit, posing a problem that lead becomes a toxic, water-soluble compound." Without wishing to be bound to any particular theory, applicants believe that this undesirable leaching effect occurs because the prior art combined the flux and colorant into a single layer, thereby not leaving enough room in the formulation for sufficient binder to protect the layer from leaching.

The particle size distribution of the colorant used in layer 20 should preferably be within a relatively narrow range. It is preferred that the colorant have a particle size distribution such that at least about 90 weight percent of its particles are within the range of 0.2 to 20 microns.

The colorant used preferably has a refractive index greater than 1.4 and, more preferably, greater than 1.6; and, furthermore, the colorant should not decompose and/or react with the molten flux when subjected to a temperature in range of from about 550 to about 1200 degrees Celsius.

Referring again to FIG. 1, and the preferred embodiment depicted therein, a flux layer 22 optionally may be disposed over the ceramic colorant image element 20. Thus flux layer, when used, will be comparable to the flux layer 18 but need not necessarily utilize the same reagents and/or concentrations and/or coating weight.

Disposed over the colorant image element 20, and coated either onto such element 20 or the optional flux layer 22, is a flux covercoat 24. The properties of this flux covercoat 24 are often similar to the properties of covercoat 242 (see FIG. 34).

Covercoats are described in the patent art. See, e.g., U.S. Pat. No. 6,123,794 (covercoat used in decal), U.S. Pat. Nos. 6,110,632, 5,912,064, 5,779,784 (Johnson Matthey OPL 164 covercoat composition), U.S. Pat. Nos. 5,779,784, 5,601,675 (screen printed organic covercoat), U.S. Pat. No. 5,328,535 (covercoat for decal), U.S. Pat. No. 5,229,201, and the like. The disclosure of each of these U.S. patents is hereby incorporated by reference into this specification.

In one embodiment, the covercoat 24, in combination with the other flux-containing layers, provides sufficient flux so that the ratio of flux to colorant is within the specified range. Furthermore, in this embodiment, it should apply structural integrity to the ceramic colorant image element 20 so that, as described elsewhere in this specification, when composite 10 is removed from its backing material, it will retain its structural integrity until it is applied to the ceramic substrate.

The covercoat 24 should be substantially water-insoluble so that, after it is contacted with water at 40 degrees Centigrade for 1 minute, less than 0.5 percent will dissolve.

The covercoat 24 should preferably have an elongation at break, as measured at 20 degrees Celsius by standard A.S.T.M. Test D638-58T, of more than 1 percent. As used herein, the term elongation at break refers to difference between length of the elongated covercoat and the length of the non-elongated covercoat, divided by the length of the non-elongated covercoated, expressed as a percentage.

In one embodiment, the elongation to break of the covercoat 24 is greater than about 5 percent.

It is has been found that certain acrylates, such as polymethylmethacrylate, have ambient temperature elongations to break that are to low to be useful in applicants' process. By comparison, these acrylates may be used in prior art processes at the elevated temperatures required thereby, such as, e.g., the process of U.S. Pat. No. 5,069,954 (see, e.g., the paragraph beginning at line 59 of column 4 of such patent).

In one embodiment, the covercoat 24 is comprised of from about 0 to about 10 weight percent of tackifying agent, by total weight of tackifying agent and covercoat binder. As used herein, the term tackifying agents includes both plasticizing agents and tackifiers. See, e.g., U.S. Pat. No. 5,069,954 (at column 6) wherein the use of sucrose acetate iso-butyrate is described. It is preferred not to use more than about 10 weight percent of such tackifying agent in that it has been found that over tackifying of the covercoat 24 often limits the use of the covercoat in thermal transfer printing processes. The excess tackifying agent creates sufficient adhesion between the covercoated substrate and the thermal transfer ribbon that undesired pressure transfer of the ink occurs.

The covercoat 24 should be applied at a sufficient coating weight to result in a coating weight of at least 1 grams per square meter and, more preferably, at least 5 grams per square meter. In one embodiment, the covercoat 24 is applied at a coating weight of at least 10 grams per square meter.

In one embodiment, the covercoat 24 preferably is comprised of the aforementioned flux and carbonaceous material (s) which, in one preferred embodiment, when subjected to a temperature of 440 degrees Centigrade for at least 5 minutes, will be substantially completely converted to gaseous material. The aforementioned binders, and/or waxes, and/or plasticizers described, e.g., with relation to layers 14, 16, 18, 20, 22, and 24, are suitable carbonaceous materials, and one or more of them may be used in the proportions described with regard to layer 14 to constitute the covercoat.

One may use a covercoat 24 which is similar in composition and structure to the layer 14. In one embodiment, it is preferred that the covercoat 24 be comprised of a binder selected from the group consisting of polyacrylate binders, polymethacrylate binders, polyacetal binders, mixtures thereof, and the like.

Some suitable polyacrylate binders include polybutylacrylate, polyethyl-co-butylacrylate, poly-2-ethylhexylacrylate, and the like.

Some suitable polymethacrylate binders include, e.g., polymethylmethacrylate, polymethylmethacrylate-co-butylacrylate, polybutylmethacrylate, and the like.

Some suitable polyacetal binders include, e.g., polyvinylacetal, polyvinylbutyral, polyvinylformal, polyvinylacetal-co-butyral, and the like.

In one embodiment, covercoat 24 preferably has a softening point in the range of from about 50 to about 150 degrees Centigrade.

In one embodiment, covercoat 24 is comprised of from 0 to 75 weight percent of frit and from 25 to about 100 weight percent of a material selected from the group consisting of binder, wax, plasticizer and mixtures thereof.

Figure 2:
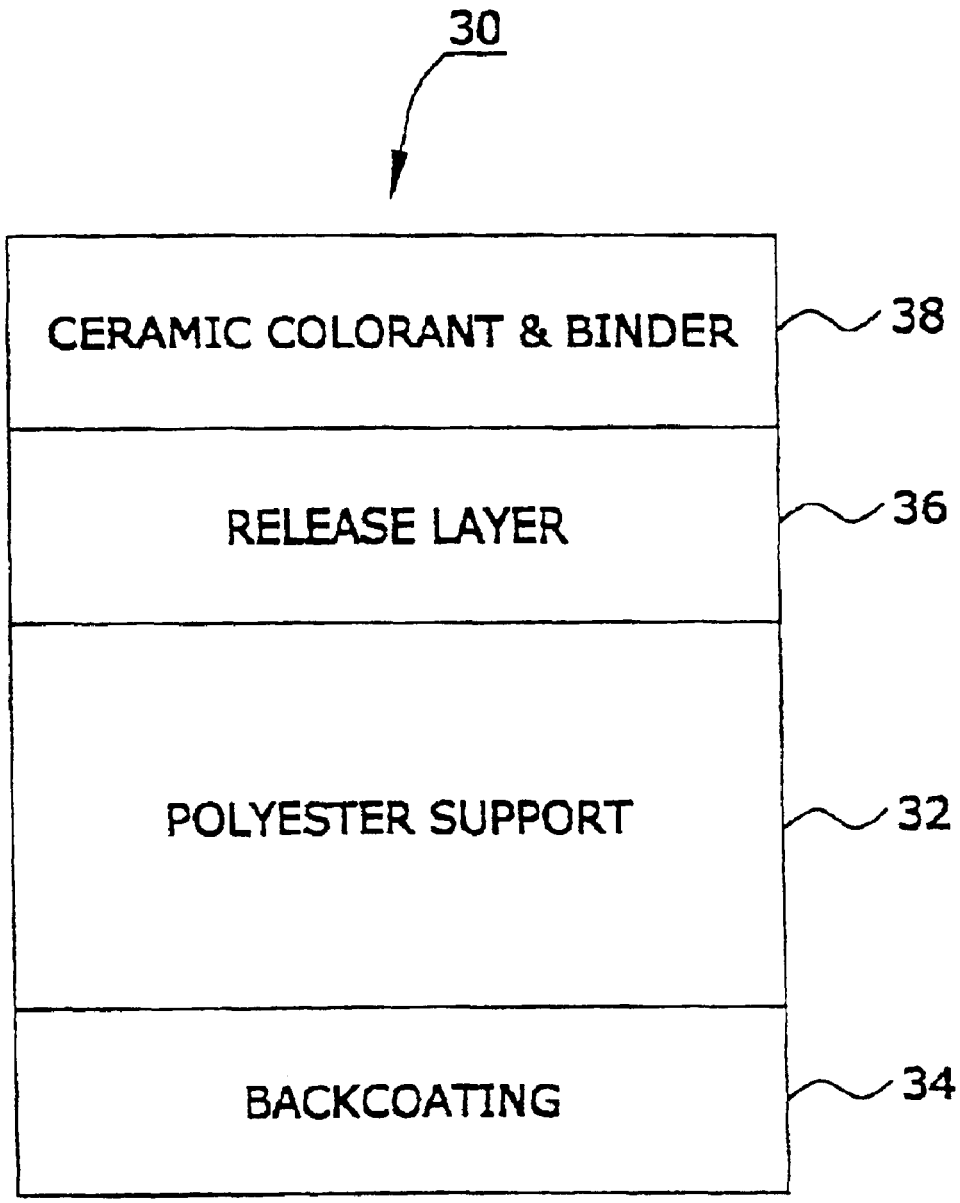

FIG. 2 is a schematic representation of a preferred ribbon which may be used in the process of this invention. Referring to FIG. 2, it will be seen that ribbon 30 is comprised of a flexible substrate 32 that, in the embodiment depicted, is a polyester support.

Substrate 32 may be any substrate typically used in thermal transfer ribbons such as, e.g., the substrates described in U.S. Pat. No. 5,776,280; the entire disclosure of this patent is hereby incorporated by reference into this specification.

In one embodiment, substrate 32 is a flexible material which comprises a smooth, tissue-type paper such as, e.g., 30–40 gauge capacitor tissue. In another embodiment, substrate 32 is a flexible material consisting essentially of synthetic polymeric material, such as poly(ethylene terephthalate) polyester with a thickness of from about 1.5 to about 15 microns which, preferably, is biaxially oriented. Thus, by way of illustration and not limitation, one may use polyester film supplied by the Toray Plastics of America (of 50 Belvere Avenue, North Kingstown, R.I.) as catalog number F53.

By way of further illustration, substrate 32 may be any of the substrate films disclosed in U.S. Pat. No. 5,665,472, the entire disclosure of which is hereby incorporated by reference into this specification. Thus, e.g., one may use films of plastic such as polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated resin, ionomer, paper such as condenser paper and paraffin paper, nonwoven fabric, and laminates of these materials.

Affixed to the bottom surface of substrate 32 is backcoating layer 34, which is similar in function to the "backside layer" described at columns 2–3 of U.S. Pat. No. 5,665,472. The function of this backcoating layer 34 is to prevent blocking between a thermal backing sheet and a thermal head and, simultaneously, to improve the slip property of the thermal backing sheet.

Backcoating layer 34, and the other layers which form the ribbons of this invention, may be applied by conventional coating means. Thus, by way of illustration and not limitation, one may use one or more of the coating processes described in U.S. Pat. Nos. 6,071,585 (spray coating, roller coating, gravure, or application with a kiss roll, air knife, or doctor blade, such as a Meyer rod), U.S. Pat. No. 5,981,058 (myer rod coating), U.S. Pat. Nos. 5,997,227, 5,965,244, 5,891,294, 5,716,717, 5,672,428, 5,573,693, 4,304,700, and the like. The entire disclosure of each of these U.S. patents is hereby incorporated by reference into this specification.

Thus, e.g., backcoating layer 34 may be formed by dissolving or dispersing the above binder resin containing additive (such as a slip agent, surfactant, inorganic particles, organic particles, etc.) in a suitable solvent to prepare a coating liquid. Coating the coating liquid by means of conventional coating devices (such as Gravure coater or a wire bar) may then occur, after which the coating may be dried.

One may form a backcoating layer 34 of a binder resin with additives such as, e.g., a slip agent, a surfactant, inorganic particles, organic particles, etc.

Binder resins usable in the layer 34 include, e.g., cellulosic resins such as ethyl cellulose, hydroxyethylcellulose, hydroxypropylcellulose, methylcellulose, cellulose acetate, cellulose acetate buytryate, and nitrocellulose. Viny resins, such as polyvinylalcohol, polyvinylacetate, polyvinylbutyral, polyvinylacetal, and polyvinylpyrrolidone also may be used. One also may use acrylic resins such as polyacrylamide, polyacrylonitrile-co-styrene, polymethylmethacrylate, and the like. One may also use polyester resins, silicone-modified or fluorine-modified urethane resins, and the like.

In one embodiment, the binder comprises a cross-linked resin. In this case, a resin having several reactive groups, for example, hydroxyl groups, is used in combination with a crosslinking agent, such as a polyisocyanate.

In one embodiment, a backcoating layer 34 is prepared and applied at a coat weight of 0.05 grams per square meter. This backcoating 34 preferably is polydimethylsiloxane-urethane copolymer sold as ASP-2200 by the Advanced Polymer Company of New Jersey.

One may apply backcoating 34 at a coating weight of from about 0.01 to about 2 grams per square meter, with a range of from about 0.02 to about 0.4 grams/square meter being preferred in one embodiment and a range of from about 0.5 to about 1.5 grams per square meter being preferred in another embodiment.

Referring again to FIG. 2, and in the preferred embodiment depicted therein, it will be seen that substrate 32 contains an optional release layer 36 coated onto the top surface of the substrate. The release layer 36, when used, facilitates the release of the ceramic colorant/binder layer 38 from substrate 32 when a thermal ribbon 30 is used to print at high temperatures.

Release layer 36 preferably has a thickness of from about 0.2 to about 2.0 microns and typically is comprised of at least about 50 weight percent of wax. Suitable waxes which may be used include carnuaba wax, rice wax, beeswax, candelilla wax, montan wax, paraffin wax, mirocrystalline waxes, synthetic waxes such as oxidized wax, ester wax, low molecular weight polyethylene wax, Fischer-Tropsch wax, and the like. These and other waxes are well known to those skilled in the art and are described, e.g., in U.S. Pat. No. 5,776,280.

In one embodiment, at least about 75 weight percent of layer 36 is comprised of wax. In this embodiment, the wax used is preferably carnuaba wax.

Minor amounts of other materials may be present in layer 36. Thus, one may include from about 5 to about 20 weight percent of heat-softening resin which softens at a temperature of from about 60 to about 150 degrees Centigrade. Some suitable heat-softening resins include, e.g., the heat-meltable resins described in columns 2 and of U.S. Pat. No. 5,525,403, the entire disclosure of which is hereby incorporated by reference into this specification. In one embodiment, the heat-meltable resin used is polyethylene-co-vinylacetate with a melt index of from about 40 to about 2500 dg. per minute.

Referring to FIG. 2, and in the preferred embodiment depicted therein, the layer 36 may be omitted and the layer 38 may be directly contiguous with substrate 32.

Ceramic colorant/binder layer 38 is one of the layers used to produce the ceramic colorant image 20. In the process of the invention, a multiplicity of ribbons 30, each one of which preferably contains a ceramic colorant/binder layer 38 with different colorant(s), are digitally printed to produce said ceramic colorant image 20. What these ribbons have in common is that they all contain both binder and colorant material of the general type and in the general ratios described for layer 20. In one preferred embodiment, there is substantially no glass frit in layer 20 (i.e., less than about 5 weight percent). The concentrations of colorant and binder, and the types of colorant and binder, need not be the same for each ribbon. What is the same, however, are the types of components in general and their ratios.

Figure 3:
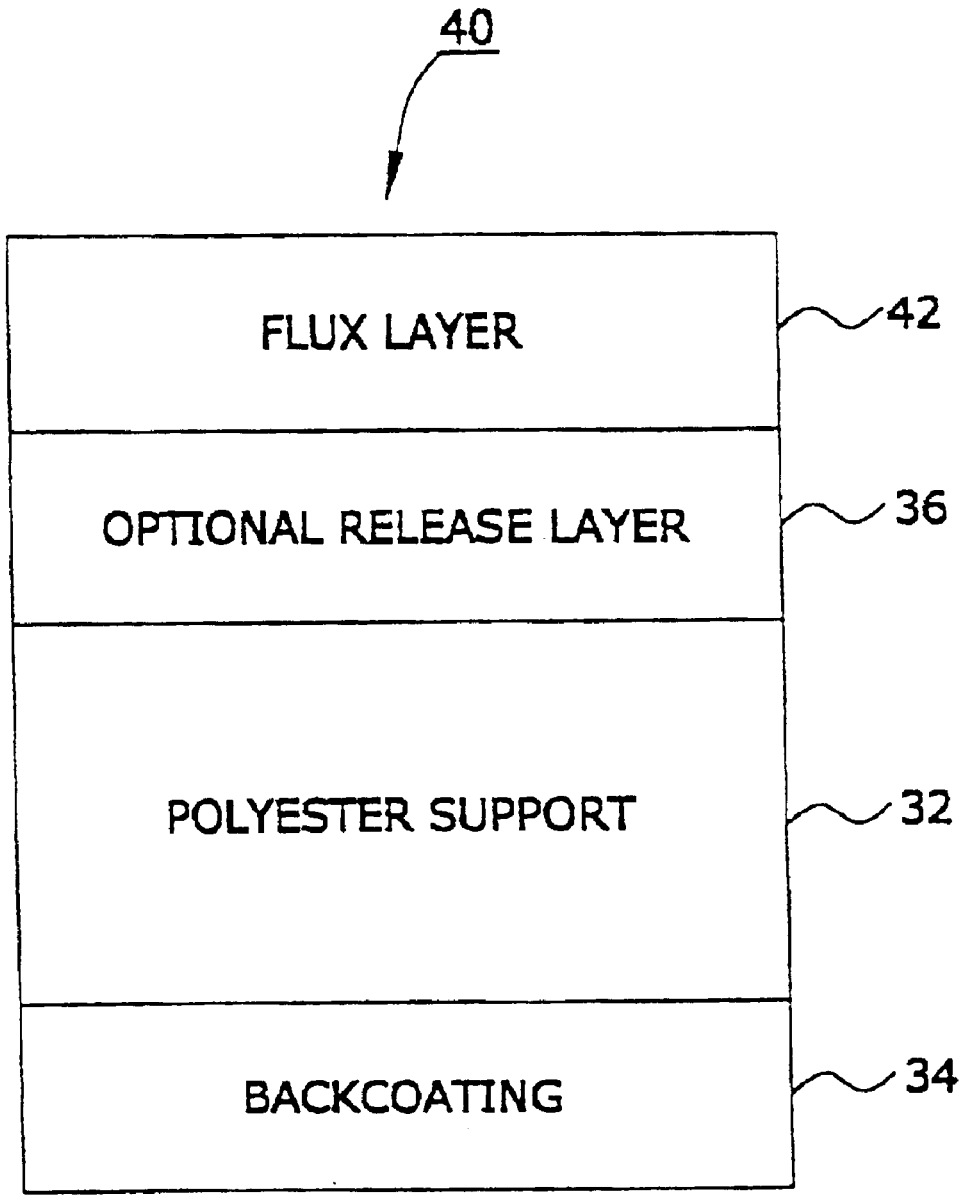

FIG. 3 is a schematic representation of a preferred ribbon 40 which is similar to the ribbon 30 depicted in FIG. 2 but differs therefrom in that it utilizes a flux layer 42 instead of the ceramic colorant and binder element 38. The flux layer 42, in general, has similar components, and ratios, as the composition of flux layer 18 (see FIG. 1) and is used to deposit layer 14 and/or layer 18 and/or layer 22 onto the ceramic substrate 12. As will be apparent to those skilled in the art, the precise composition and coating weight of flux layer 42 will depend upon the precise composition and coating weight of the flux layer 14 and/or flux layer 18 and/or flux layer 22 desired.

In the embodiment depicted in FIG. 1, at least 4 separate flux-containing layers are depicted. In general, it is preferred to utilize at least two such layers. In general, the number of layers of flux required will depend upon how much total flux must be used to keep the total flux/colorant ratio in composite 11 at least 2.0.

It is preferred not to dispose all of the flux required in one layer. Furthermore, it is preferred that at least some of the flux be disposed below the ceramic colorant image, and at least some of the flux be disposed above the ceramic colorant image.

In one embodiment, at least 10 weight percent of the total amount of flux used should be disposed on top of ceramic colorant image 20 in one or more flux layers (such as layers 22 and 24). In this embodiment, at least about 50 percent of the total amount of flux should be disposed below ceramic colorant image 20 in one or more of flux layer 18 and/or flux layer 14.

In another embodiment, from about 30 to about 70 weight percent of the entire amount of frit used in the process of this invention is disposed below the ceramic image 20, and from about 70 to about 30 weight percent of the entire amount of frit used in the process of the invention should be disposed above the ceramic image 20. As will be apparent to those skilled in the art, a layer of material which contains frit need not necessarily be contiguous with the ceramic colorant image 20 to be disposed either below or above it. Thus, by way of illustration and not limitation, and referring to FIG. 1, the flux underlayer 14 is not contiguous with the ceramic colorant image 20 but is still disposed below such image.

In one embodiment, from about 40 to about 60 weight percent of the entire amount of frit used in the process of this invention is disposed below the ceramic image 20, and from about 60 to about 40 weight percent of the entire amount of frit used in the process of the invention should be disposed above the ceramic image 20. In yet another embodiment, from about 75 to about 90 weight percent of the entire amount of frit used in the process of this invention is disposed below the ceramic image 20, and from about 25 to about 10 weight percent of the entire amount of frit used in the process of the invention should be disposed above the ceramic image 20

If the required amount of flux is not disposed above the ceramic colorant image 20, applicants have discovered that poor color development occurs when cadmium pigments and other pigments are used. Inasmuch as the ceramic substrate 12 (see FIG. 1) is substantially as impervious as a sintered flux layer, applicants do not know precisely why this phenomenon occurs.

For non-cadmium-containing ceramic colorant images, applicants have discovered that acceptable results utilizing a single layer of frit may be obtained so long as the single layer of frit is positioned both above the colorant image 20 and the ceramic substrate 12 and provides a ratio of total frit to ceramic colorant in excess of about 1.25, weight/weight.

Figure 4:
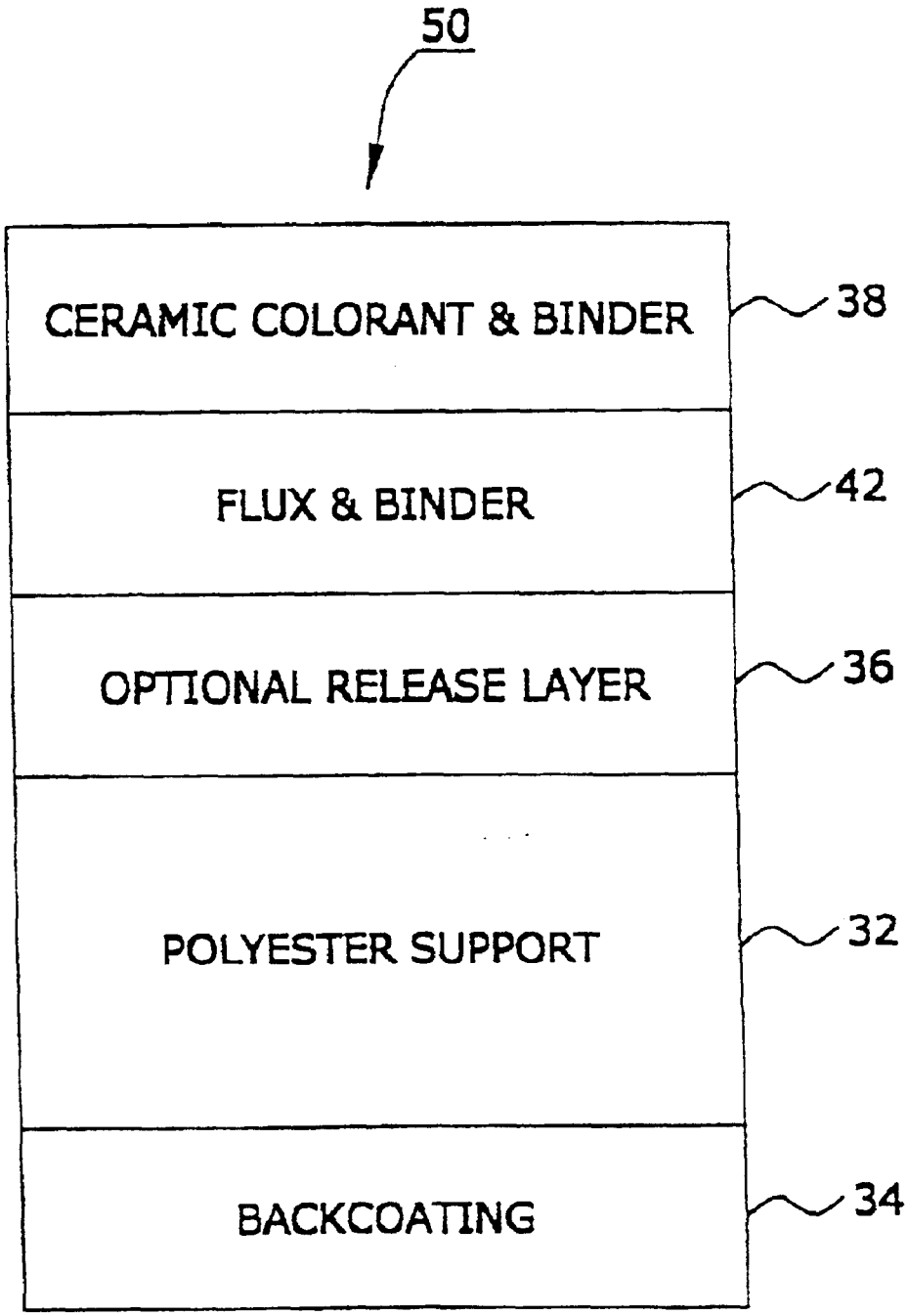

FIGS. 4 is a schematic of yet another preferred ribbon 50 which is similar in construction to the ribbons depicted in FIGS. 2 and 3 but differs therefrom in containing a different arrangement of layers.

Figure 5:
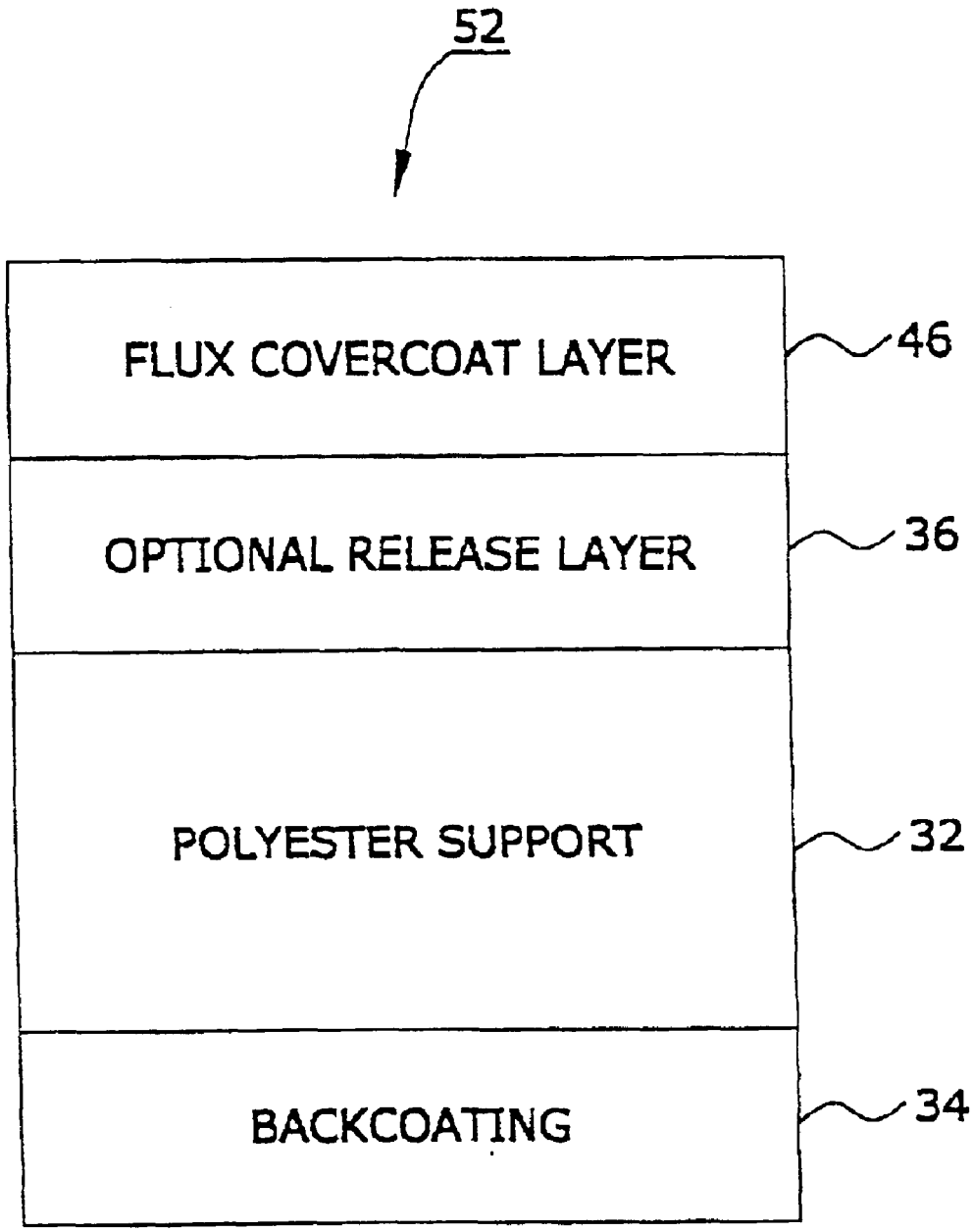

FIG. 5 is a schematic of yet another preferred ribbon 52 which is similar to the ribbons depicted in FIGS. 2, 3, and 4 but differs therefrom in containing a flux covercoat layer 46. As will be apparent to those skilled in the art, the flux covercoat layer 46 may be used to deposit the flux covercoat 24 (see FIG. 1) and, thus, should have a composition similar to the desired covercoat 24.

FIG. 6 is a schematic of yet another preferred ribbon 54 which is similar to the other ribbons depicted but which, additionally, is comprised of opacification layer 48. The opacification layer 48 may be used to print opacification layer 16 (see FIG. 1) and, thus, should contain substantially the same components and ratios as described for layer 16.

FIG. 6A is a schematic representation of a another preferred ribbon 60 of the invention which is comprised of backcoating layer 34, polyester support 32, and release layer 36. Disposed on top of release layer 36 are a multiplicity of panels which are disposed at selected locations on top of release layer 36. Using conventional printing techniques, one of such panels (such as panel 42) is first coated onto release layer 36 at the desired location, followed by selective coating of the second panel 48, the third panel 38 etc. Although the panels 42, 48, 38, and 46 have been shown in a particular configuration in FIG. 6A, it will be apparent that other panels and/or other configurations may be used.

To obtain such selective location(s) of the panels, one may a gravure coating press. What is obtained with this process is a ribbon with repeating sequences of various panels, which thus can be utilized in a single head thermal transfer printer to obtain a print image with multiple colors and or compositions and/or properties.

In this embodiment, it is preferred to use a sequence of 42/48/38/38/38/46 to obtain, with printing operation, and covercoated decal which may be used to produce an image on a ceramic substrate with good print density and good durability.

FIG. 7 is a schematic representation of a ceramic decal 70, which can be produced using one or more of the ribbons depicted in FIGS. 2 through 6A. The various panels 38 shown in FIG. 6A represent one or more ceramic colorant panels used to produce a ceramic colorant image 20.

Referring to FIG. 7, and in the preferred embodiment depicted therein, the ceramic decal 70 is preferably comprised of flexible substrate 72.

Flexible substrate 72 is often referred to as a "backing sheet" in the prior art; see, e.g., U.S. Pat. No. 5,132,165 of Blanco, the entire disclosure of which is hereby incorporated by reference into this specification. Thus, e.g., substrate 72 can include a dry strippable backing or a solvent mount or a water mount slide-off decal. The backing may be of paper or other suitable material such as, e.g., plastic, fabric, and the like. In one embodiment, the backing comprises paper which is coated with a release material, such as dextrine-coated paper. Other possible backing layers include those coated with polyethylene glycol and primary aliphatic oxyethylated alcohols.

By way of further illustration, one may use "Waterslide" paper, which is commercially available paper with a soluble gel coat; such paper may be obtained from Brittians Papers Company of England. This paper is also described in U.S. Pat. Nos. 6,110,632, 5,830,529, 5,779,784, and the like; the entire disclosure of each of these U.S. patents is hereby incorporated by reference into this specification.

Additionally, one may use heat transfer paper, i.e., commercially available paper with a wax coating possessing a melt point in the range of from about 65 to about 85 degrees Centigrade. Such heat transfer paper is discussed, e.g., in U.S. Pat. Nos. 6,126,669, 6,123,794, 6,025,860, 5,944,931, 5,916,399, 5,824,395, 5,032,449, and the like. The disclosure of each of these U.S. patents is hereby incorporated by reference into this patent application.

Regardless of what paper is used, and in one embodiment, it is optionally preferred that a flux layer 74 be either coated to or printed on such paper 72. The thickness of such coating 74 should be at least about 5 microns after such coating has dried, and even more preferably at least about 7 microns. Applicants have discovered that when a coating weight is used which produces a thinner layer 74, poor color development results when cadmium-based ceramic colorants are used. It should be note that, in the process described in U.S. Pat. No. 5,132,165, a thickness of the "prefused glass flux layer" of only from about 3 to about 4 microns is disclosed.

In one embodiment, the flexible substrate 72 is adapted to separate from a release layer upon the application of minimal force. Thus, e.g., and referring to FIG. 14, the paper 226 (which acts as a flexible substrate 72) is preferably adapted to release from covercoat 224 upon the application of a linear stress of less than about 30 grams per centimeter at a temperature of 20 degrees Celsius. It is preferred that the peel strength required to separate the covercoat be less than about 15 grams per centimeter at 20 degrees Celsius.

One may determine the force required to separate a covercoat from a flexible substrate by a test in which 1.27 centimeter×20.32 centimeter strips of cover coated substrate are prepared. The covercoat is then manually separated at 20 degrees Celsius from the substrate backing for 2.54 centimeters at the top of each strip. Each half of the strip is then mounted in the grips of an tensile device manufactured by the Sintech Division of MTS Systems company (P.O. Box 14226, Research Triangle Park, Raleigh, N.C. 22709) and identified as Sintech model 200/S. 200/S). Such use of the Sintech 200/S machine is well known. Reference may be had to, e.g., international patent publications W00160607A1, W00211978A, W00077115A1, and the like. The entire disclosure of each of these patent publications is hereby incorporated by reference into this specification. The peel adhesion is measured at 25.4 centimeters per minute with a 5 pound load cell at a temperature of 20 degrees Celsius and ambient pressure.

Referring again to FIG. 7, ceramic colorant images 76 (yellow), and/or 78 (magenta) and/or 80 (cyan) and/or 82 (black) may be digitally printed by sequentially using one or more ribbons 30. Flux layers 42 may optionally be printed by utilizing ribbon 40, which can sequentially print layer 42 in between the various image colors. Alternatively, layer 42 may be printed simultaneously with the image colors by the use of ribbon 50.

The preferred ribbons depicted in FIGS. 2 through 6A afford one a substantial amount of flexibility, when using applicants' process, of preparing decals with many different configurations.

As will be apparent, one or more printers equipped with one or more of such ribbons can be controlled by a computer, which can produce a decal with substantially any desired combination of colors, colored patterns, images, and physical properties.

Referring again to FIG. 7, the flux covercoat 46 may be printed by means, e.g., of ribbon 52.

FIG. 8 is a schematic representation of a decal 80 which is similar in many respects to decal 70 (see FIG. 7) but differs therefrom in containing an opacification layer 48 which is similar in function and composition to the opacification layer 48 depicted for ribbon 54 (see FIG. 6); in another embodiment, not shown, the flux underlayer 14 is omitted. It should be noted that, in image 20, a multiplicity of ceramic images may be digitally printed and superimposed on each other to form such image.

Figure 9:
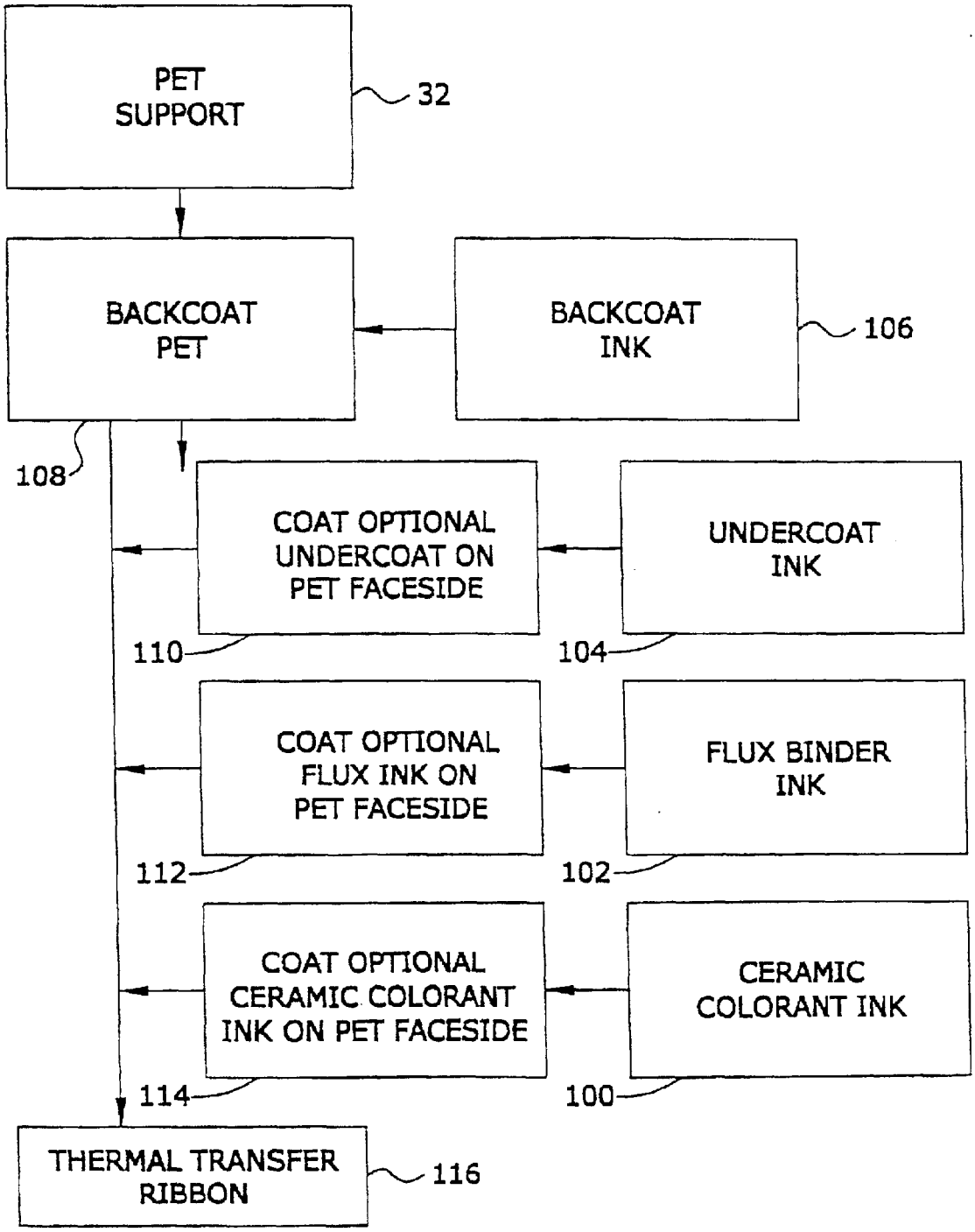

FIG. 9 is a flow diagram of one preferred process for preparing a ribbon of this invention As will be apparent to those skilled in the art, the process illustrated may be used to prepare ribbon 30, and/or ribbon 40, and/or ribbon 50, etc.

In step 100 of the process depicted in FIG. 9, one may prepare a ceramic colorant ink as described in this specification, in accordance with the description, e.g., of layer 38 of FIG. 2. This ink may be used to coat the faceside of polyester support 32 in step 114 (see FIG. 2).

In step 102, one may prepare a flux binder ink as described in this specification; see, e.g., layer 42 of FIG. 3 and its accompanying description. This flux binder ink may be used to either directly coat the faceside of the polyester support 32 in step 112, and/or coat over an optional release layer 36 in step 110.

In step 104, a release layer is prepared as described in this specification; see, e.g., release layer 36 of FIG. 2 and its accompanying description. This release layer 36 may optionally be used in step 110 to coat the face side of the polyester substrate 32.

In step 106, a backcoat ink may be prepared as described in this specification; see, e.g., backcoating layer 34 of FIG. 2 and its accompanying description. This backcoat layer 34 may be used to coat the backside of the polyester substrate in step 108. In step 114, the faceside of the polyester support 32 may be coated with ceramic colorant ink.

As will be apparent to those skilled in the art, using the combination of steps illustrated in FIG. 9, one may readily prepare one or more of the ribbons illustrated in FIGS. 2 through 5. Furthermore, although not specifically depicted in FIG. 9, one may prepare an opacification layer in accordance with the description of opacification layer 48 (See FIG. 6 and its accompanying description) which may be used to prepare ribbons containing such opacification layer; also see FIG. 6A).

Figure 10:
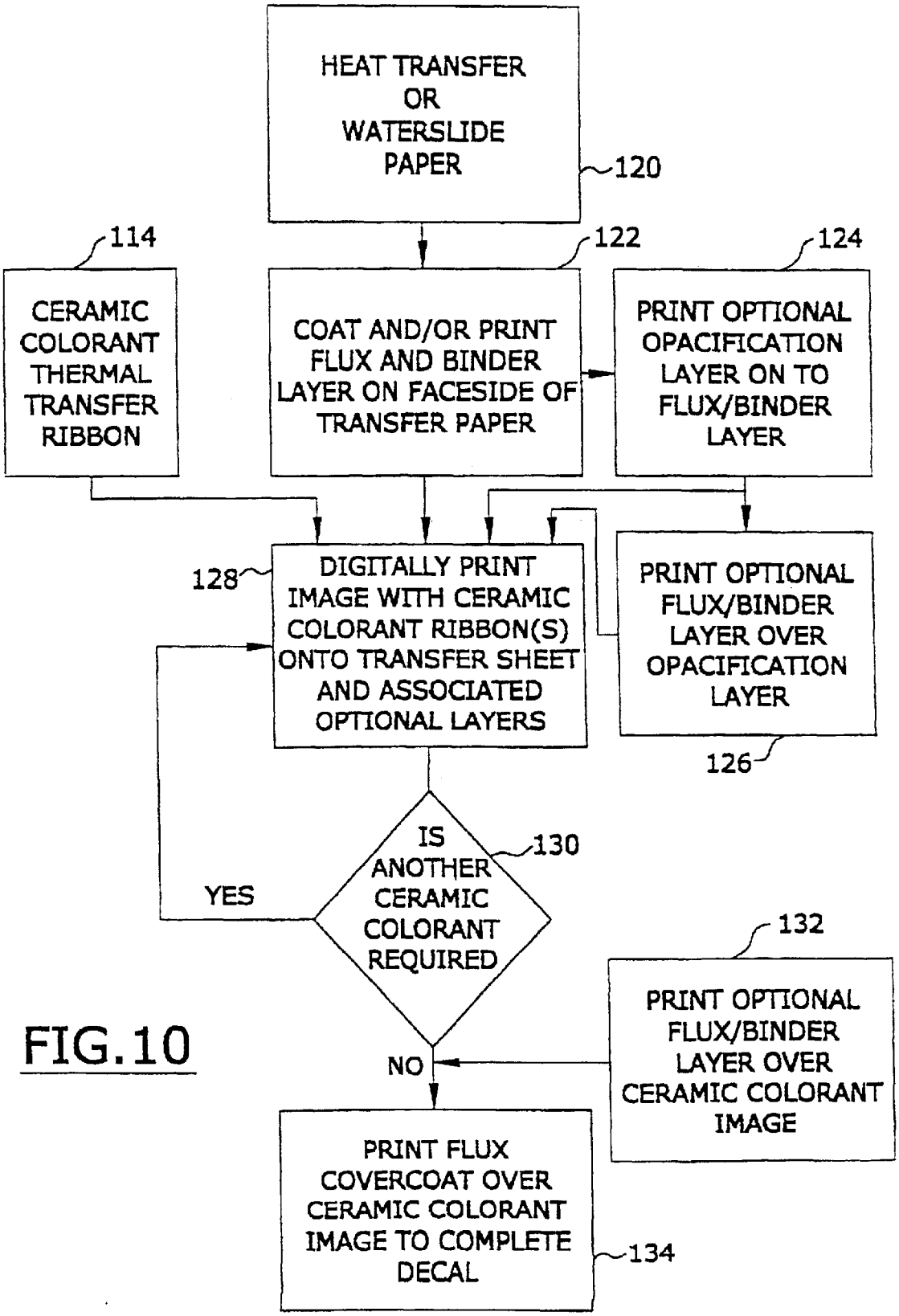

FIG. 10 is a schematic diagram of a preferred process for producing a ceramic decal. In step 120, either heat transfer or Waterslide paper is provided; these papers are described in the specification (see element 72 of FIG. 7 and its accompanying description). A flux and binder layer is either coated or printed on the face of such optional step 122 (see element 74 of FIG. 7 and its accompanying description); and this flux and binder layer, when dried, should be at least about 7 microns thick.

In step 124, one may optionally print an opacification layer onto the flux binder layer described in step 122. This opacification layer corresponds to layer 48 of FIG. 8. It is preferred, when such opacification layer is used in step 122, to print an optional flux/binder layer over the opacification layer in step 126; this optional flux binder layer is described as element 42 of FIG. 8. However, as is illustrated in FIG. 10, the optional flux/binder layer may be omitted, and one may proceed directly from step 124 to step 128. Alternatively, one may omit both the opacification step and the optional flux binder layer step and proceed directly from step 122 to 128.

Whichever pathway one wishes to follow, it is preferred to use a ceramic colorant thermal transfer ribbon 114 in step 128. The preparation of this ribbon was illustrated in FIG. 9.

In step 128, which may optionally be repeated one or more times with different ceramic colorant ribbons 114, an color image is digitally printed using such ribbon 114 and a digital thermal transfer printer. In one embodiment, prints were produced using a Zebra 140XiII thermal transfer printer run at 4 inches per second with energy level settings ranging from 18 to 24.

In one embodiment, the digital image to be printed is composed of one or more primary colors, and such image is evaluated to determine how many printings of one or more ceramic colorants are required to produce the desired image. Thus, in decision step 130, if another printing of the same or a different colored image is required, step 128 is repeated. If no such additional printing is required, one may then proceed to step 132 and/or step 134.

In optional step 132, an optional flux binder layer is printed over the ceramic colorant image produced in step(s) 128. This optional flux binder layer corresponds to element 42 of FIG. 8. Thereafter, either one goes from step 132 to 134, or one goes directly from decision step 130 to step 134. In printing step 134, a flux covercoat corresponding to element 24 of FIG. 8 is printed to complete the decal. As will be apparent to those skilled in the art, one may apply the covercoat over the entire decal (which includes both a printed image and unprinted area[s]). Alternatively, one may apply the covercoat over the entire imaged areas.

Figure 11:
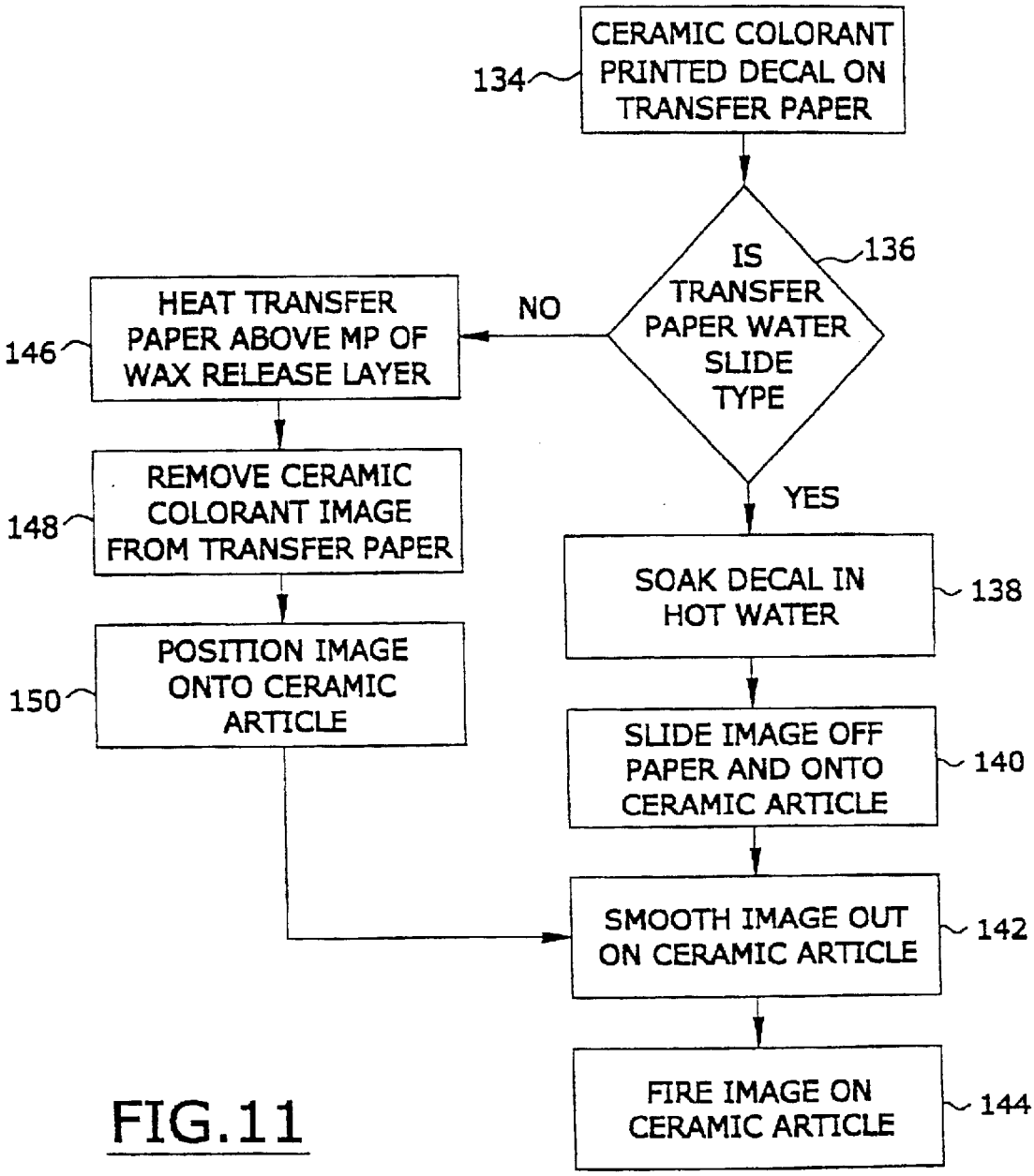

Thus, a complete decal is produced in FIG. 10 and now be may be used in FIG. 11 to produce the imaged ceramic article.

Figure 10A:
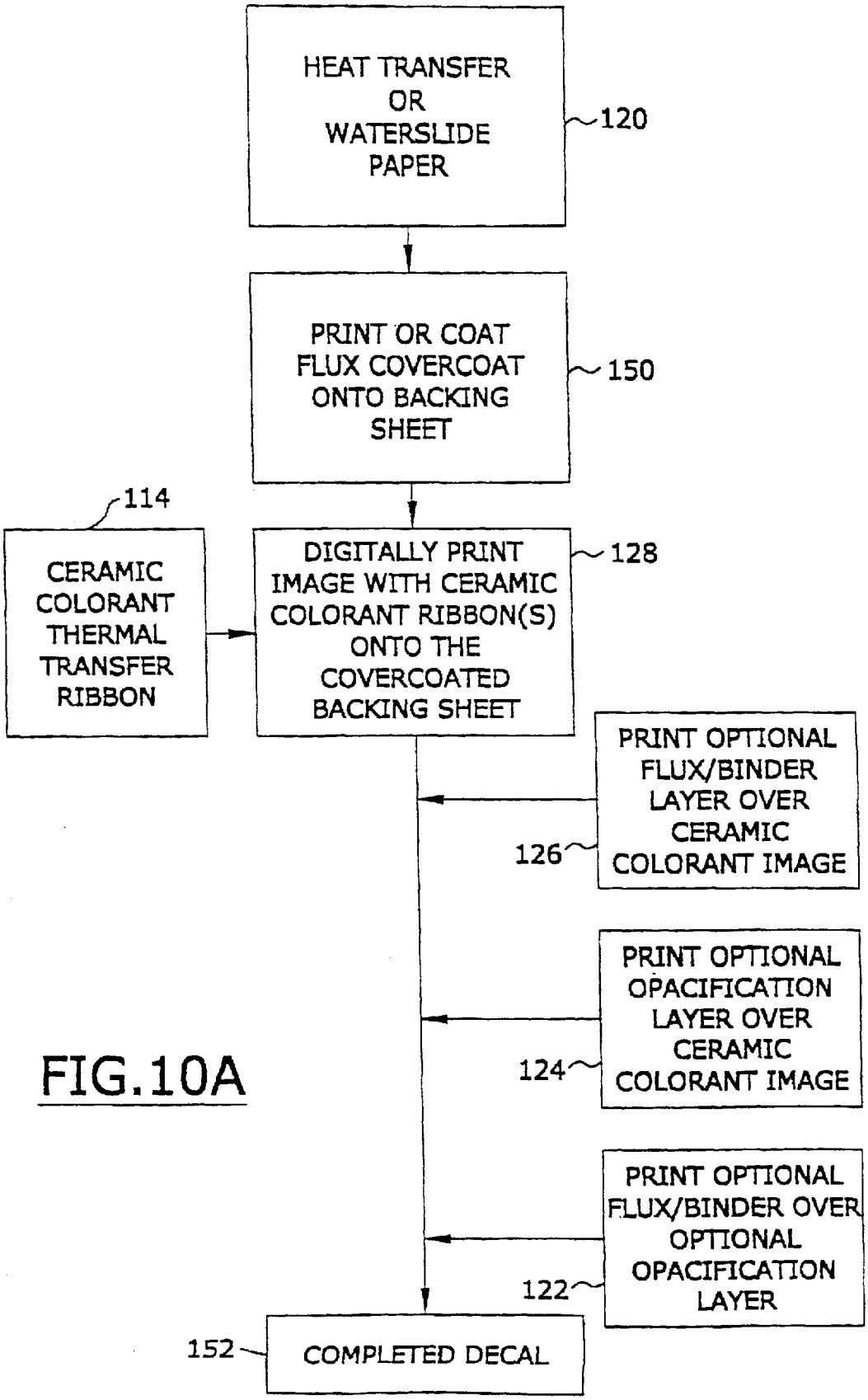

FIG. 10A illustrates an alternative process for preparing a decal according to the invention. As will be apparent to those skilled in the art, the process illustrated in FIG. 10A is very similar to the process illustrated in FIG. 10 with several exceptions. In the first place, in the process of FIG. 10A, in step 150 the covercoat is applied or printed to the assembly prior to the time the ceramic colorant image 128 is applied. Thereafter, following the application of ceramic colorant image 128, optional flux binder (step 126), and/or opacifying agent (step 124), and/or flux/binder (step 122) may be applied to form the decal 152.

The process of FIG. 10A may be used, e.g., to print a decal which thereafter may be applied, e.g., to a wine bottle. Thus, e.g., in such an embodiment, the image is preferably removed from the decal with hot silicone pad or a hot silicone roller. Thereafter, the image is retransferred directly onto the ceramic article (wine bottle) and processed as illustrated in FIG. 11.

In the process depicted in FIG. 11, the decal produced in step 134 of FIG. 10 is treated in one of two ways, depending upon whether the substrate comprising the decal is Waterslide or heat transfer paper.

If the substrate comprising the image is Waterslide paper, then the decal is first soaked in hot water (at a temperature of greater than 40 degrees Centigrade. for preferably at least about 30 seconds). In step 138, the image on the Waterslide paper is then separated from the paper in step 140, this image is then placed onto a ceramic substrate and smoothed to remove wrinkles or air bubbles in step 142 and dried; and the image is then "fired." The imaged ceramic substrate is subjected to a temperature of from about 550 to about 1200 degrees Centigrade in step 144.

If, alternatively, the substrate is heat transfer paper, then the decal is heated above the melting point of the wax release layer on the paper in step 146; such temperature is generally from about 50 to about 150 degrees Centigrade. Thereafter, while said wax release layer is still in its molten state, one may remove the ceramic colorant image from the paper in step 148, position the image onto the ceramic article in step 150, and then follow steps 142 and 144 as described hereinabove.

When one wishes to make the ornamental wine bottle referred to hereinabove, the step 148 may be accompanied with the use of the hot silicone pad and/or the hot silicone roller described hereinabove.

A Thermal Transfer Ribbon Comprised of Frosting Ink

In one preferred embodiment, the thermal transfer ribbon of this invention is used to directly or indirectly prepare a digitally printed "frost" or "frosting" on a ceramic or glass substrate. As is known to those skilled in the art, frosting is a process in which a roughened or speckled appearance is applied to metal or glass. Reference may be had, e.g., to U.S. Pat. Nos. 6,092,942, 5,844,682, 5,585,555, 5,536,595, 5,270,012, 5,209,903, 5,076,990, 4,402,704, 4,396,393, and the like. The entire disclosure of each of these U.S. patents is hereby incorporated by reference into this specification.

FIG. 12 is a schematic representation of one preferred thermal ribbon 200 comprised of a frosting ink layer 202. The ribbon depicted in this Figure is prepared in substantial accordance with the procedure described elsewhere in this specification.

The frosting ink layer 202 is preferably comprised of from about 15 to about 94.5 weight percent of a solid, volatilizable carbonaceous binder; in one preferred embodiment, the frosting ink layer is comprised of from about 20 to about 40 weight percent of such solid, volatilizable carbonaceous binder.

As used herein, the term carbonaceous refers to a material which is composed of carbon. The term volatilizable, as used in this specification, refers to a material which, after having been heated to a temperature of greater than 350 degrees Centigrade for at least 5 minutes in an atmosphere containing at least about 15 volume percent of oxygen, will be transformed into gas and will leave less than about 5 weight percent (by weight of the original material) of a residue comprised of carbonaceous material.

The solid, volatilizable carbonaceous binder may be one or more of the resins, and/or waxes, and/or plasticizers described elsewhere in this specification Reference may be had, for example, to the thermoplastic binders described elsewhere in this specification.

Referring again to FIG. 12, the frosting ink layer is preferably comprised of from about 5 to about 75 weight percent of a film forming glass flux which melts at a temperature of greater than about 550 degrees Centigrade. As is known to those skilled in the art, such a film forming material is able to form a continuous film when fired at a temperature of above 550 degrees Centigrade. Reference may be had, e.g., to the frits used to form underlayer 14 (see FIG. 1) and or flux layer 18 (see FIG. 1) and/or flux layer 22 (see FIG. 1).

In one preferred embodiment, the frosting ink layer is comprised of from about 35 to about 75 weight percent of the film forming glass flux. In another embodiment, the frosting ink layer is comprised of from about 40 to about 75 weight percent of the film forming glass flux.

The film forming glass flux used in frosting ink layer 202 preferably has a refractive index less than about 1.4.

By way of illustration and not limitation, and in one preferred embodiment, the film forming glass flux used in frosting ink layer 202 is comprised of 48.8 weight percent of unleaded glass flux 23901 and 9.04 weight percent of OnGlaze Unleaded Flux 94C1001, each of which is described elsewhere in this specification.

Referring again to FIG. 12, the frosting ink layer 12 is preferably comprised of at least about 0.5 weight percent of opacifying agent with a melting temperature of at least 50 degrees Centigrade above the melting temperature of the film forming glass, a refractive index of greater than about 1.4, and a particle size distribution such that substantially all of its particles are smaller than about 20 microns. One may use one or more of the opacifying agents described elsewhere in this specification by reference to opacification layer 16 (see FIG. 1). One may use other opacifying agents such as, e.g., Superpax Zircon Opacifier. This and other suitable opacifying agents are described elsewhere in this specification.

In one embodiment, from about 2 to about 25 weight percent of the opacifying agent is used. In another embodiment, from about 5 to about 20 weight percent of the opacifying agent is used. Thus, e.g., one may 8.17 weight percent of such Superpax Zircon Opacifier opacifying agent.

In one preferred embodiment, it is preferred that the refractive index of the opacifying agent(s) used in the frosting ink layer 202 be greater than about 1.4 and, preferably, be greater than about 1.7.

The film forming glass flux(es) and the opacifying agent (s) used in the frosting ink layer 202 should be chosen so that the refractive index of the film forming glass flux material(s) and the refractive index of the opacifying agent material(s) differ from each other by at least about 0.1 and, more preferably, by at least about 0.2. In another preferred embodiment, the difference in such refractive indices is at least 0.3, with the opacifying agent having the higher refractive index.

The film forming glass flux(es) and the opacifying agent (s) used in the frosting ink layer 202 should be chosen such that melting point of the opacifying agent(s) is at least about 50 degrees Centigrade higher than the melting point of the film forming glass flux(es) and, more preferably, at least about 100 degrees higher than the melting point of the film forming glass fluxes. In one embodiment, the melting point of the opacifying agent(s) is at least about 500 degrees Centigrade greater than the melting point of the film forming glass flux(es). Thus, it is generally preferred that the opacifying agent(s) have a melting temperature of at least about 1,200 degrees Centigrade.

It is preferred that the weight/weight ratio of opacifying agent/film forming glass flux used in the frosting ink layer 202 be no greater than about 1.25.

Referring again to FIG. 12, and in one embodiment, thereof, the frosting ink layer 202 is optionally comprised of from about 1 to about 25 weight percent of platy particles; in an even more preferred aspect of this embodiment, the concentration of the platy particles is from about 5 to about 15 weight percent. As is known to those skilled in the art, a platy particle is one whose length is more than three times its thickness. Reference may be had, e.g., to U.S. Pat. Nos. 6,277,903, 6,267,810, 6,153,709, 6,139,615, 6,124,031, 6,004,467, 5,830,364, 5,795,501, 5,780,154, 5,728,442, 5,693,397, 5,645,635, 5,601,916, 5,597,638, 5,560,983, 5,460,935, 5,457,628, 5,447,782, 5,437,720, 5,443,989, 5,364,828, 5,242,614, 5,231,127, 5,227,283, 5,196,131, 5,194,124, 5,153,250, 5,132,104, 4,548,801, 4,544,761, 4,465,797, 4,405,727, 4,154,899, 4,131,591, 4,125,411, 4,087,343, and the like. The entire disclosure of each of these U.S. patents is hereby incorporated by reference into this specification.

The platy particles are preferably platy inorganic particles such as, e.g., platy talc. Thus, by way of illustration and not limitation, one may use "Cantal 290" micronized platy talc sold by the Canada Talc company of Marmora Mine Road, Marmora, Ontario, Canada. This platy talc has a particle size distribution such that substantially all of its particles are smaller than about 20 microns. Alternatively, or additionally, one may use, e.g., Cantal 45–85 platy particles, and/or Sierralite 603 platy particles; Sierralite 603 particles are sold by Luzenac America, Inc. of 9000 East Nicols Avenue, Englewood, Colo.

In one preferred embodiment, the frosting ink layer 202 optionally contains from 0.5 to about 25 weight percent of a colorant such as, e.g., the metal-oxide colorants referred to in reference to ceramic colorant layer 38 (see FIG. 2). It is preferred that such optional metal oxide pigment, when used in ink layer 202, have a have a refractive index of greater than 1.4.

The thermal ribbon 202 depicted in FIG. 12 may be prepared by the means described elsewhere in this specification (see, e.g., the examples). In particular, The frosting ink layer 202 is preferably prepared by coating a frosting ink at a coating weight of from about 2.0 to about 15 grams per square meter onto the polyester substrate. In one embodiment, the coating weight of the frosting ink layer 202 is from about 4 to about 10 grams per square meter.

In the embodiment depicted in FIG. 12, the polyester support 32 preferably has a thickness of from about 2.5 to about 15 microns, and the backcoat 34 preferably has a coating weight of from about 0.02 to about 1.0 grams per square meter. A similar ribbon 210 is depicted in FIG. 13.

The ribbon 210 is substantially identical to the ribbon 200 with the exception that it contains an undercoating layer 212. This undercoat layer 212 is preferably comprised of at least about 75 weight percent of one or more of the waxes and thermo plastic binders described elsewhere in this specification, and it preferably has a coating weight of from about 0.1 to about 2.0 grams per square meter.

The ribbon 210 (see FIG. 13) may be prepared by means described elsewhere in this specification. Reference may be had, e.g., to the Examples of this case.

In FIG. 13A, a ribbon 211 is illustrated which may be constructed in a manner similar to that used for ribbons 200 and 210. The ribbon 211 additionally comprises one or more covercoats 213 which are substantially free of glass frit (containing less than about 5 weight percent of glass) and which preferably each have a coating weight of from about 1 to about 10 grams per square meter. These covercoats 213 preferably are comprised of at least 80 weight percent of one or more of the thermoplastic binders described elsewhere in this specification. The thermoplastic binder material(s) used in the covercoat(s) preferably have an elongation to break of more than about 2 percent, as determined by the standard A.S.T.M. test.

In the embodiment depicted in FIG. 13A, the frosting ink layer preferably has a coat weight of from about 2 to about 15 grams per square meter, the undercoat 212 preferably has a coat weight of from about 0.2 to about 1 grams per square meter, and the polyester substrate 32 preferably has a thickness of from about 3 to about 10 microns.

A similar ribbon 215 is depicted in FIG. 13B. This ribbon is substantially identical to the ribbon depicted in FIG. 13A with the exception that it omits a covercoat 213 disposed on top of the frosting ink layer 202.

The ribbons 200 and/or 210 and/or 211 and/or 215 may be used to prepare a frosting decal. Thus, e.g., one such process comprises the steps of applying to a backing sheet a covercoat comprised of a thermoplastic material with an elongation to break greater than 2 percent and a digitally printed frosting image. The digitally printed frosting image is comprised of a solid carbonaceous binder (described elsewhere in this specification), and a mixture of a film forming glass flux and one or more opacity modifying particles, wherein the difference in the refractive index between the particles and the glass frit is at least 0.1 and the melting point of the particles is at least 50 degrees Centigrade greater than that of the film forming glass flux.

The backing sheet used in this process may be typically polyester or paper. Alternatively, or additionally, the backing sheet may comprise or consist of cloth, flexible plastic substrates, and other substrates such as, e.g., substantially flat materials. When paper is used in this embodiment, it is preferred that similar in composition to the papers described elsewhere in this specification.

FIG. 14 is a schematic representation of one preferred heat transfer paper 220 made with the thermal ribbon of FIG. 12 or FIG. 13. Referring to FIG. 14, it will be seen that, in the preferred embodiment depicted, a wax release layer 36 (see FIG. 2) may be coated onto paper 226 by means described elsewhere in this specification. This wax release layer 36 preferably has a thickness of from about 0.2 to about 2.0 microns and typically is comprised of at least about 50 weight percent of wax.

Referring again to FIG. 14, a covercoat layer 224 is disposed above a paper substrate 226. The covercoat layer 224 preferably is comprised of at least 25 weight percent of one or more of the aforementioned thermoplastic materials with an elongation to break greater than about 2 percent. In one embodiment, the covercoat layer 224 is comprised of at least about 50 weight percent of such thermoplastic material.

In one embodiment, described elsewhere in this specification, the covercoat layer 224 is incorporated into a covercoated transfer sheet for transferring images to a ceramic substrate, wherein said covercoated transfer sheet is comprised of a flat, flexible substrate and a transferable covercoat releaseably bound to said flat, flexible substrate, wherein, when said transferable covercoat is printed with an image to form an imaged covercoat, said image has a higher adhesion to said covercoat than said covercoat has to said flexible substrate, said imaged covercoat has an elongation to break of at least about 1 percent, and said imaged covercoat can be separated from said flexible substrate with a peel force of less than about 30 grams per centimeter. Some of the properties of the desired covercoated layer 224 have been discussed, e.g., by reference to FIG. 7.

In the preferred embodiments depicted in FIGS. 13, 13A, 13B, 14, 15, and 16, the covercoat layers 213 and/or 224 contain less than about 5 weight percent of glass frit. In another embodiment, such covercoat layers contain less than about 1 weight percent of glass frit.

In one preferred embodiment, the covercoat layer 224 is comprised of a thermoplastic material with an elongation to break of at least about 5 percent.

By way of illustration and not limitation, suitable thermoplastic materials which may be used in covercoat layer 224 include, e.g., polyvinylbutyral, ethyl cellulose, cellulose acetate propionate, polyvinylacetal, polymethylmethacrylate, polybutylmethacrylate, and mixtures thereof.

Referring again to FIG. 14, after the covercoat layer 224 has been applied, the frosting ink image 222 may be digitally applied with the use of either the ribbon 200 and/or the ribbon 210 and/or the ribbon 211 and/or the ribbon 215 by means of the printing process described elsewhere in this specification.

FIG. 15 is a schematic representation of a Waterslide assembly 230 which is similar to the heat transfer paper 220 but differs therefrom in several respects. In the first place, the wax release layer 36 is replaced by the water soluble gel layer 228; in the second place, the paper 226 is replaced by the Waterslide paper substrate 229. As is known to those skilled in the art, and as is taught elsewhere in this specification, Waterslide paper is commercially available with soluble gel coating 228.

The Waterslide paper assembly (elements 229 and 228), in the embodiment depicted in FIG. 15, is first coated with covercoat layer 224 at a coat weight of from about 2 to about 20 grams per square meter and then digitally printed with frosting ink image 222 by the means described elsewhere in this specification.

FIG. 16 is a schematic representation of a transferable covercoat assembly 240, which is comprised of paper substrate 226, transferable covercoat paper 242, and frosting ink image 222.

The aforementioned description of the embodiments of FIGS. 1–16 is illustrative only and that changes can be made in the ingredients and their proportions, and in the sequence of combinations and process steps, as well as in other aspects of the inventions discussed herein.

Thus, for example, in one embodiment the decorated ceramic article 10 depicted in FIG. 1 comprises a ceramic or glass substrate 12 on which a ceramic colorant image 20 is disposed. A similar ceramic glass substrate 301 is depicted in FIG. 19. As will be apparent to those skilled in the art, in both cases the ceramic/glass substrate 12 is fired to either sinter it or to cause the materials disposed on it to adhere to it. When such firing occurs, the frit in layers 224 melts and reforms as glass. Thus, after such firing, the ceramic colorant image 20 of FIG. 1, and the frosting ink image 222 of FIG. 19, are disposed between two glass layers.

Thus, e.g., FIG. 19 depicts a coated ceramic/glass substrate 301 which is similar to the coated substrate assembly 10 (see FIG. 1) but differs therefrom in having a covercoat 213/frosting ink image 222/covercoat layer 213 disposed over the substrate 12..

Thus, e.g., other structures may be formed in which, e.g., the frosting ink image 222 is disposed between two glass layers. By way of illustration, and in the process depicted in FIG. 20, one may print a frosting ink image 222 onto a thermoplastic substrate 302 with the use of a ribbon 200, 210, 211, and/or 215. One may use a substrate such as, e.g., a sheet of biaxially oriented poly(ethyelene terephthalate), a sheet of polyvinyl chloride, a sheet of polycarbonate, etc. The digitally printed thermoplastic substrate may then be attached to a first pane of ceramic of glass material and, thereafter, the assembly thus formed may be attached to a second pane of ceramic or glass material to form a ceramic (glass)/thermoplastic sheet/ceramic(glass) laminate structure.

FIG. 21 discloses a structure 305 in which the coated flexible substrate 303 is attached to a ceramic/glass substrate 12. It is preferred not to fire this structure, because the gases evolved from the flexible substrate layer 302 may degrade the frosting ink layer 305.

FIG. 22 depicts a laminated structure 307 in which the assembly 303 is sandwiched between two ceramic/glass substrates 12 to form a laminated structure.

FIG. 23 shows a structure which is similar to that of FIG. 21 but, unlike the structure of FIG. 1, can be fired without substantially degrading the structural integrity of frosting ink image 222.

A Process for Making a Ceramic Decal Assembly

FIG. 24 is a flow diagram of one preferred process of the invention. Referring to the process depicted in FIG. 24, and in step 400 thereof, a decal is prepared which can thereafter be adhesively attached to a ceramic/glass substrate.

The decal to be prepared is preferably a digitally printed decal whose preparation is described elsewhere in this specification. One may prepare any of the ceramic decals described elsewhere in this specification.

Thus, by way of illustration, and referring to FIGS. 25A and 25B, one may prepare ceramic decal 401 and/or ceramic decal 402. When these embodiments are used, it is preferred that they comprise, in one preferred aspect of this embodiment, an "ethocel coated heat transfer paper." This term as used herein refers to heat transfer paper, i.e., commercially available paper with a wax coating possessing a melt point in the range of from about 65 to about 85 degrees Centigrade which is coated with a layer of ethylcellulose which, in one embodiment, is about 10 grams/square meter thick. Such heat transfer paper is discussed, e.g., in U.S. Pat. Nos. 6,126,669, 6,123,794, 6,025,860, 5,944,931, 5,916,399, 5,824,395, 5,032,449, and the like. The entire disclosure of each of these U.S. patents is hereby incorporated by reference into this specification.

As will be apparent, what each of decals 401 and 402 have in common is a substrate 226. This substrate 226, which is typically paper, is described elsewhere in the specification. However, this substrate may be any type of flat, thin, flexible sheet, for example, polyester or polyolefin films, non-woven sheets and the like. The substrate for the decal should first be coated with a wax/resin release layer and then a covercoat layer which has also been described elsewhere in this specification. The covercoated substrate should have the characteristics of being able to receive a thermally printed digital image from the various thermal transfer ribbons described elsewhere in this specification. After printing onto such coated substrates, a ceramic decal is formed. A further characteristic of the these decals is that, after the decal has been attached to the glass or ceramic substrate, the substrate on which the decal was formed must be able to be cleanly separated from the image. This separation should occur between the wax/resin release layer and the covercoat such that the covercoat and the image remain entirely on the glass and ceramic substrate.

As will also be apparent, each of the decals 401 and 402 has a wax release layer 36 in common. This wax release layer 36 preferably has a thickness of from about 0.2 to about 2.0 microns and comprises at least about 50 weight percent of wax.

As will also be apparent, each of the decals 401 and 402 also comprise a transferable covercoat layer 242. In one embodiment, the transferable covercoat layer 242 is comprised of ethylcellulose. Such a covercoat is prepared by dissolving 12 grams of ethylcellulose with a mixture of 16.4 grams of isopropyl alcohol, 68.17 grams of toluene, and 3.42 grams of dioctyl pthalate that has been heated to 50 degrees Celsius. This solution thus formed is then applied to a wax/resin coated substrate with a Meyer rod to achieve a coating weight of about 10 grams/square meter. Thus, e.g., the transferable covercoat layer 242 may have the same composition as covercoat layer 224 (see FIG. 14) and/or covercoat layer 24. In this embodiment, covercoat layer 242 is comprised of at least about 25 weight percent of thermoplastic material with an elongation to break of greater than about 1 percent. In one embodiment, the covercoat layer 242 is comprised of at least about 50 weight percent of thermoplastic material with an elongation to break of greater than 1 percent. In another embodiment, the covercoat layer 242 is comprised of thermoplastic material with an elongation to break greater than 5 percent.

In each of the decals 401 and 402, disposed above the transferable covercoat layer 242 is either a frosted ink image 222 (decal 401), or a ceramic colorant image 20. As will be apparent, what each of these image layers has in common with the other is the presence of either opacification particles or colorant particles that have a particle size distribution such that at least about 90 weight percent of such particles are within the range of from about 0.2 to about 20 microns. In addition, both of these images must be comprised of film forming glass flux. The aforementioned opacification particles or colorant particles must have a refractive index of at least about 0.1 and preferably 0.2 units different from the refractive index of the film forming glass flux used in the image. In addition, the aforementioned opacification particles or colorant particles as well as the glass flux must be non-carbonaceous in their combination and essentially inorganic such that they remain on the glass or ceramic substrate after firing. Both of these images must also have the capability to alter the visual appearance of the glass or ceramic substrates, in an image-wise fashion, after the substrates have been fired to visually reveal the intended decoration of said substrates.

Referring again to FIG. 24, and in step 410 thereof, a pressure sensitive transfer adhesive assembly is prepared. As is indicated in FIG. 26, the pressure sensitive transfer adhesive assembly is preferably comprised of pressure sensitive transfer adhesive. These adhesives, and assemblies comprising them, are well known to those in the art. Reference maybe had, e.g., to U.S. Pat. Nos. 5,319,475, 6,302,134, reissue 37,036, 6,063,589, 5,623,010, 5,059,964, 5,602,202, 6,284,338, 6,134,892, 5,931,000, and the like. Reference may be had, e.g., to U.S. patent applications 20010001060A1, 20020015836A1, and the like. Reference may be had to international patent publications EP0530267B1, EP0833965B1, EP0833866B1, WO9700922A1, WO9700913A1, EP0576530B2, and the like. The entire disclosure of each of these patent publications is hereby incorporated by reference into this specification.

Pressure sensitive adhesives are also described at, e.g., pages 724–735 of Irving Skeist's "Handbook of Adhesives," Second Edition (Van Nostrand Reinhold Company, New York, N.Y., 1977). These adhesives are often composed of a rubbery type elastomer combined with a liquid or solid resin tackifier component.

Pressure-sensitive acrylic adhesives are often used. The acrylate pressure-sensitive adhesives are often a copolymer of a higher alkyl acrylate, such as, e.g., 2-ethylehexyl acrylate copolymerized with a small amount of a polar comonomer. Suitable polar comonomers include, e.g., acrylic acid, acylamide, maleic anhydride, diacetone acrylaminde, and long chain alkyl acrylamides.

In one preferred embodiment, the pressure sensitive transfer adhesive is an acrylic pressure sensitive transfer adhesive. These adhesives are also well known. Reference may be had, e.g., to U.S. Pat. No. 5,623,010 (acrlate-containing polymer blends and methods of using), U.S. Pat. Nos. 5,605,964, 5,602,202 (methods of using acrylate-containing polymer blends), U.S. Pat. Nos. 6,134,892, 5,931,000, 5,677,376 (acrylate-containing polymer blends), U.S. Pat. No. 5,657,516, and the like. The entire disclosure of each of these U.S. patents is hereby incorporated by reference into this specification.

One suitable pressure sensitive transfer adhesive assembly is sold as "Arclad 7418" by Adhesives Research, Inc. of 400 Seaks Run Road, Glen Rock, Pa. This assembly is comprised of an acrylic adhesive and a densified kraft liner.

Other laminating adhesive assemblies also may be used in the process of this invention. Reference may be had, e.g., to U.S. Pat. No. 5,928,783 (pressure sensitive adhesive compositions), U.S. Pat. No. 5,487,338, 5,339,737, and the like. Reference may also be had to European patent publications EP0942003A1, EP0684133B1, EP0576128A1, and the like.

Referring again to FIG. 26, and in the preferred embodiment depicted therein, the pressure sensitive adhesive assembly 410 is comprised of pressure sensitive adhesive 412, silicone release coating 413, transfer substrate 414, and silicone release coating 415. The adhesive assembly 410 preferably has a thickness 416 of less than about 100 microns, preferably being from about 1 to about 20 microns thick. More preferably, the adhesive assembly 410 has a thickness 416 from about 0.1 to about 2 microns thick.

In one embodiment, the pressure sensitive transfer adhesive is comprised of at least 95 weight percent of carbonaceous material and less than about 5 weight percent of inorganic material.

Referring again to FIG. 24, and in step 420 of the process, the decal provided in step 400 and the pressure-sensitive transfer adhesive assembly provided in step 410 are pressure laminated to form a composite laminated structure (see FIG. 27). This pressure lamination process is well known to those skilled in the art. Reference may be had, e.g., to U.S. Pat. Nos. 6,120,882, 5,866,236, 5,656,360, 5,100,181, 5,124,187, 6,270,871, 5,397,634, and the like. The entire disclosure of each of these U.S. patents is hereby incorporated by reference into this specification.

In the preferred embodiment depicted in FIG. 27, the composite assembly is pressure laminated with pressure rollers 425, preferably using a light pressure of less than about 1 pound per square inch. It is preferred to remove substantially all air and/or other gases between adjacent contiguous surfaces in this process.

Referring again to FIG. 24, and in step 430 thereof, the release paper (comprised of the transfer substrate 414, with silicone release coatings 413/415 on its opposed surfaces) is stripped away from the pressure sensitive adhesive 412 to form a pressure-sensitive adhesive decal. This process step 430 is schematically illustrated in FIG. 28.

Referring again to FIG. 24, and in step 440 thereof, the pressure sensitive adhesive decal is laminated to either a glass or a ceramic substrate with light pressure (less than about 1 pound per square inch) by pressure lamination; reference may be had to FIG. 29, wherein this step 440 is schematically illustrated.. This step 440 will leave the paper 226 and the wax release layer 36 indirectly attached to the glass or ceramic substrate 12. Alternatively, the glass or ceramic article may be directly coated or laminated with a pressure sensitive adhesive. Such an article may then be directly laminated to the decal as in Step 440, eliminating Steps 420 and 430.

Thereafter, and referring again to FIG. 24, in step 450 the wax/resin coated paper or substrate 226 is peeled away from the covercoat 242 of the ceramic decal assembly. The assembly that remains after this step is illustrated in FIG. 31.

The assembly depicted in FIG. 31 is comprised of a frosted ink image 222. As will be apparent, this will be obtained when decal 401 is used (see FIG. 25A). When decal 402 is used (see FIG. 25B), a ceramic colorant image 20 will be obtained.

Referring again to FIG. 24, and in step 460 of the process depicted, the ceramic/glass assembly is then fired to burn off substantially all of the carbonaceous material in the assembly. In general, the assembly is subjected to a temperature of from at least about 350 degrees Centigrade for at least about 5 minutes.

Thereafter, in step 470 of the process (see FIG. 24), the fired substrate is measured to determine its optical quality. The optical quality of a fired substrate may be determined, e.g., by comparing the optical density of the image on the fired substrate with the optical density of the image on the unfired substrate.

Applicants' process unexpectedly produces a fired product whose optical properties are substantially as good as, if not identical to, the optical properties of the unfired product.

As is illustrated in FIG. 32, the unfired substrate assembly 473 is preferably analyzed by optical analyzer 471. Thereafter, the fired substrate assembly 475 is analyzed by optical analyzer 471. The optical properties of the fired substrate 475 are preferably at least about 80 percent as good as the optical properties of the unfired substrate 473.

In one embodiment, a pattern recognition algorithm (not shown) is used to compare the unfired image on assembly 473 to the fired image on assembly 475. The use of pattern recognition algorithms for the purpose is well known. Reference maybe had, e.g., to U.S. Pat. No. 6,278,798 (image object recognition), U.S. Pat. Nos. 6;275,559, 6,195,475, 6,128,561, 5,024,705, 6,017,440, 5,838,758, 5,264,933, 5,047,952, 5,040,232, 5,012,522 (automated face recognition), and the like. The entire disclosure of each of these U.S. patents is hereby incorporated by reference into this specification.

One or more matching algorithms may be used to compare these optical qualities. These algorithms, and their uses, are well known. See, e.g., U.S. Pat. No. 6,041,137 (handwriting definition), U.S. Pat. Nos. 5,561,475, 5,961, 454, 6,130,912, 6,128,047, 5,412,449, 4,955,056 (pattern recognition system), U.S. Pat. Nos. 6,031,980, 5,471,252, 5,875,108, 5,774,357, and the like. The entire disclosure of each of these U.S. patents is hereby incorporated by reference into this specification.

In one embodiment, illustrated in FIG. 32, when the substrate 12 is a clear substrate (such as, e.g., glass), one may measure and compare the transmission density of the unfired and fired optical images by means of, e.g., a densitometer. In another embodiment, illustrated in FIG. 32, when the substrate 12 is an opaque substrate, one may measure and compare the reflection density of the unfired and fired optical images by means of, e.g., a densitometer. Such uses of a densitometer are well known. Reference may be had, e.g., to U.S. Pat. No. 3,614,241 (automatic recording densitometer which simultaneously determines and records the optical density of a strip of photographic film), U.S. Pat. Nos. 5,525,571, 5,118,183, 5,062,714, and the like. The entire disclosure of each of these U.S. patents is hereby incorporated by reference into this specification.

Referring again to FIG. 32, and in particular to fired assembly 475, it will be seen that, in the embodiment depicted, in areas 477, 479, 481, and 483 some or all of the image has been eroded during the firing. Without wishing to be bound by any particular theory, applicants believe that this erosion can occur when gases are formed during the firing and disrupt the layer 22 as they escape from the fired assembly.

Regardless of the cause of such erosion, its existence damages the optical properties of the fired substrate. The process of the instant invention produces a product in which such erosion is substantially absent.

One may determine the difference in opacity between the unfired frosted ink image 222 and the fired frosted ink image with standard TAPPI test T519. This difference in opacity is often referred to as the "delta opacity," and it preferably is less than about 15 percent. In one embodiment, such delta opacity is less than about about 8 percent. In yet another embodiment, such delta opacity is less than about 2 percent.

A Covercoated Transfer Sheet

In this portion of the specification, applicants discuss a covercoated transfer sheet suitable for transferring images to a ceramic substrate. This covercoated transfer sheet is comprised of a flat, flexible substrate and a transferable covercoat releaseably bound to said flat, flexible substrate, wherein, when said transferable covercoat is printed with an image to form an imaged covercoat, said image has a higher adhesion to said covercoat than said covercoat has to said flexible substrate, said imaged covercoat has an elongation to break of at least about 1 percent, and said imaged covercoat can be separated from said flexible substrate with a peel force of less than about 30 grams per centimeter.

FIG. 33 is a schematic illustration of one preferred embodiment of a covercoat transfer assembly 550 that is comprised of a transferable covercoat 242 (see FIG. 16) coated onto a flexible substrate 510.

The transferable covercoat 242 used in assembly 550 may comprise ethyl cellulose. Alternatively or additionally, the covercoat 242 may comprised of styrenated acrylic resin, polyvinyl butyral, polyester, polyvinyl chloride, polyethylene-co-vinylaceate, polybutylmethacrylate, polymethylmethacrylate, polystyrene-co-butadiene, polyvinylacetate, and the like. In general, the covercoat is preferably comprised of at least about 70 weight percent of one or more of these polymeric entities.

In one embodiment, the covercoat 242 is similar in many respects to, and/or identical to, covercoat 24 (see FIG. 1).

The transferable covercoat 242, after being subjected to a temperature of 550 degrees Celsius for 10 minutes, preferably produces less than about 1 weight percent of ash, based upon the weight of the uncombusted covercoat.

The transferable covercoat 242 may optionally contain from about 2 to about 80 weight percent (by total weight of the covercoat) of one or more of the frits described elsewhere in this specification. In one preferred embodiment, the covercoat 242 is comprised of from about 50 to about 60 weight percent of such frit.

The transferable covercoat 242 may also optionally contain from about 1 to about 40 weight percent of opacifying agent, by total weight of covercoat. In one embodiment, both such flit and such opacifying agent are present in the covercoat 242, the amount of frit and the amount of opacifying agent, in combination, exceeds the amount of binder in the covercoat 242, and the amount of flit in the covercoat 242 exceeds the amount of opacifying agent.

The covercoat 242 contains from 20 to about 100 weight percent of one or more of the binders described elsewhere in this specification. When the covercoat 242 also contains frit and/or opacifying agent, then the covercoat 242 is comprised of less than about 50 weight percent of such binder.

The transferable covercoat 242 may also optionally contain from about 1 to about 40 weight percent of inorganic pigment, by total weight of covercoat. In one embodiment, both such frit and such pigment are present in the covercoat 242, the amount of frit and the amount of pigment, in combination, exceeds the amount of binder in the covercoat 242, and the amount of frit in the covercoat 242 exceeds the amount of pigment.

The covercoat 242 contains from 20 to about 100 weight percent of one or more of the binders described elsewhere in this specification. When the covercoat 242 also contains frit and/or pigment, then the covercoat 242 is comprised of less than about 50 weight percent of such binder.

Referring again to FIG. 33, it will be seen that the flexible substrate 510 is similar to the substrate 226 (see FIG. 14). It is preferred that flexible substrate 510 be smooth, uniform in thickness, and flexible.

In one embodiment, the flexible substrate 510 has a surface energy of less than about 40 dynes per centimeter. Surface energy, and means for measuring it, are well known to those skilled in the art. Reference may be had, e.g., to U.S. Pat. No. 5,121,636 (surface energy meter), U.S. Pat. Nos. 6,225,409, 6,221,444, 6,075,965, 6,007,918, 5,777,014, and the like. The entire disclosure of each of these U.S. patents is hereby incorporated by reference into this specification.

In one embodiment, the flexible substrate 510 has a surface energy of less than about 30 dynes per centimeters.

In one preferred embodiment, the flexible substrate 510 either consists essentially of or is comprised of at least 80 weight percent of a synthetic polymeric material such as, e.g., polyethylene, polyester, nylon, polypropylene, polycarbonate, poly(tetrafluoroethylene), fluorinated polyethylene-co-propylene, polychlorotrifluoroethylene, and the like.

In one preferred embodiment, the flexible substrate 510 is comprised of at least about 90 weight percent of polyethylene or polypropylene or polybutylene, or mixtures thereof.

The flexible substrate 510 preferably has a thickness 512 of from about 50 microns to about 250 microns. In one embodiment.

It is preferred that the thickness 512 of substrate 510 not vary across the substrate 510 by more than about 15 percent.

In one embodiment, the substrate 510 does soften when exposed to organic solvent(s) or water.

In one embodiment, the flexible substrate 510 is adapted to separate from a transferable covercoat 242 upon the application of minimal force. Thus, e.g., and referring to FIG. 33, the flexible substrate 510 is preferably adapted to release from covercoat 242 upon the application of a linear stress of less than about 100 grams per centimeter and, more preferably, less than about 30 grams per centimeter at a temperature of 20 degrees Celsius. It is preferred that the peel strength required to separate the covercoat 242 be less than about 15 grams per centimeter at 20 degrees Celsius.

One may determine the force required to separate a covercoat from a flexible substrate by a test in which 1.27 centimeter×20.32 centimeter strips of cover coated substrate are prepared. The covercoat is then manually separated at 20 degrees Celsius from the substrate backing for 2.54 centimeters at the top of each strip. Each half of the strip is then mounted in the grips of an tensile device manufactured by the Sintech Division of MTS Systems company (P.O. Box 14226, Research Triangle Park, Raleigh, N.C. 22709) and identified as Sintech model 200/S. 200/S). Such use of the Sintech 200/S machine is well known. Reference may be had to, e.g., international patent publications W00160607A1, W00211978A, W00077115A1, and the like. The entire disclosure of each of these patent publications is hereby incorporated by reference into this specification. The peel adhesion is measured at 25.4 centimeters per minute with a 5 pound load cell at a temperature of 20 degrees Celsius and ambient pressure.

FIG. 34 is a schematic illustration of an assembly 552 that is similar to the assembly 550 (see FIG. 33) but also incorporates a release layer 500 and a flexible substrate 511.

The flexible substrate 511 is similar to the flexible substrate 510 but does not necessarily have the same surface energy. In one embodiment, the surface energy of flexible substrate 511 is less than 60 dynes per centimeter. In this embodiment, the flexible substrate 511 preferably is comprised of at least about 80 weight percent or consists essentially of a cellulosic material such as, e.g., paper.

When paper is used as the flexible substrate 511, it preferably has a basis weight of at least about 50 to about 150 grams per square meter. In one embodiment, the basis weight of the paper 511 is from about 70 to about 110 grams per square meter.

In one embodiment, the substrate 511 is a 90 gram per square meter basis paper made from bleached softwood and hardwood fibers. The surface of this paper is sized with starch.

In the embodiment depicted in FIG. 34, the flexible substrate/paper 511 is preferably coated with and contiguous with a release layer 500. Thus, e.g., the paper 511 may be coated with a release layer by extrusion coating a polyethylene and wax mixture to a coatweight of 20 grams per square meter.

The release layer 500 is similar to wax release layer 36, but it need not necessarily comprise wax. The release layer 500 does comprise a material that, when coated upon the flexible substrate 511, provides a smooth surface with a surface energy of less than about 40 dynes per centimeter.

In one embodiment, the release layer 500 is comprised of a polyolefin, such as, e.g., polyethylene, polypropylene, polybutylene, and mixtures thereof.

In one embodiment, it is preferred to coat the release layer 500 onto the substrate 511 by means of extrusion, at a temperature of from about 200 to about 300 degrees Celsius. Extrusion coating of a resin is well known. Reference may be had, e.g., to U.S. Pat. Nos. 5,104,722, 4,481,352, 4,389, 445, 5,093,306, 5,895,542, and the like. The entire disclosure of each of these U.S. patents is hereby incorporated by reference into this specification.

It is preferred that the release layer coating 500 be substantially smooth. In one embodiment, the coated substrate has a Sheffield smoothness of from about 10 to about 150 and, more preferably, from about 10 to about 40 Sheffield Units. Means for determining Sheffield smoothness are well known. Reference may be had, e.g., to U.S. Pat. Nos. 5,451,559, 5,271,990 (image receptor heat transfer paper), U.S. Pat. Nos. 5,716,900, 6,332,953, 5,985,424, and the like. The entire disclosure of each of these U.S. patents is hereby incorporated by reference into this specification.

Similarly, the uncoated substrate 510 (see FIG. 33) also has a surface energy of less than 40 dynes per centimeter and smoothness of from about 10 to about 150 Sheffield Units.

Referring again to FIG. 34, and in the preferred embodiment depicted therein, the release layer may be of any composition that will produce the desired surface energy and smoothness upon coating the substrate 511. Thus, by way of illustration and not limitation, one may utilize a cured silicone release layer. Release layers comprised of silicone are well known. Reference may be had, e.g., to U.S. Pat. No. 5,415,935 (polymeric release film), U.S. Pat. No. 5,139,815 (acid catalyzed silicone release layer), U.S. Pat. Nos. 5,654,093, 5,761,595, 5,543,231 (radiation curable silicone release layer), and the like. The entire disclosure of each of these U.S. patents is hereby incorporated by reference into this specification.

By way of further illustration, one may use fluoropolymer release agents See, e.g., U.S. Pat. No. 5,882,753 (extrudable release coating), U.S. Pat. Nos. 5,807,632, 6,248,435, and the like. The entire disclosure of each of these U.S. patents is hereby incorporated by reference into this specification.

The following Examples are presented to illustrate the claimed invention but are not to be deemed limitative thereof. Unless otherwise specified, all parts are by weight, and all temperatures are in degrees Celsius.

In these examples a flexible substrate was used. The flexible substrate was a 90 gram per square meter basis paper made from bleached softwood and hardwood fibers. The surface was sized with starch. This base paper was coated with a release layer by extrusion coating a polyethylene and extrudable wax (Epolene, from Eastman Chemical Corporation of Kingsport, Tenn.) mixture to a coatweight of 20 gram per square meter.

The examples described below contain a variety of cover-coated flexible substrates. In each of such examples, a rectangular solid fill image was printed onto the cover coated flexible substrate with a frosting ink ribbon using a Zebra 170X11 printer at an energy level setting of 25 and a print speed of 2 inches per minute to prepare a frosting ink decal.

In the experiments described in these examples, the frosting ink ribbon was prepared by the following procedure:: A 4.5 micron thick poly (ethylene terephthalate) film (Toray F31) was used as a substrate film, and it was backcoated with a polydimethylsiloxane-urethane copolymer SP-2200 crosslinked with D70 toluene diisocyanate prepolymer (both of which are sold by the Advanced Polymer Company of New Jersey) at a coat weight of 0.03 grams per square meter. The copolymer composition was applied with a Myer Rod and dried in an oven at a temperature of 50 degrees Centigrade for 15 seconds.

A release coating composition was prepared for application to the face coat of the polyester film. To a mixture of 38 grams of reagent grade toluene and 57 grams of reagent grade isopropyl alcohol were charged 0.58 grams of Diacarna 3B (an alpha-olefin sold by by the Mitsubishi Kasai Company of Japan), 0.6 grams of EVALEX V577 (an ethylene-vinylacetate resin sold by the DuPont Mitsui and Polychemicals Company of Japan), and 3.82 grams of "POLYWAX 850" (a polyethylene wax sold by the Baker Hughes Baker Petroline Company of Sugarland, Tex.). This mixture was stirred until the components were fully dissolved. Then it was coated with a Myer Rod at a coating weight of 0.5 grams per square meter and thereafter dried for 15 seconds at 50 degrees Centigrade. The polyester film, with its backcoating and release coating, then was coated with a frosted ink layer at a coating weight of 5.6 grams per square meter; the frosted ink layer was applied to the release layer. The frosted ink was prepared by mixing 60.0 grams of hot toluene (at a temperature of 60 degrees Centigrade) with 14.73 grams of a mixture of Dianal BR 106 and Dianal BR 113 binders in weight/weight ratio of 1/3; these binders were purchased from the Dianal America Company of Pasadena, Tex. Thereafter, 3.99 grams of dioctyl pthalate (sold by Eastman Chemical, Kingsport, Tenn.), 48.8 grams of Unleaded Glass Flux 23901 (sold by Johnson Matthey Ceramic Inc. of Downington, Pa.) with a refractive index of 1.4, 9.04 grams of Onglaze Unleaded Glass Flux 94C1001 (sold by Johnson Matthey Ceramic Inc. of Downington, Pa.) with a refractive index of 1.7, 8.17 grams of Superpax Zircon Opacifier (sold by Johnson Matthey Ceramic Inc. of Downington, Pa.) with a refractive index of 1.9, 8.17 grams of Cantal 290 (sold by Canada Talc, Marmora, Ontario, Canada), and 1.59 grams of Cerdec 1795 Black Oxide (sold by Cerdec-DMC$^2$, Washington, Pa.) were charged to the mixture. The composition thus produced was mixed with 50 grams of ceramic grinding media and milled on a paint shaker for 15 minutes until substantially all of the particles were smaller than 10 microns. Thereafter, 5.48 grams of Unilin 425 (a wax sold by the Baker Hughes Baker Petrolite Company) were dissolved in sufficient reagent grade methylethylketone to prepare a 15 percent solution, and this wax solution was then charged to the mixture with stirring, until a homogeneous mixture was obtained. Thereafter the mixture was filtered to separate the filtrate from the grinding media, and the filtrate was then coated onto the release layer of the polyester substrate at a coating weight of 5.6 grams per square meter using a Meyer Rod. The coated substrate thus produced was then dried with a hot air gun.

A transfer adhesive was prepared by mixing 61 grams of the UCAR 9569 acrylic emulsion (sold by the Union Carbide Corporation, a subsidiary of the Dow Chemical Company, Danbury, Conn.) with 32 grams of UCAR 413 acrylic emulsion (sold by the Union Carbide Corporation) and 6 grams of the BYK 438 polyether modified siloxane surfactant (sold by the Byk-Chemie USA company of Wallingford, Conn.)).

The transfer adhesive thus formed was then coated via Myer rod at a 5 grams coatweight to a 2 mil thick release liner coated with a ultraviolet-curable release coating known as UV10 (purchased from the CPFilms company of Greenboro, Va.). This adhesive coated liner was then laminated to a second 1 mil thick release liner coated with a platinum cured release coating known as P10 (also purchased from such CPFilms company).

A decal was then prepared by affixing the imaged, cover-coated transfer paper to a flat surface by taping the corners down.

The UV10 release liner of the adhesive was removed, and adhesive was placed adhesive side down onto the imaged transfer paper. The adhesive and paper were laminated to produce contact and remove air bubbles. The P10 release liner was then removed, and the transfer adhesive remained with the imaged decal.

The adhesive side of the decal was then positioned over the glass substrate and laminated to it as air bubbles were removed. The backing paper was then peeled away leaving the frosting ink image and cover coat on the glass.

The glass, adhesive and frosting ink image were then fired in a kiln for 10 minutes at 1150 degrees Fahrenheit (132 degrees Centigrade). This thermal treatment caused the carbonaceous materials in the frosting ink as well as the cover coat to burn away, leaving the mixture of film forming glass frit and opacifying agents on the glass sheet. The opacifying agents remained dispersed in this film, thus rendering the film translucent yet not transparent.

In the examples described hereinbelow, the frosting ink image was characterized for opacity. The test for determining opacity was carried out according to the Tappi Standard T519.

In the Examples presented below, adhesion of the cover coat to the paper was measured by cutting 0.5 inch wide×8 inch long strips of cover coated paper. The covercoat was manually separated from the paper backing for one inch at the top of the strip. Each half of the strip was mounted in the grips of the Sintech 200/S tensile apparatus described elsewhere in this specification. The peel adhesion was measured at room temperature (20 degrees Celsius) and at 25.4 centimeters per minute with a 5 pound load cell.

In the experiments of the examples, elongation at break (at 20 degrees Celsius) of the cover coat to the paper was measured by cutting 0.5" wide×8 inch long strips of cover coated paper. The covercoat was then separated form the paper backing, this free film of covercoat was mounted in the grips of the MTS Sintech 200/S tensile apparatus. The free film of coveroat was then pulled to determine the elongation at break of the film. The pull was performed at 5 inches per minute with a 5 pound load cell. The film thickness of each free film was measured using the Mahr micrometer.

In these examples, the covercoat was prepared in substantial accordance with the procedure described hereinabove.

EXAMPLE 1

A covercoat coating composition was prepared for application to the face coat of the paper. The cover coat was prepared by coating Joncryl 617 (a styrene/acrylic emulsion sold by Johnson Polymers, Racine, Wis.) at a dry coat weight of 10 grams per square meter using a Meyer rod. The coated paper was then allowed to dry at ambient temperature for 16 hours.

In the experiment of this example, the styrenated acrylic covercoat cover coat had an adhesion value of 3.68 grams per centimeter, an elongation at break of 68.2 percent, and a delta opacity (as described elsewhere in this specification) of—5.27.

EXAMPLE 2

A covercoat coating composition was prepared for application to the face coat of the paper. The cover coat was prepared by dissolving 12 grams of Ethocel (an ethylcellulose sold by the Dow Corporation of Midland, Mich.) into 44 grams of methyl ethyl ketone and 44 grams of toluene that had been heated to a temperature of 70 degrees centigrade. This solution was coated onto the release sheet at 10 grams per square using a Meyer rod. The coated paper was then allowed to dry at ambient temperature for 16 hours.

In the experiment of this example, the ethylcellulose cover coat had an adhesion value of 2.8 grams per centimeter, an elongation at break of 41 percent, and a delta opacity of 5.27.

EXAMPLE 3

A covercoat coating composition was prepared for application to the face coat of the paper. The cover coat was prepared by dissolving 15 grams of Dynapoll 411 (a polyester sold by the Degussa-GoldSchmitt Company of Hopewell, Va.) into 75 grams of methyl ethyl ketone that had been heated to a temperature of 70 degrees centigrade. This solution was coated onto the release sheet at a dry weight of 10 grams per square using a Meyer rod. The coated paper was then allowed to dry at ambient temperature for 16 hours.

In the experiment of this example, the Polyester cover coat had an adhesion value of 17.7 grams per centimeter, an elongation at break at 20 degrees Celsius of 753 percent, and a delta opacity of 13.25.

EXAMPLE 4

A covercoat coating composition was prepared for application to the face coat of the paper. The cover coat was prepared by dissolving 20 grams of VROH (a vinylacetate vinylchloride sold by Dow Chemical Corporation of Midland, Mich.) into 80 grams of toluene that had been heated to a temperature of 70 degrees centigrade. This solution was coated onto the release sheet at a dry weight of 10 grams per square using a Mayer rod. The coated paper was then allowed to dry at ambient temperature for 16 hours.

In the experiment of this example, the vinylacetatevinylchloride cover coat had an adhesion value of 0.8 grams per centimeter, an elongation at break at 20 degrees Celsius of 1.7 percent, and a delta opacity of 10.34.

EXAMPLE 5

A covercoat coating composition was prepared for application to the face coat of the paper. The cover coat was prepared by dissolving 12 grams of Butvar 79 (a polyvinylbutyral sold by the Solutia Company of St. Louis, Mo.) into a mixture of 42 grams of isopropanol, 42 grams of 2-butanone and 4 grams of dioctyl phthalate (Eastman Chemical, Inc., Kingsport, Tenn.) that had been heated to a temperature of 70 degrees centigrade. This solution was coated onto the base paper at 10 grams per square using a Meyer rod. The coated paper was then allowed to dry at ambient temperature for 16 hours.

In the experiment of this example, the Polyvinylbutyral cover coat had an adhesion value of 0.7, an elongation at break of 7.7% and a delta opacity of 12.26.

EXAMPLE 6

The substrate used in this example was a silicone coated release sheet purchased from the Sappy Fine Paper Company N.A. of Westbrook, Mass.; the catalog description of the paper was Strip Kote BOR Super matte. A covercoat coating composition was prepared for application to the face coat of the paper. A covercoat of Elvax 240 (an ethylene vinyl acetate sold by Dupont of Wilmington, Del.) was extrusion coated onto the substrate at a temperature of 121 degrees Celsius at a coat weight of 30 grams per square meter.

In this example, the imaged decal was then transferred to a sheet of borosilicate glass (10 centimeters×10 centimeter×0.5 centimeters) by pressing the frosting ink decal against the glass sheet and heating this composite up to a temperature of 275 degrees Fahrenheit (132 degrees Centigrade). The glass, adhesive and frosting ink image were then fired in a kiln for 10 minutes at 1150 degrees Fahrenheit (132 degrees Centigrade).

In the experiment of this example, the covercoat had an adhesion value of 3.2 grams per centimeter, an elongation at break of 1,167 percent at 20 degrees Celsius, and a delta opacity of 1.95.

EXAMPLE 7

This example utilized the procedure described in Example 6, except the covercoat coating composition was prepared for application to the face coat of the paper. The cover coat was prepared by coating Joncryl 617 (a styrene/acrylic emulsion sold by Johnson Polymers, Racine, Wis.) at a dry coat weight of 10 grams per square meter using a Meyer rod. The coated paper was then allowed to dry at ambient temperature for 16 hours.

In the experiment of this example, the styrenated acrylic covercoat cover coat had an adhesion value of 3.68 grams per centimeter, an elongation at break of 68.2 percent, and a delta opacity (as described elsewhere in this specification) of–0.38.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A covercoated transfer sheet for transferring an image to a ceramic substrate, wherein said covercoated transfer sheet is comprised of a flat, flexible substrate and a transferable covercoat releaseably bound to said flat, flexible substrate, and wherein:

(a) when said transferable covercoat is printed with an image to form an imaged covercoat, said image has a higher adhesion to said covercoat than said covercoat has to said flexible substrate;

(b) said imaged covercoat has an elongation to break of at least about 1 percent;

(c) said imaged covercoat can be separated from said flexible substrate at a temperature of 20 degrees Celsius with a peel force of less than about 100 grams per centimeter; and (d) said flexible substrate has a surface energy of less than about 40 dynes per centimeter.

2. The covercoated transfer sheet as recited in claim 1, wherein said imaged covercoat can be separated from said flexible substrate at a temperature of 20 degrees Celsius with a peel force of less than about 30 grams per centimeter.

3. The covercoated transfer sheet as recited in claim 1, wherein said flexible substrate has a Sheffield smoothness of from about 10 to about 150 Sheffield units.

4. The covercoated transfer sheet as recited in claim 1, wherein said covercoat is comprised of from about 2 to about 80 weight percent of frit, by total weight of said covercoat.

5. The covercoated transfer sheet as recited in claim 4, wherein said covercoat is comprised of from about 1 to about 40 weight percent of opacifying agent, by total weight of said covercoat.

6. The covercoated transfer sheet as recited in claim 4, wherein said covercoat is comprised of from about 1 to about 40 weight percent of inorganic pigment, by total weight of said covercoat.

7. The covercoated transfer sheet as recited in claim 1, wherein said imaged covercoat has a delta opacity of less than about 15 percent.

8. The covercoated transfer sheet as recited in claim 1, wherein said imaged covercoat has a delta opacity of less than about 2 percent.

9. A covercoated transfer sheet assembly for transferring an image to a ceramic substrate, wherein said covercoated transfer sheet is comprised of a flat, flexible substrate, and release layer contiguous with said flexible substrate, and a transferable covercoat releaseably bound to said release layer, and wherein:

(a) when said transferable covercoat is printed with an image to form an imaged covercoat, said image has a higher adhesion to said covercoat than said covercoat has to said release layer;

(b) said imaged covercoat has an elongation to break of at least about 1 percent; and (c) said imaged covercoat can be separated from said release layer at a temperature of 20 degrees Celsius with a peel force of less than about 100 grams per centimeter; and (d) said release layer has a top surface, and said top surface of said release layer has a surface energy of less than about 40 dynes per centimeter.

10. The covercoated transfer sheet assembly as recited in claim 9, wherein said imaged covercoat can be separated from said release layer at a temperature of 20 degrees Celsius with a peel force of less than about 30 grams per centimeter.

11. The covercoated transfer sheet assembly as recited in claim 9, wherein said top surface of said release layer has a Sheffield smoothness of from about 10 to about 150 Sheffield units.

12. The covercoated transfer sheet assembly as recited in claim 9, wherein said covercoat is comprised of from about 2 to about 80 weight percent of frit, by total weight of said covercoat.

13. The covercoated transfer sheet assembly as recited in claim 12, wherein said covercoat is comprised of from about 1 to about 40 weight percent of opacifying agent, by total weight of said covercoat.

14. The covercoated transfer sheet assembly as recited in claim 12, wherein said covercoat is comprised of from about 1 to about 40 weight percent of inorganic pigment, by total weight of said covercoat.

15. The covercoated transfer sheet assembly as recited in claim 9, wherein said imaged covercoat has a delta opacity of less than about 15 percent.

16. The covercoated transfer sheet assembly as recited in claim 9, wherein said imaged covercoat has a delta opacity of less than about 2 percent.

* * * * *